US006257703B1

(12) United States Patent
Hirosawa et al.

(10) Patent No.: US 6,257,703 B1
(45) **Date of Patent: *Jul. 10, 2001**

(54) INK JET RECORDING HEAD

(75) Inventors: Toshiaki Hirosawa, Hiratsuka; Osamu Morita, Yokosuka; Osamu Sato, Chigasaki; Shogo Kawamura, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/901,109

(22) Filed: Jul. 28, 1997

(30) Foreign Application Priority Data

| | | |
|---|---|---|
| Jul. 31, 1996 | (JP) | 8-202247 |
| Jul. 31, 1996 | (JP) | 8-202249 |
| Jul. 31, 1996 | (JP) | 8-202568 |
| Sep. 9, 1996 | (JP) | 8-237858 |

(51) Int. Cl.[7] ..... B41J 2/14
(52) U.S. Cl. ..... 347/50; 347/58
(58) Field of Search ..... 347/58, 63, 65, 347/50

(56) References Cited

U.S. PATENT DOCUMENTS

| | | | | |
|---|---|---|---|---|
| 4,500,895 | * | 2/1985 | Buck et al. | 347/87 |
| 4,881,318 | * | 11/1989 | Komuro et al. | 29/827 |
| 4,933,808 | * | 6/1990 | Horton et al. | 361/770 |
| 4,985,710 | * | 1/1991 | Drake et al. | 347/63 |
| 5,057,854 | * | 10/1991 | Pond et al. | 347/42 |
| 5,164,747 | * | 11/1992 | Osada et al. | 347/19 |
| 5,220,345 | * | 6/1993 | Hirosawa | 347/17 |
| 5,285,216 | * | 2/1994 | Ota et al. | 347/223 |
| 5,343,227 | * | 8/1994 | Hirosawa et al. | 349/42 |
| 5,422,667 | * | 6/1995 | Daggs et al. | 347/87 |
| 5,442,386 | * | 8/1995 | Childers et al. | 347/63 |
| 5,646,659 | * | 7/1997 | Moriyama et al. | 347/55 |
| 5,657,539 | * | 8/1997 | Orikasa et al. | 29/890.1 |
| 5,821,961 | * | 10/1998 | Sato | 347/63 |
| 5,826,333 | * | 10/1998 | Iketani et al. | 29/890.1 |

FOREIGN PATENT DOCUMENTS

| | | | | |
|---|---|---|---|---|
| 0 430 692 | * | 6/1991 | (EP) . | |
| 0 593 175 | * | 4/1994 | (EP) . | |
| 605006 | * | 7/1994 | (EP) | 347/63 |
| 0 644 051 | * | 3/1995 | (EP) . | |
| 0 666 174 | * | 8/1995 | (EP) . | |
| 0 705 697 | * | 4/1996 | (EP) . | |
| 0 714 773 | * | 6/1996 | (EP) . | |
| 61-16862 | * | 1/1986 | (JP) | 347/58 |
| 5-254113 | * | 10/1993 | (JP) . | |
| 94/27827 | * | 12/1994 | (WO) . | |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink jet recording head comprises a main body section having a joined surface in which one end of an ink supply passage for introducing ink from an ink reserving portion is open, a support member having a first joint surface joined to the joined surface in the main body section and a second joint surface disposed opposite to the first joint surface, the support member having a communicating passage in communication with the one end of the ink supply passage, and a recording element board comprising an ink heating portion disposed on the second joint surface of the support member and arranged to heat the ink supplied through the communicating passage, and an ink ejection outlet forming portion in which an ink ejection outlet for ejecting the ink heated by the ink heating portion is formed, wherein thermal properties in materials of the recording element board and the support member are of the same quality.

11 Claims, 41 Drawing Sheets

INK JET RECORDING HEAD

BACKGROUND OF THE INVENTION

1. Field of the Invention

The present invention relates to an ink jet recording head for ejecting ink to a recording surface of a recording medium to obtain a recorded image thereon.

2. Related Background Art

There are practically available ink jet recording devices for selectively ejecting ink from a plurality of ink ejection outlets onto the recording surface of recording medium, based on recording data, thereby depositing the ink on the recording surface to form an image. Such ink jet recording devices have an ink jet recording head selectively mounted on a carriage portion, which is disposed opposite to the recording surface of recording medium and which is arranged to undergo scanning in directions perpendicular to the conveying direction of the recording medium.

The ink jet recording head of a side shooter type is comprised, for example as shown in FIG. 25, of main body section 2 consisting of ink supply section 2B, to which ink tank IT is mounted, and input terminal section 2A electrically connected to the carriage portion not illustrated and receiving a drive control signal group from the carriage portion; recording element board 6 joined to a joined surface in the ink supply section 2B of the main body section 2; and printed wiring board 4 electrically connected to the recording element board 6 and supplying the drive control signal group from the input terminal section 2A thereto.

The ink supply section 2B in the main body section 2 is formed, for example, in such a manner that block piece 8 made of an aluminum alloy is integrally molded in a resin, as shown in FIG. 26A. The ink supply section 2B is provided with ink supply passage 2*a* for guiding the ink from the ink tank IT thereinto. One opening end of the ink supply passage 2*a* is open in the joined surface 2*b* including a portion exposed to the outside in the block piece 8.

The recording element board 6 is comprised, as shown in FIG. 26B and FIG. 29, of substrate 10 having ink supply opening portion 10*c* in communication with the opening end of the ink supply passage 2*a* in the ink supply section 2B, partition member 12 for forming a plurality of ink branching supply passages 12*a* provided respectively corresponding to heaters 10*a* as ink heating portions in the substrate 10, and orifice plate 14 in which a plurality of ink ejection outlets 14*a* are arrayed in two parallel strings and opposite to the respective heaters 10*a* in the substrate 10.

The substrate 10 in the recording element board 6 is made of, for example, a silicon material of the thickness of 0.5 to 1.0 mm. Provided in the surface of the substrate 10 bonded to the joined surface 2*b* of the ink supply section 2B with an adhesive is ink supply opening portion 10*c* extending in the array direction of the ink ejection outlets 14*a* and opposite to the orifice plate 14, as shown in FIG. 27A and FIG. 26B.

Further, the heaters 10*a* are arranged at predetermined mutual intervals on either side of the ink supply opening portion 10*c* in the substrate 10. One ends of the ink branching supply passages 12*a* in the partition member 12 are in communication with the ink supply opening portion 10*c* and each ink branching supply passage 12*a* is arranged to guide the ink supplied through the ink supply opening portion 10*c* to the associated heater 10*a*.

The printed wiring board 4 is electrically connected to each electrode 10*b* of the substrate 10 in the recording element board 6, as shown in FIG. 29. The printed wiring board 4 has recording element board receiving section 4B in which the recording element board 6 is placed, and terminal section 4A disposed in the input terminal section 2A in the main body section 2.

In this arrangement, when a drive control signal is supplied to each heater 10*a* of the substrate 10 in the recording element board 6 through the printed wiring board 4 to heat the heater 10*a*, the ink introduced through the ink branching supply passages 12*a* is heated, bubbles are generated therein by the film boiling phenomenon, and with expansion of the bubbles thus generated, the ink is ejected from the ink ejection outlets 14*a* toward the recording surface of recording medium.

In the arrangement wherein the recording element board 6 in the printed wiring board 4 fixed to the main body section 2 is bonded to the joined surface 2*b* in the main body section 2 with the adhesive as described above, when the recording element board 6 is excited into the recording operation state as described above, the temperature of the block piece 8 in the joined surface 2*b* in the main body section 2 increases as the temperature of the recording element board 6 increases. This causes the recording element board 6 and block piece 8 to thermally expand. However, since there is a difference between an expansion coefficient of the recording element board 6 made of silicon and an expansion coefficient of the block piece made of the aluminum alloy, there would occur some cases wherein the recording element board 6 is deformed so that the arrays of ink ejection outlets near the central portion are so curved as to approach each other as deviating from the straight line as shown in FIG. 28, or cases wherein the recording element board 6 is broken. Especially, when a thermosetting adhesive is used, it might be deformed or broken.

In such cases, it is also conceivable to increase the thickness or the surface area in order to enhance the rigidity of the recording element board 6, but it is not wise, because it also increases the manufacturing cost of the recording element board 6.

SUMMARY OF THE INVENTION

In consideration of the above problem, an object of the present invention is to provide an ink jet recording head for ejecting the ink to the recording surface of recording medium to obtain the recorded image thereon, wherein, in bonding fixation of the recording element board to the main body section, the recording element board is prevented from breaking with change in the temperature of the recording element board, without increasing the manufacturing cost of the recording element board.

For achieving the above object, an ink jet recording head according to the present invention is an ink jet recording head comprising: a main body section having a joined surface in which one end of an ink supply passage for introducing ink from an ink reserving portion is open; a support member having a first joint surface joined to the joined surface in the main body section and a second joint surface disposed opposite to the first joint surface, the support member having a communicating passage in communication with the one end of the ink supply passage; and a recording element board comprising an ink heating portion disposed on the second joint surface of the support member and arranged to heat the ink supplied through the communicating passage, and an ink ejection outlet forming portion in which an ink ejection outlet for ejecting the ink heated by the ink heating portion is formed; wherein thermal properties in materials of the recording element board and the support member are of the same quality.

Another ink jet recording head according to the present invention is an ink jet recording head comprising: a main body section having a joined surface in which one end of an ink supply passage for introducing ink from an ink reserving portion is open; a first support member having a first joint surface joined to the joined surface in the main body section and a second joint surface disposed opposite to the first joint surface, the support member having a communicating passage in communication with the one end of the ink supply passage; a second support member joined to the second joint surface of the first support member; and a recording element board comprising an ink heating portion disposed inside the second support member, joined to the second joint surface of the first support member, and arranged to heat the ink supplied through the communicating passage, and an ink ejection outlet forming portion in which an ink ejection outlet for ejecting the ink heated by the ink heating portion is formed.

A further ink jet recording head according to the present invention is an ink jet recording head comprising: a main body section having a joined surface in which one end of an ink supply passage for introducing ink from an ink reserving portion is open; a first support member having a first joint surface joined to the joined surface in the main body section and a second joint surface disposed opposite to the first joint surface, the support member having a communicating passage in communication with the one end of the ink supply passage; a second support member joined to the second joint surface of the first support member; and a plurality of recording element boards, each recording element board comprising an ink heating portion disposed inside the second support member, joined to the second joint surface of the first support member, and arranged to heat the ink supplied through the communicating passage, and an ink ejection outlet forming portion in which an ink ejection outlet for ejecting the ink heated by the ink heating portion is formed; wherein thermal properties in a material of the first support member and a material of the recording element boards are of the same quality.

BRIEF DESCRIPTION OF THE DRAWINGS

FIG. 31A and FIG. 31B are complete assembly diagrams of the ink jet recording head shown in FIG. 30, wherein FIG. 31A is a perspective view of the appearance and FIG. 31B is a partially enlarged view of a cross section along 31B—31B shown in FIG. 31A;

FIG. 33A and FIG. 33B are complete assembly diagrams to show the ninth embodiment of the ink jet recording head according to the present invention, wherein FIG. 33A is a perspective view of the appearance and FIG. 33B is a partially enlarged view of a cross section along 33B—33B shown in FIG. 33A;

FIG. 35A and FIG. 35B are complete assembly diagrams of the ink jet recording head shown in FIG. 34, wherein FIG. 35A is a perspective view of the appearance and FIG. 35B is a partially enlarged view of a cross section along 35B—35B shown in FIG. 35A;

FIG. 37A and FIG. 37B are complete assembly diagrams of the ink jet recording head shown in FIG. 36, wherein FIG. 37A is a perspective view of the appearance and FIG. 37B is a partially enlarged view of a cross section along 37B—37B shown in FIG. 37A;

FIG. 38A and FIG. 38B are complete assembly diagrams to show the twelfth embodiment of the ink jet recording head according to the present invention, wherein FIG. 38A is a perspective view of the appearance and FIG. 38B is a partially enlarged view of a cross section along 38B—38B shown in FIG. 38A;

FIG. 39A, FIG. 39B, and FIG. 39C are drawings to show the thirteenth embodiment of the ink jet recording head according to the present invention, wherein FIG. 39A is a plan view of the support member, FIG. 39B is a cross-sectional view along 39B—39B shown in FIG. 39A, and FIG. 39C is an enlarged view of the cross section along 39B—39B after completion of assembly;

DESCRIPTION OF THE PREFERRED EMBODIMENTS (Embodiment 1)

Figure 1:
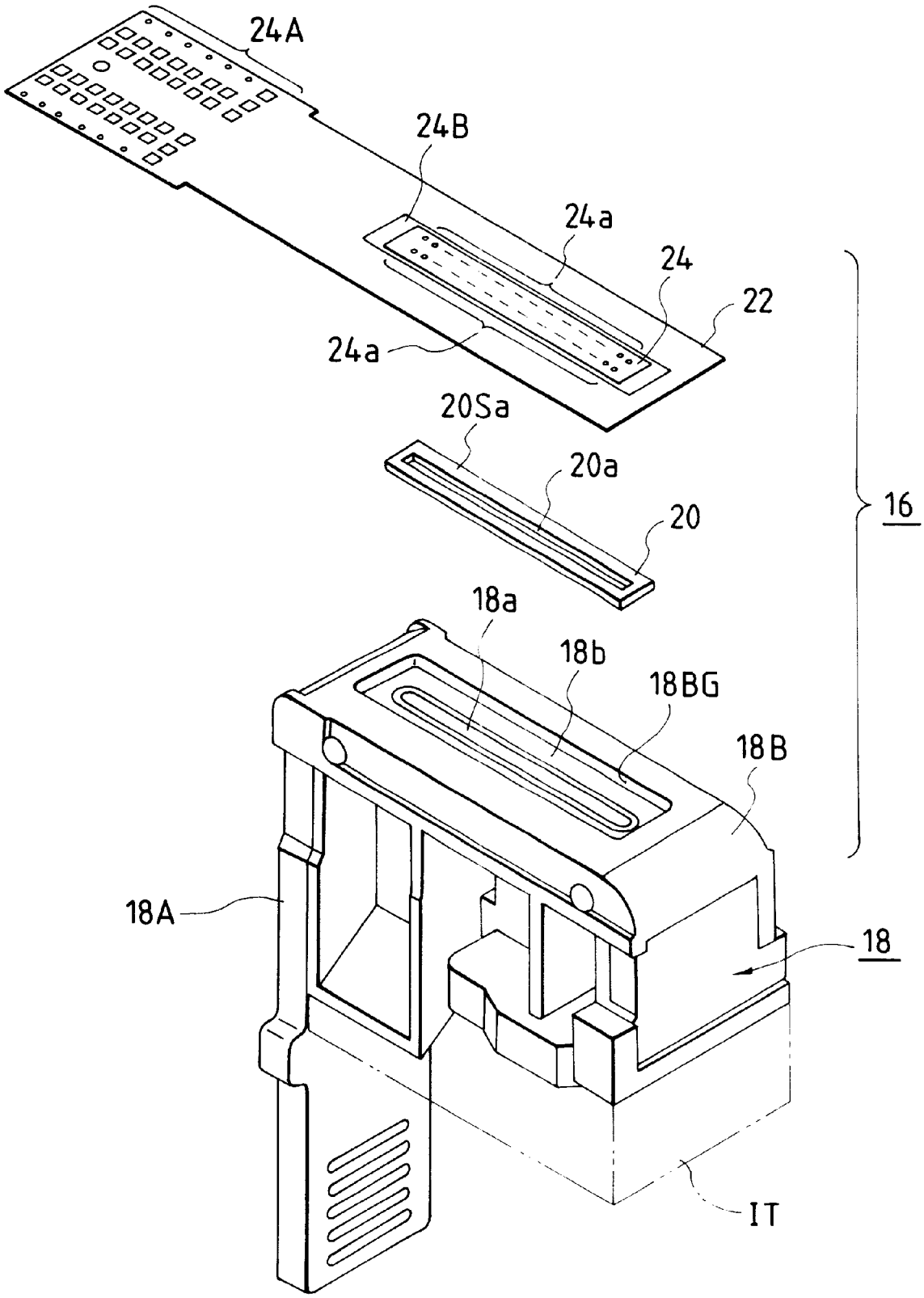
FIG. 1 is an exploded, perspective view to show the first embodiment of the ink jet recording head according to the present invention.

FIG. 1 schematically shows the major part of the first embodiment of the ink jet recording head according to the present invention.

In FIG. 1, the ink jet recording head 16 of the side shooter type is composed, for example, of the main body section 18 consisting of the ink supply section 18B, to which the ink tank IT is mounted, and the input terminal section 18A electrically connected to the carriage portion not illustrated and receiving the drive control signal group from the carriage portion; support member 20 joined to a joined surface 18*b* of recess 18BG in the ink supply section 18B of the main body section 18; the recording element board 24 bonded to an upper surface as a second joint surface in the support member 20; and the printed wiring board 22 electrically connected to the recording element board 24 and supplying the drive control signal group from the input terminal section 18A thereto.

Figure 2A:
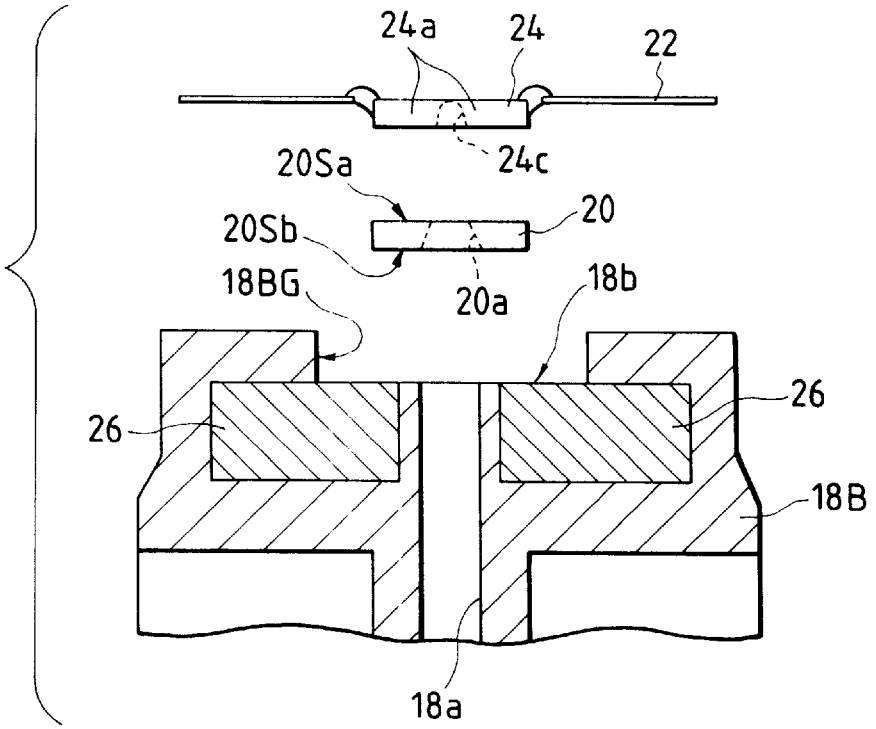
FIG. 2A and FIG. 2B are cross-sectional views in the example shown in FIG. 1.
Figure 2B:
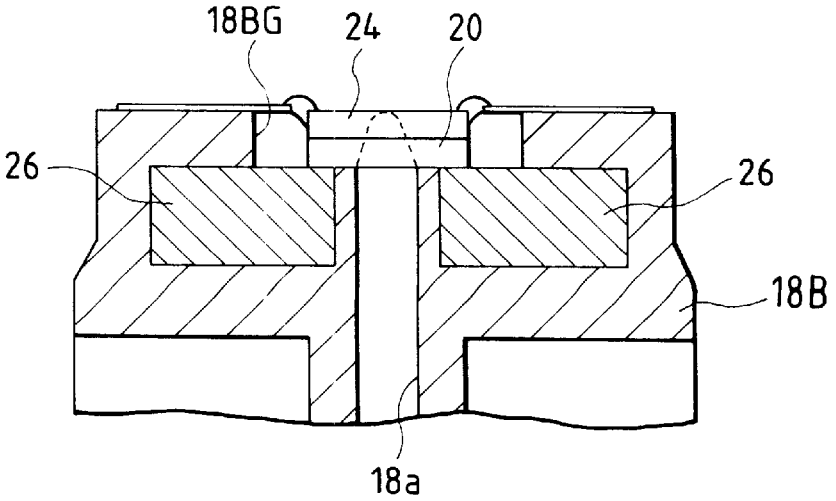

The main body section 18 is constructed in such a way that the input terminal section 18A and ink supply section 18B are integrally molded, for example, of a resin. As shown in FIG. 1 and FIGS. 2A, 2B, the generally rectangular recess 18BG is provided in the upper surface opposite to the mounting portion of ink tank IT in the ink supply section 18B of the main body section 18. The bottom of the recess 18BG is the joined surface 18*b* to which the support member 20 is bonded. Parts of the joined surface 18*b* are formed by the surface of block piece 26 made, for example, of an aluminum alloy. The block piece 26 is placed in the mold and is surrounded by a resin upon molding of the main body section 18. An elongate opening end of the ink supply passage 18*a* for introducing the ink from the ink tank IT is open at the nearly central portion of the joined surface 18*b*.

Figure 26A:
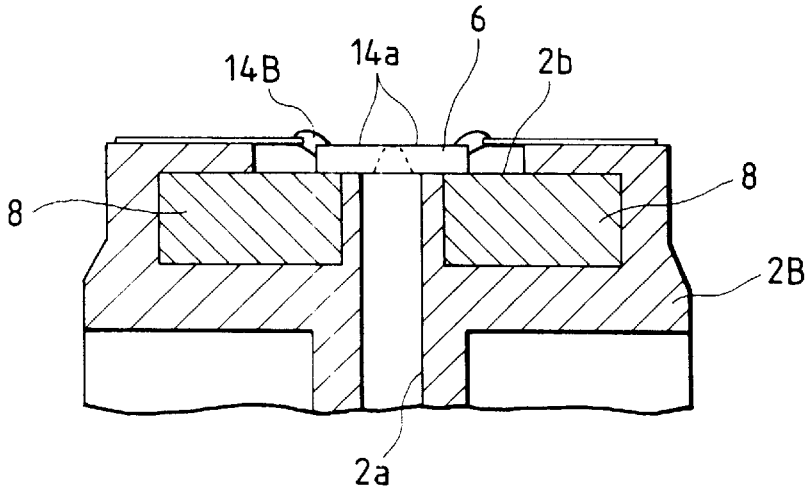
FIG. 26A and FIG. 26B are partial cross-sectional views in the example shown in FIG. 25.
Figure 26B:
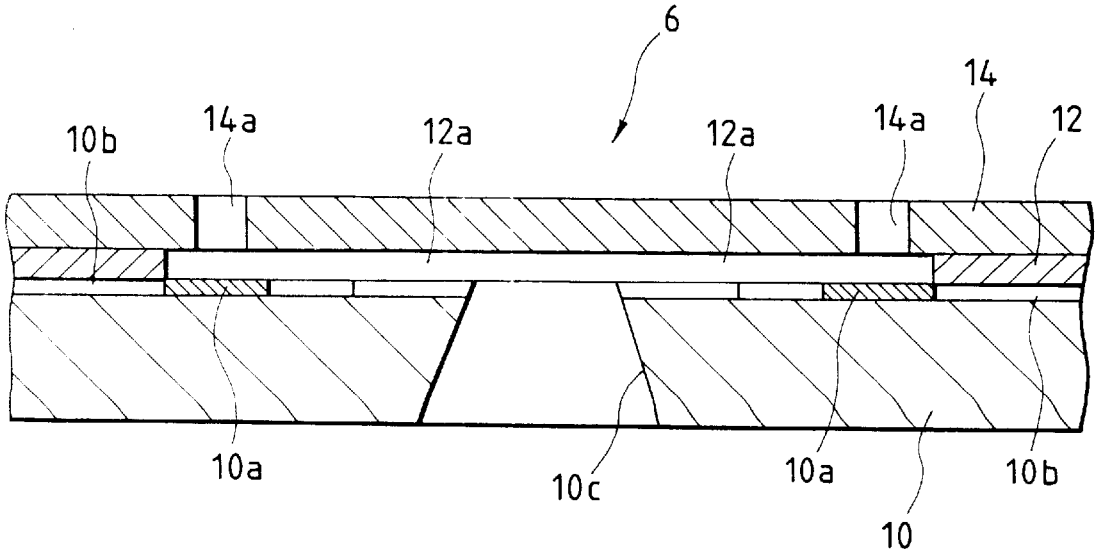
Figure 27A:
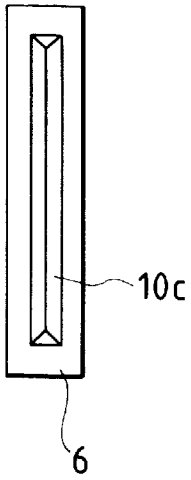
FIG. 27A and FIG. 27B are plan views to show the recording element board in the conventional apparatus.
Figure 27B:
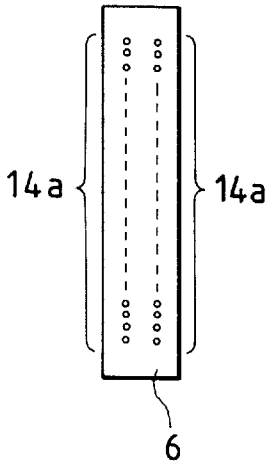
Figure 28:
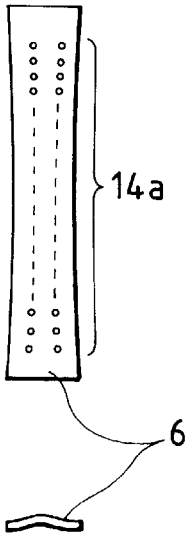
FIG. 28 is a plan view used for explanation of the operation of the recording element board in the conventional apparatus.
Figure 29:
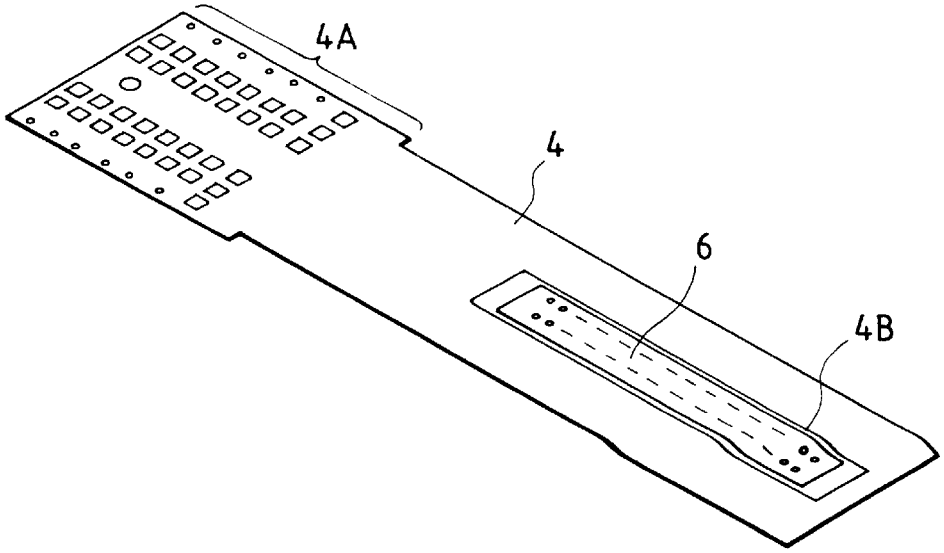
FIG. 29 is a perspective view to show the printed wiring board used in the apparatus shown in FIG. 25.

The recording element board 24 is constructed in the same structure as the recording element board 6 shown in FIG. 26B, and, therefore, detailed description of the internal structure thereof is omitted herein.

The substrate in the recording element board 24 is made of, for example, the silicon material of the thickness of 0.5 to 1.0 mm. Provided in the surface of the substrate to be bonded to the joined surface 18*b* of the recess 18BG of the ink supply section 18B with an adhesive is the ink supply opening portion 24*c* extending in the array direction of ink ejection outlets 24*a* and opposite to the orifice plate, as shown in FIG. 2A. Further, heaters not illustrated are arranged at predetermined mutual intervals on either side of the ink supply opening portion 24*c* in the substrate. One end of the ink branching supply passages in the partition member are in communication with the ink supply opening portion 24*c* and each ink branching supply passage guides the ink supplied through the ink supply opening portion 24*c* to the associated heater.

The printed wiring board 22 is electrically connected to each electrode of the substrate in the recording element board 24, as shown in FIG. 1 and FIGS. 2A and 2B. The printed wiring board 22 has the recording element board receiving section 24B, in which the recording element board 24 is placed, and the terminal section 24A disposed in the input terminal section 18A in the main body section 18. In bonding the printed wiring board 22 to the recording element board 24, they are connected, for example, by the TAB (Tape Automated Bonding) method.

The support member 20, which is placed between the recording element board 24 and the joined surface 18*b* of the recess 18BG of the ink supply section 18B, is formed in the rectangular plate shape, as shown in FIG. 1 and FIGS. 2A and 2B. The support member 20 is made, for example, of silicon, which is the same material as the recording element board 24. The material for the support member 20 is not limited to silicon, but the support member 20 may be made of any material having the coefficient of linear expansion equal to that of the material for the recording element board 24 and having the thermal conductivity equal to or higher than that of the material for the recording element board 24. The material for the support member 20 may be, for example, either one of alumina ($Al_2O_3$), aluminum nitride (AlN), silicon carbide (SiC), trisilicon tetranitride ($Si_3N_4$), molybdenum (Mo), and tungsten (W).

The support member 20 has, as shown in FIG. 2A, the second joint surface 20*sa,* which is bonded to the surface provided with the ink supply opening portion 24*c* in the recording element board 24, and the first joint surface 20*sb,* which is bonded to the joined surface 18*b* of the recess 18BG of the ink supply section 18B. The support member 20 is provided with a communicating passage 20*a* extending long in the longitudinal direction at the position corresponding to the ink supply opening portion 24*c* in the recording element board 24 and to the ink supply passage 18*a* formed in the joined surface 18*b* of the recess 18BG of the ink supply section 18B. Further, lengths of the shorter sides and longer sides of the support member 20 are equal to those of the shorter sides and longer sides, respectively, of the recording element board 24, and the thickness of the support member 20 is almost equal to that of the recording element board 24.

For placing the recording element board 24, to which the printed wiring board 22 is connected, the first joint surface 20*sb* of the support member 20 is first bonded to the predetermined position of the joined surface 18*b* with an adhesive. Subsequently, as shown in FIG. 2B, the second joint surface 20*sa* of the support member 20 is bonded to the surface provided with the ink supply opening portion 24*c* in the recording element board 24 with the adhesive. Examples of the adhesive preferably applicable are those having low viscosity, forming a thin adhesive layer on the contact surface, and having relatively high hardness after cured.

Figure 3A:
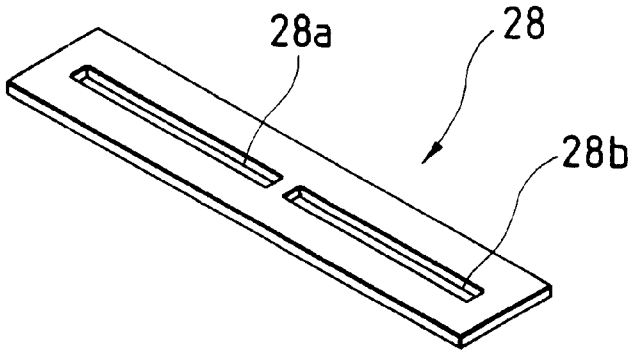
FIG. 3A, FIG. 3B, and FIG. 3C are perspective views to show other examples of the support member used in the example shown in FIG. 1.
Figure 3B:
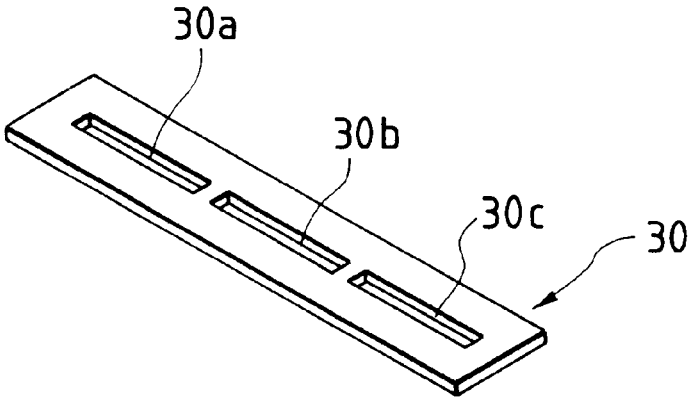
Figure 3C:
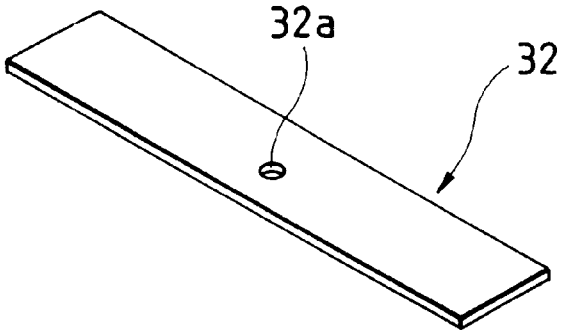

The number of communicating passage 20*a* in the support member 20 does not have to be limited to one as in the above example. The communication passage may be split into plural paths as shown in FIG. 3A and FIG. 3B. FIG. 3A and FIG. 3B each show support members 28 and 30 as other examples of the support member 20. The support members 28 and 30 are made of the same material as the support member 20 and the support member 28 is made in such a shape that slit-shaped communicating passages 28*a* and 28*b* extending in the longitudinal direction are located on a same straight line. In the support member 30, slit-shaped communicating passages 30*a,* 30*b,* and 30*c* extending in the longitudinal direction are positioned on a same straight line. FIG. 3C shows support member 32 as still another example of the support member 20. The support member 32 is also made of the same material as the support member 20 described above. The support member 32 has a circular through hole 32*a* at the almost center position. With the above arrangements, since in the support members 28 and 30 the portions except for the communicating passage are linked at one position in the almost central portion or at two positions, the mechanical strength or rigidity is improved as compared with the mechanical strength or rigidity of the support member 20. In the support member 32, the mechanical strength thereof is improved more than that of the support members 20, 28, and 30.

In the structure described above, when the drive control signal is supplied to each heater of the substrate in the recording element board 24 through the printed wiring board 22 to heat each heater, the ink is introduced through the ink supply passage 18*a* and through the ink branching supply passage of the partition member. The ink is heated by each heater to generate a bubble, based on the film boiling phenomenon, and with expansion of the bubble the ink is ejected from the ink ejection outlet 24*a* toward the recording surface of recording medium. On that occasion, even if the recording element board 24 expands because of the heat of the heaters, the support member 20 will also expand together with the recording element board 24. This means that the substantial cross-sectional area of the recording element board 24 is increased, which prevents the recording element board 24 from being broken by the change in temperature.

(Embodiment 2)

Figure 4:
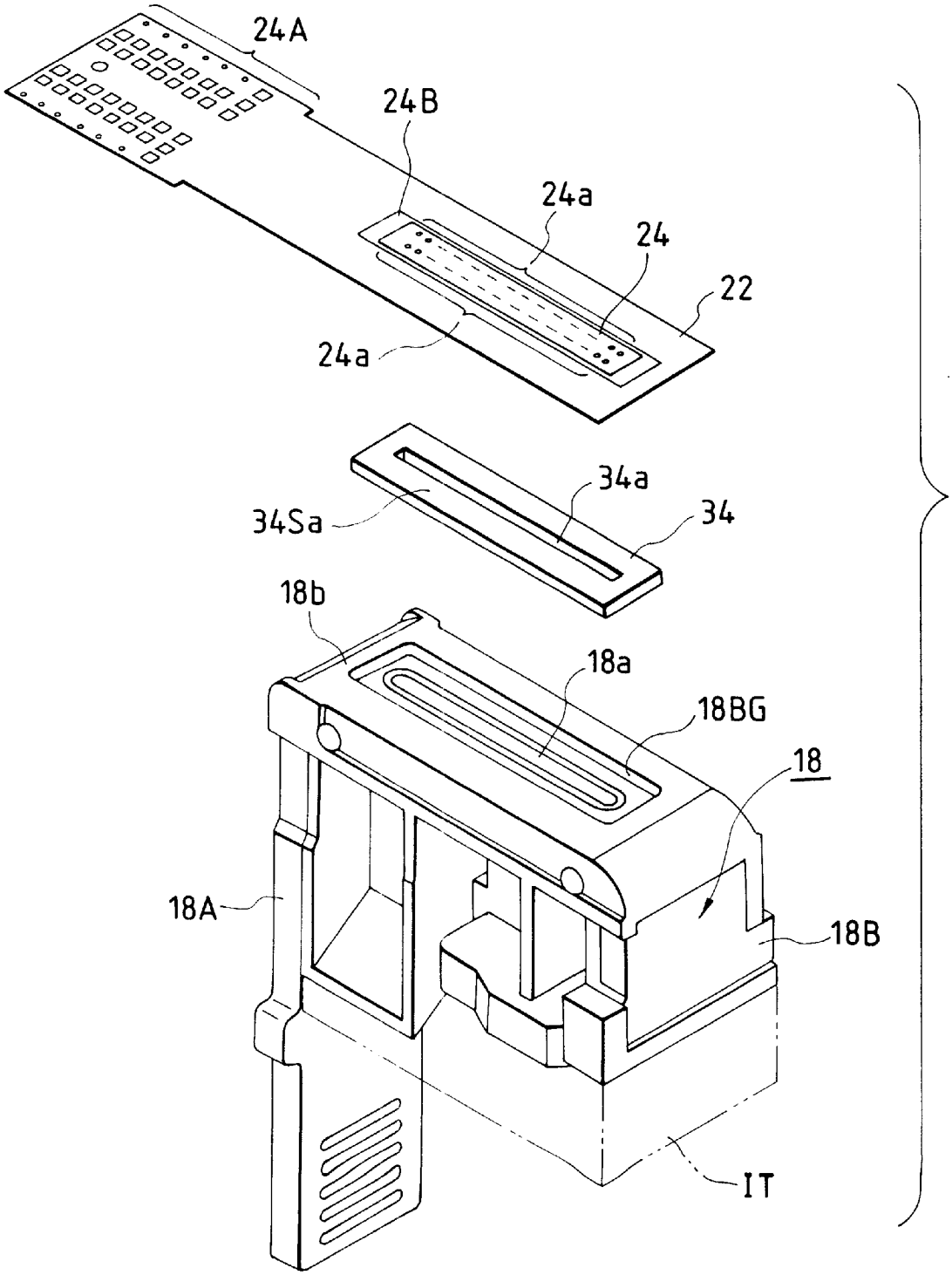
FIG. 4 is an exploded, perspective view to show the second embodiment of the ink jet recording head according to the present invention.

FIG. 4 schematically shows the major part of the second embodiment of the ink jet recording head according to the present invention.

In the example shown in FIG. 1 the lengths of the shorter sides and the longer sides of the support member 20 were equal to those of the shorter sides and the longer sides, respectively, of the recording element board 24 and the thickness of the support member 20 was generally equal to that of the recording element board 24; whereas in the example of FIG. 4 the length of the shorter sides of the support member 34 is longer than that of the shorter sides of the recording element board 24 and is set to a length generally equal to the width of the joined surface 18*b* of the recess 18BG of the ink supply section 18B.

In FIG. 4, the same reference symbols denote the same components as those in the example shown in FIG. 1 and redundant description thereof is omitted herein.

The support member 34 is formed in a rectangular plate shape. The support member 34 is made, for example, of silicon, which is the same material as the recording element board 24. The material for the support member 34 is not limited to silicon, but the support member 34 may be made of any material having the coefficient of linear expansion equal to that of the material for the recording element board 24 and having the thermal conductivity equal to or higher than that of the material for the recording element board 24. The material for the support member 34 may be, for example, either one of alumina ($Al_2O_3$), aluminum nitride (AlN), silicon carbide (SiC), trisilicon tetranitride ($Si_3N_4$), molybdenum (Mo), and tungsten (W).

Figure 5A:
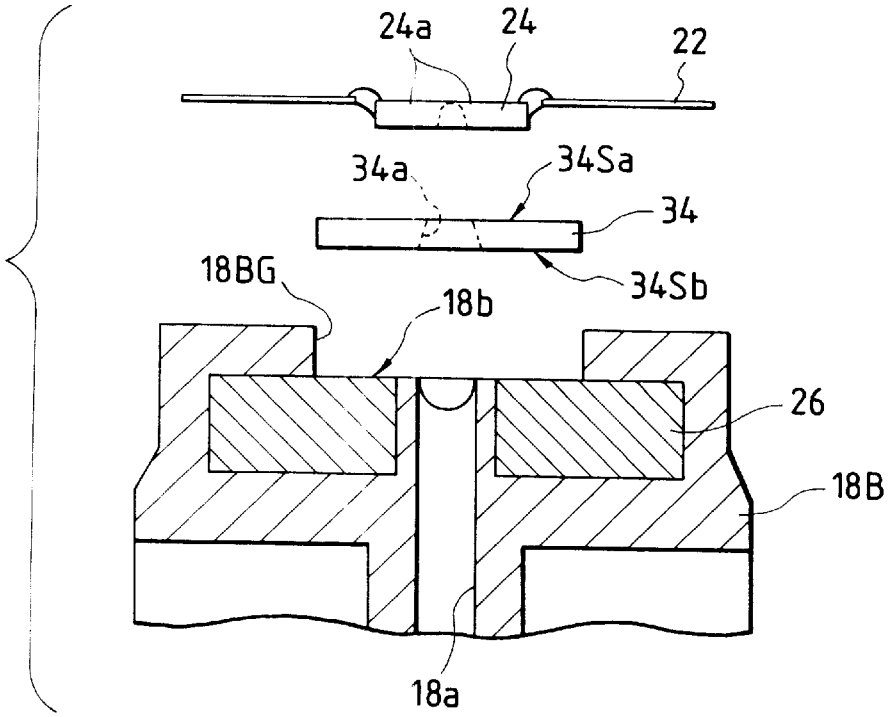
FIG. 5A and FIG. 5B are cross-sectional views in the example shown in FIG. 4.
Figure 5B:
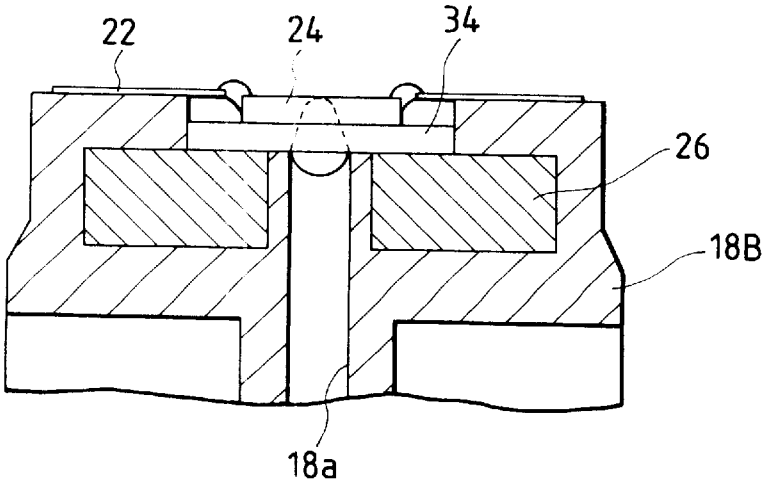

The support member 34 has, as shown in FIGS. 5A and 5B, the second joint surface 34*sa,* which is bonded to the surface provided with the ink supply opening portion 24*c* in the recording element board 24, and the first joint surface 34*sb,* which is bonded to the joined surface 18*b* of the recess 18BG of the ink supply section 18B. The support member 34 is provided with the communicating passage 34*a* extending long in the longitudinal direction at the position corresponding to the ink supply opening portion 24*c* in the recording element board 24 and to the ink supply passage 18*a* formed in the joined surface 18*b* of the recess 18BG of the ink supply section 18B. The communicating passage 34*a* may be formed in a split shape of plural passages, as shown in FIGS. 3A to 3C.

In the structure described above, when the drive control signal is supplied to each heater of the substrate in the recording element board 24 through the printed wiring board 22 to heat each heater, the ink is introduced through the ink supply passage 18*a* and through the ink branching supply passage of the partition member. The ink is heated by each heater to generate a bubble, based on the film boiling phenomenon, and with expansion of the bubble the ink is ejected from the ink ejection outlet 24*a* toward the recording surface of recording medium.

On that occasion, even if the recording element board 24 expands because of the heat of the heaters, the support member 34 will also expand together with the recording element board 24, as in the above example. This means that the substantial cross-sectional area of the recording element board 24 is increased, which prevents the recording element board 24 from being broken by the change in temperature. In addition, the mechanical strength and rigidity are increased further, because the shorter sides of the support member 34 are longer than those of the support member 20 in the example shown in FIG. 1.

(Embodiment 3)

Figure 6A:
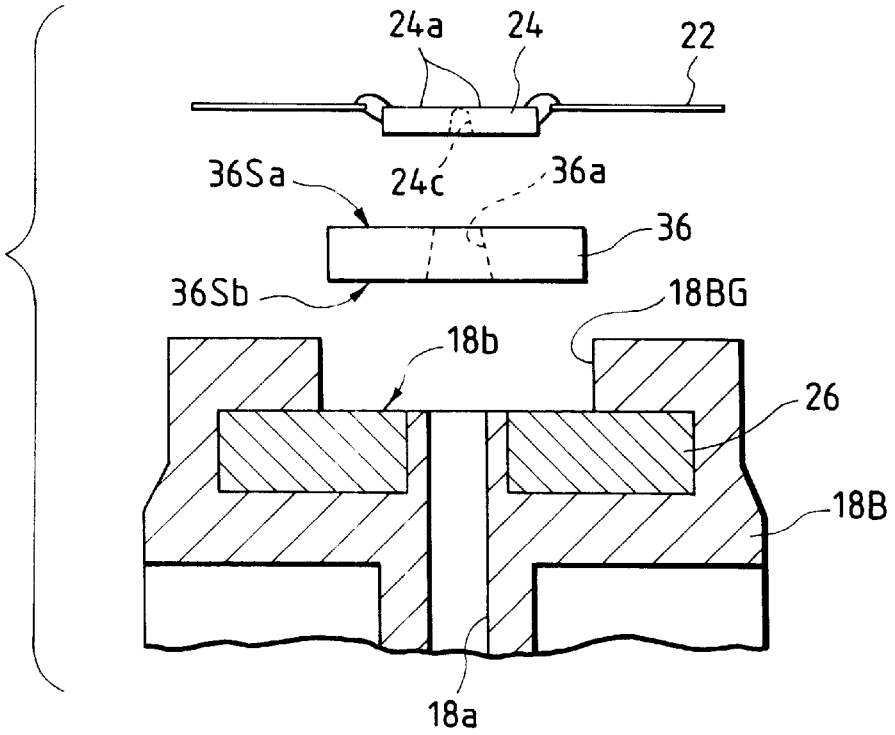
FIGS. 6A and 6B are cross-sectional views to show the third embodiment of the ink jet recording head according to the present invention.
Figure 6B:
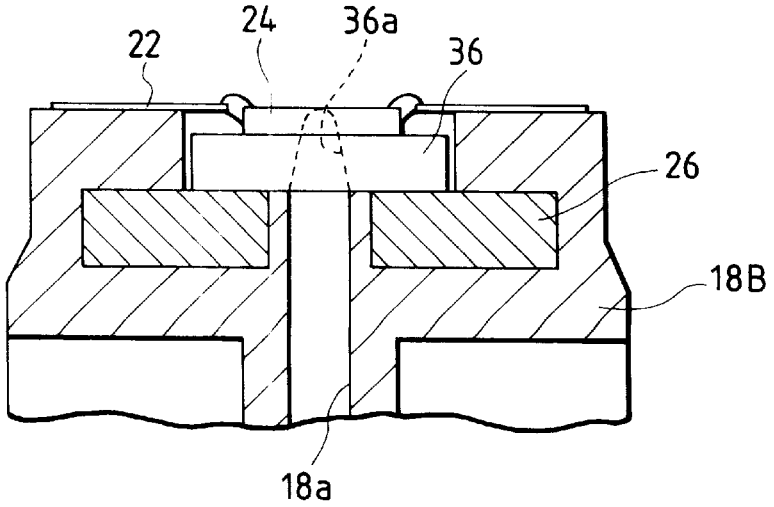

FIG. 6A and FIG. 6B schematically show the major part of the third embodiment of the ink jet recording head according to the present invention.

In the example shown in FIG. 1 the lengths of the shorter sides and the longer sides of the support member 20 were equal to those of the shorter sides and the longer sides, respectively, of the recording element board 24 and the thickness of the support member 20 was generally equal to the thickness of the recording element board 24; whereas in the example of FIGS. 6A and 6B the length of the shorter sides of the support member 36 is longer than that of the shorter sides of the recording element board 24 and the thickness of the support member 36 is greater than that of the recording element board 24. In FIGS. 6A and 6B, the same reference symbols denote the same components as those in the example shown in FIG. 1 and redundant description thereof is omitted herein.

The support member 36 is formed in a rectangular plate shape. The support member 36 is made, for example, of silicon, which is the same material as the recording element board 24. The material for the support member 36 is not limited to silicon, but the support member 36 may be made of any material having the coefficient of linear expansion equal to that of the material for the recording element board 24 and having the thermal conductivity equal to or higher than that of the material for the recording element board 24. The material for the support member 36 may be, for example, either one of alumina ($Al_2O_3$), aluminum nitride (AlN), silicon carbide (SiC), trisilicon tetranitride ($Si_3N_4$), molybdenum (Mo), and tungsten (W).

The support member 36 has, as shown in FIGS. 6A and 6B, the second joint surface 36*sa,* which is bonded to the surface provided with the ink supply opening portion 24*c* in the recording element board 24, and the first joint surface 36*sb,* which is bonded to the joined surface 18*b* of the recess 18BG of the ink supply section 18B. The support member 36 is provided with the communicating passage 36*a* extending long in the longitudinal direction at the position corresponding to the ink supply opening portion 24*c* in the recording element board 24 and to the ink supply passage 18*a* formed in the joined surface 18*b* of the recess 18BG of the ink supply section 18B. The communicating passage 36*a* may be formed in a split shape of plural passages, as shown in FIGS. 3A to 3C.

In the structure described above, when the drive control signal is supplied to each heater of the substrate in the recording element board 24 through the printed wiring board 22 to heat each heater, the ink is introduced through the ink supply passage 18*a* and through the ink branching supply passage of the partition member. The ink is heated by each heater to generate a bubble, based on the film boiling phenomenon, and with expansion of the bubble the ink is ejected from the ink ejection outlet 24*a* toward the recording surface of recording medium. On that occasion, even if the recording element board 24 expands because of the heat of the heaters, the support member 36 will also expand together with the recording element board 24, as in the above example. This means that the substantial cross-sectional area of the recording element board 24 is increased, which prevents the recording element board 24 from being broken by the change in temperature. In addition, the mechanical strength and rigidity are increased much more, because the shorter sides and the thickness of the support member 36 are longer or thicker, respectively, than those of the support member 20 in the example shown in FIG. 1.

(Embodiment 4)

Figure 7:
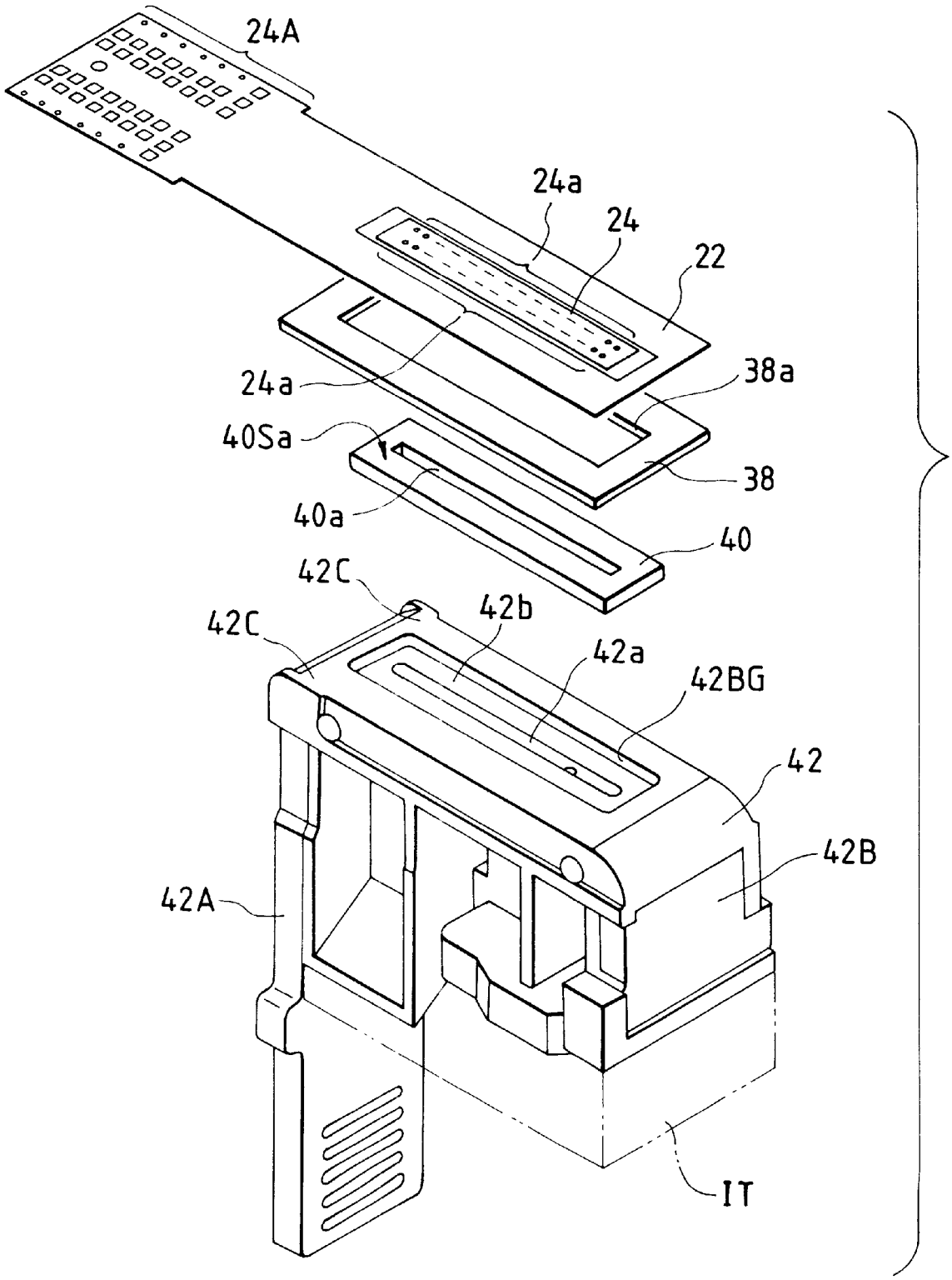
FIG. 7 is an exploded, perspective view to show the fourth embodiment of the ink jet recording head according to the present invention.

FIG. 7 schematically shows the major part of the fourth embodiment of the ink jet recording head according to the present invention.

In the example shown in FIG. 4 the length of the shorter sides of the support member 34 to which the recording element board 24 was bonded was longer than that of the shorter sides of the recording element board 24 and generally equal to the width of the joined surface 18*b* of the recess 18BG of the ink supply section 18B, and the printed wiring board 22 connected to the recording element board 24 was bonded to the periphery around the recess 18BG of the ink supply section 18B; in the example of FIG. 7, in addition to the foregoing, frame member 38 is provided as a second support member and the printed wiring board 22 connected to the recording element board 24 is placed in the periphery around the recess 18BG of the ink supply section 18B through the frame member 38.

In FIG. 7 the same reference symbols denote the same components as those in the example shown in FIG. 4, and redundant description thereof is omitted herein.

In the example shown in FIG. 7, the main body section 42 is composed of the ink supply section 42B, to which the ink tank IT is mounted, and the input terminal section 42A electrically connected to the carriage portion not illustrated and receiving the drive control signal group from the carriage portion.

Figure 8A:
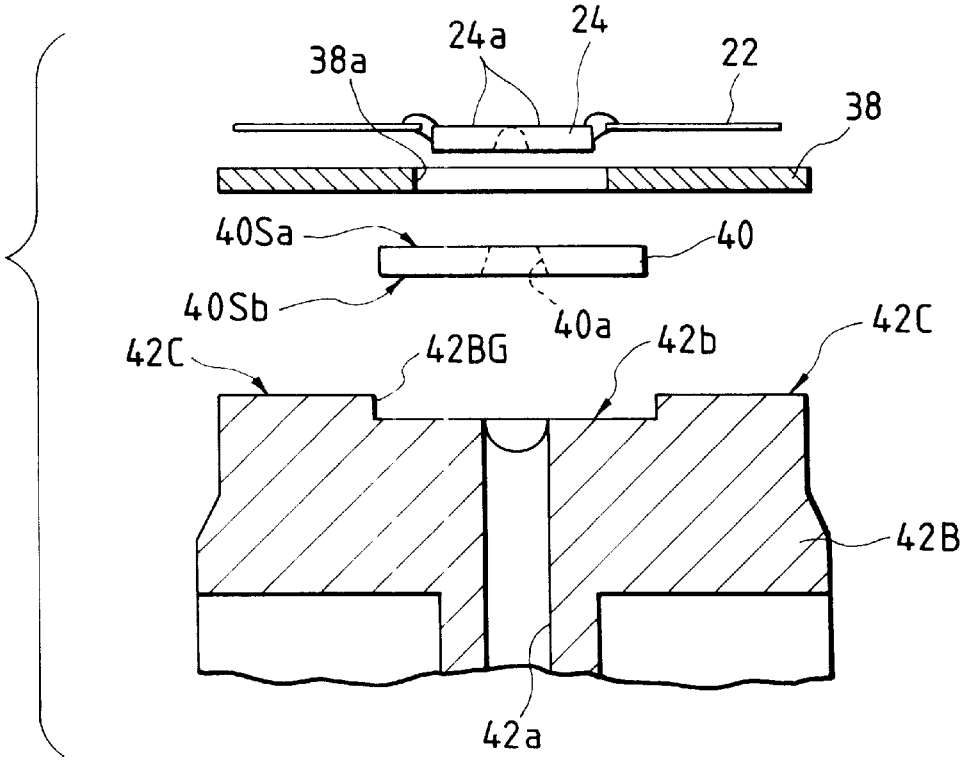
FIG. 8A and FIG. 8B are cross-sectional views in the example shown in FIG. 7.
Figure 8B:
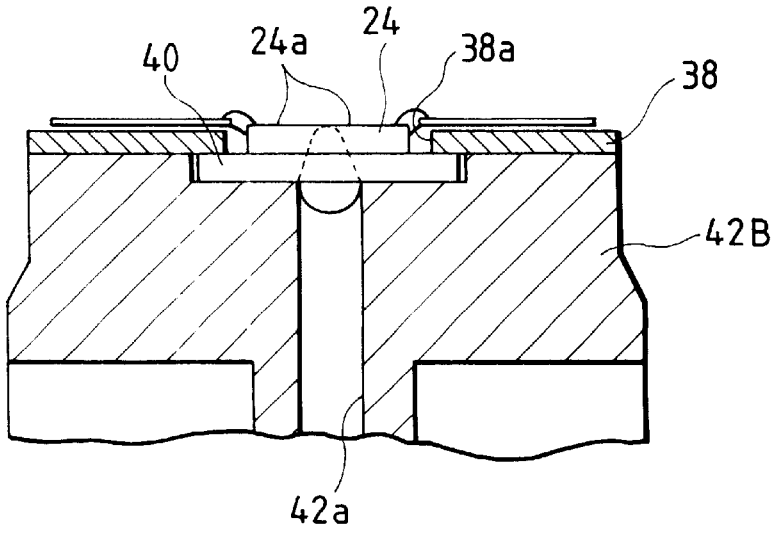

The main body section 42 is made in such a manner that the input terminal section 42A and ink supply section 42B are integrally molded, for example, of a resin. As shown in FIG. 7 and FIGS. 8A and 8B, the generally rectangular recess 42BG is formed in the upper surface opposite to the portion to which the ink tank IT is mounted in the ink supply section 42B of the main body section 42. The bottom of the recess 42BG is the joined surface 42*b* to which the support member 40 as the first support member is bonded. A flat surface in the periphery around the recess 42BG is a joined surface 42*c* to which the frame member 38 as the second support member is bonded.

An elongate opening end of the ink supply passage 42*a* for introducing the ink from the ink tank IT is open in the almost central portion of the joined surface 42*b*.

The support member 40 is formed in a rectangular plate shape having the thickness generally equal to that of the recording element board 24. The support member 40 is made, for example, of silicon, which is the same material as the recording element board 24. The material for the support member 40 is not limited to silicon, but the support member 40 may be made of any material having the coefficient of linear expansion equal to that of the material for the recording element board 24 and having the thermal conductivity equal to or higher than that of the material for the recording element board 24. The material for the support member 40 may be, for example, either one of alumina ($Al_2O_3$), aluminum nitride (AlN), silicon carbide (SiC), trisilicon tetranitride ($Si_3N_4$), molybdenum (Mo), and tungsten (W).

As shown in FIGS. 8A and 8B, the support member 40 has the thickness generally equal to the depth of the recess 42BG of the ink supply section 42B and has the width and length generally equal to those of the recess 42BG. The support member 40 has the second joint surface 40*sa* bonded to the surface provided with the ink supply opening portion 24*c* in the recording element board 24 and to one joint surface of the frame member 38, and the first joint surface 40*sb* bonded to the joined surface 42*b* of the recess 42BG of the ink supply section 42B. The support member 40 is provided with the communicating passage 40*a* extending long in the longitudinal direction, at the position corresponding to the ink supply opening portion 24*c* in the recording element board 24 and to the ink supply passage 42*a* provided in the joined surface 42*b* of the recess 42BG of the ink supply section 42B. The communicating passage 40*a* may be formed in a split shape of plural passages, as shown in FIGS. 3A to 3C.

The frame member 38 is made, for example, of an aluminum alloy in a plate shape of a predetermined thickness and receives the heat generated in the recording element board through the support member, thereby easily radiating the heat. The material for the frame member 38 is not limited to the aluminum alloy, but the material may be selected, as desired, from materials having relatively large thermal conductivities. The frame member 38 has the thickness nearly equal to the thickness of the recording element board 24 and is formed in the width and length nearly equal to those of the joined surface 42*c* of the ink supply section 42B. Provided in the central portion of the frame member 38 is opening portion 38*a* to surround the recording element board 24 bonded. Owing to this arrangement, the printed wiring board connected to the recording element board is supported by the frame member having the height generally equal to that of the recording element board, which enhances the reliability of the electric connection part of the printed wiring board.

For placing the recording element board 24, to which the printed wiring board 22 is connected, in the ink supply section 42B, as shown in FIG. 8A, the first joint surface 40*sb* of the support member 40 is first placed opposite to the joined surface 42*b* and thereafter is bonded to the predetermined position of the joined surface 42*b* with an adhesive. This adhesive is preferably, for example, one having high viscosity and having relatively low hardness after cured to show elasticity.

Subsequently, as shown in FIG. 8B, the frame member 38 is positioned at the predetermined position on the joined surface 42*c* in the ink supply section 42B and on the second joint surface 40*sa* of the support member 40 and is bonded in close fit thereto without clearance with an adhesive. This adhesive is preferably, for example, one having a relatively high thermal conductivity after cured.

Then, as shown in FIG. 8B, the second joint surface 40*sa* of the support member 40 is bonded to the surface provided with the ink supply opening portion 24*c* in the recording element board 24 with an adhesive. The adhesive is preferably, for example, one having low viscosity, forming a thin adhesive layer on the contact surface, and having relatively high hardness after cured. On that occasion, the clearance between the printed wiring board 22 and the recording element board 24 connected therewith is desirably sealed with an adhesive having elasticity after curing.

By this, the recording element board 24 to which the printed wiring board 22 is connected is placed in the ink supply section 42B.

In the structure described above, when the drive control signal is supplied to each heater of the substrate in the recording element board 24 through the printed wiring board 22 to heat each heater, the ink is introduced through the ink supply passage 18*a* and through the ink branching supply passage of the partition member. The ink is heated by each heater to generate a bubble, based on the film boiling phenomenon, and with expansion of the bubble the ink is ejected from the ink ejection outlet 24*a* toward the recording surface of recording medium. On that occasion, even if the recording element board 24 expands because of the heat of the heaters, the support member 40 will also expand together with the recording element board 24. This means that the substantial cross-sectional area of the recording element board 24 is increased, which prevents the recording element board 24 from being broken by the change in temperature.

Since the second joint surface 40*sa* of the support member 40 is bonded to the surface provided with the ink supply opening portion 24*c* in the recording element board 24 with the adhesive having the relatively high hardness after cured, the mechanical strength and rigidity of the recording element board 24 are enhanced further. Since the first joint surface 40*sb* of the support member 40 is bonded at the predetermined position of the joined surface 42*b* with the adhesive having the relatively low hardness after cured to show elasticity, the recording element board 24 is prevented from being deformed by thermal stress due to the difference between the coefficient of linear expansion of the support member 40 and the coefficient of linear expansion of the ink supply section 42B. Further, the frame member 38 radiates the heat from the recording element board 24 through the support member 40.

Figure 9A:
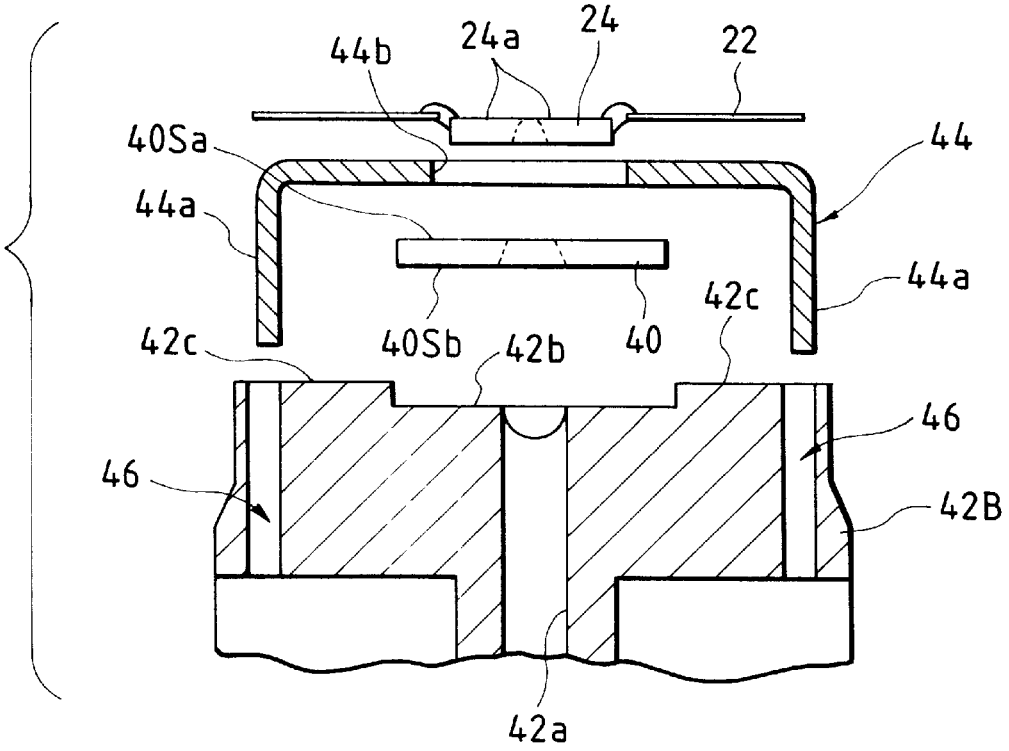
FIG. 9A and FIG. 9B are cross-sectional views to show another example of a frame member used in the example shown in FIG. 7.
Figure 9B:
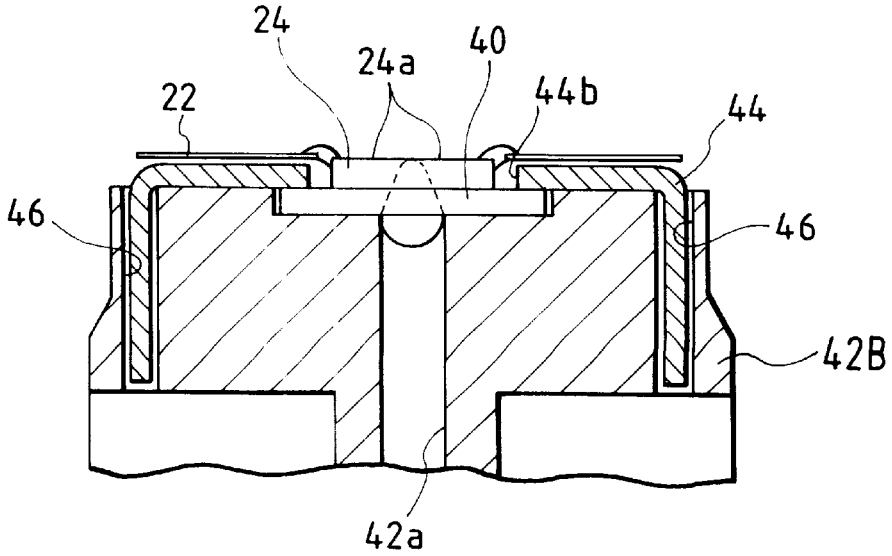

FIGS. 9A and 9B show another example of the frame member 38 in the example shown in FIG. 7. The same reference symbols denote the same components as those in the example shown in FIG. 7, and redundant description thereof is omitted herein.

In FIGS. 9A and 9B, the frame member 44 is made, for example, of an aluminum alloy, as in the example shown in FIG. 7, in a plate shape of a predetermined thickness by press working. The frame member 44 has the uniform thickness generally equal to that of the recording element board 24 and is formed in the width and length generally equal to those of the joined surface 42*c* of the ink supply section 42B. The frame member 44 has bent portions 44*a* at the both edges. Further, the frame member 44 has the opening portion 44*b* to surround the recording element board 24 bonded.

On the other hand, the ink supply section 42B is provided with elongate slots 46, with which the bent portions 44*a* of the frame member 44 are engaged, along the longitudinal direction of the recess 42BG.

For placing the recording element board 24, to which the printed wiring board 22 is connected, in the ink supply section 42B in use of the above-stated frame member 44, as shown in FIG. 9A, the first joint surface 40*sb* of the support member 40 is first placed opposite to the joined surface 42*b* and thereafter is bonded to the predetermined position of the joined surface 42*b* with an adhesive. This adhesive is preferably, for example, one having high viscosity and having relatively low hardness after cured to show elasticity.

Subsequently, as shown in FIG. 9B, the bent portions 44*a* of the frame member 44 are engaged with the respective slots 46 with predetermined clearance, while the frame member 44 is positioned at the predetermined position on the joined surface 42*c* in the ink supply section 42B and on the second joint surface 40*sa* of the support member 40 and is bonded in close fit thereto without clearance with an adhesive. This adhesive is preferably, for example, one having a relatively high thermal conductivity after curing.

Then, as shown in FIG. 9B, the surface provided with the ink supply opening portion 24*c* in the recording element board 24 is bonded to the second joint surface 40*sa* of the support member 40 with an adhesive. The adhesive is preferably, for example, one having low viscosity, forming a thin adhesive layer on the contact surface, and having relatively high hardness after cured. Hence, the heat radiation area of the frame member 44 becomes greater than that of the above-stated frame member 38, which improves the cooling effect by heat radiation of frame member 44.

Figure 10A:
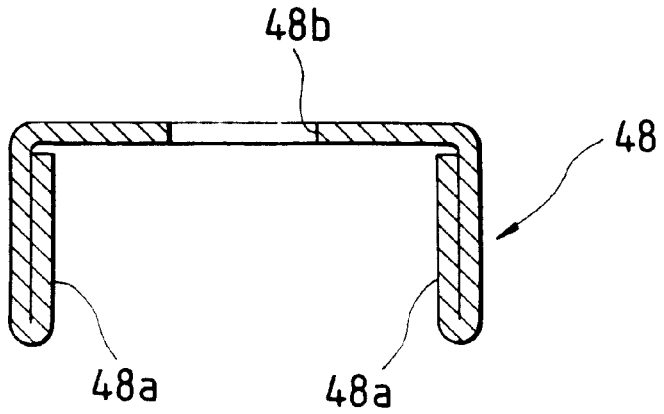
FIG. 10A and FIG. 10B are cross-sectional views to show other examples of the frame member used in the example shown in FIG. 7.
Figure 10B:
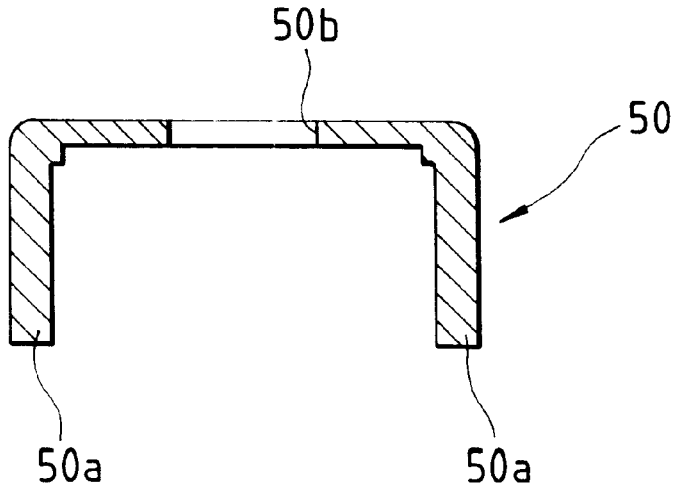

FIGS. 10A and 10B show still other examples of the frame member 38. The frame member 44 described above was made of the plate of uniform thickness, but the frame member 48 shown in FIG. 10A has bent portions 48*a* at the both edges thereof. Provided in the central portion of the frame member 48 is the opening portion 48*b* in which the recording element board 24 bonded is placed. Since the bent portions 48*a* are formed by folding the edges back by hemming work, the thickness thereof is larger than that of the other portion. This increases the heat radiation area in the frame member 48 as compared with the frame member 44.

The frame member 50 shown in FIG. 10B is molded by extrusion molding. The frame member 50 has the bent portions 50*a* at the both edges thereof. Provided in the central portion of the frame member 50 is the opening portion 50*b* in which the recording element board 24 bonded is placed. The bent portions 50*a* are molded thicker than the other portion. This increases the heat radiation area in the frame member 50 as compared with the frame member 44, as in the above example.

(Embodiment 5)

Figure 11:
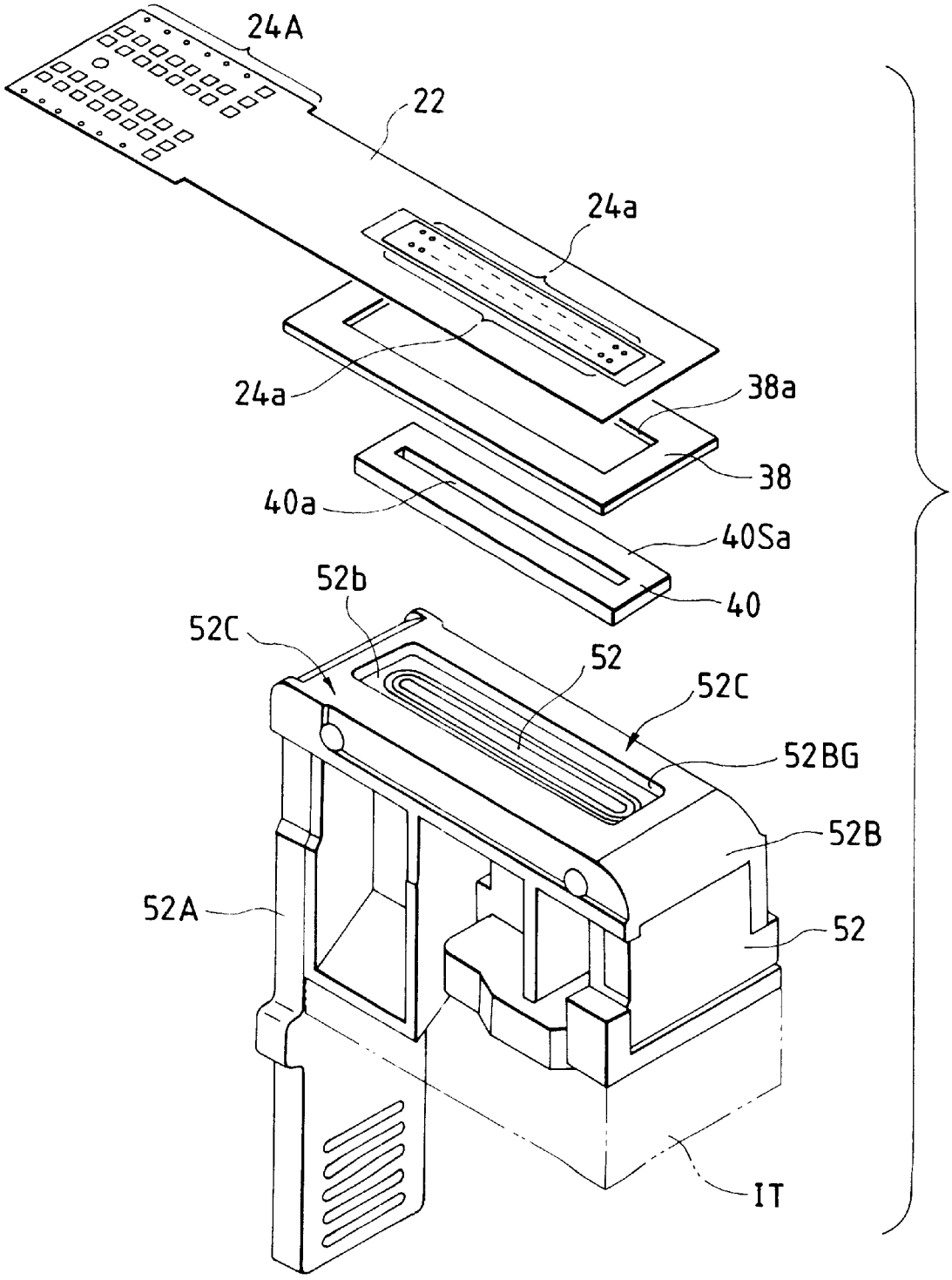
FIG. 11 is an exploded, perspective view to show the fifth embodiment of the ink jet recording head according to the present invention.

FIG. 11 schematically shows the major part of the fifth embodiment of the ink jet recording head according to the present invention.

In the example shown in FIG. 7 the frame member 38 was provided as the second support member and the printed wiring board 22 connected to the recording element board 24 was placed on the periphery around the recess 42BG of the ink supply section 42B through the frame member 38; whereas in the example of FIG. 11, in addition to the foregoing, a groove 54 for holding the adhesive applied is provided in the bottom portion of the recess 52BG of the ink supply section 52B.

In FIG. 11, the same reference symbols denote the same components as those in the example shown in FIG. 7, and redundant description thereof is omitted herein.

In the example shown in FIG. 11, the main body section 52 is composed of the ink supply section 52B, to which the ink tank IT is mounted, and the input terminal section 52A electrically connected to the carriage portion not illustrated and receiving the drive control signal group from the carriage portion.

Figure 12A:
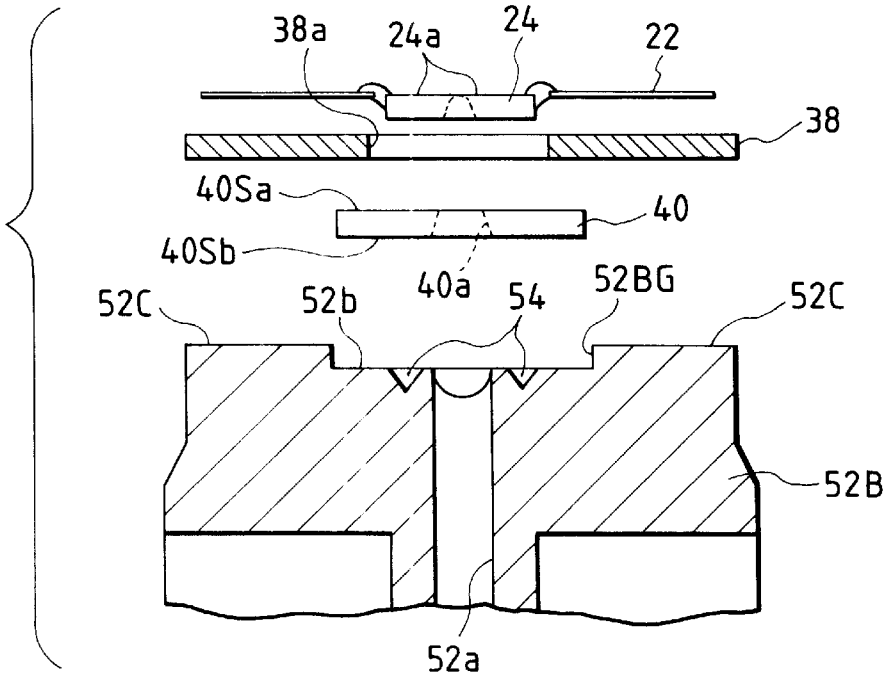
FIG. 12A and FIG. 12B are cross-sectional views in the example shown in FIG. 11.
Figure 12B:
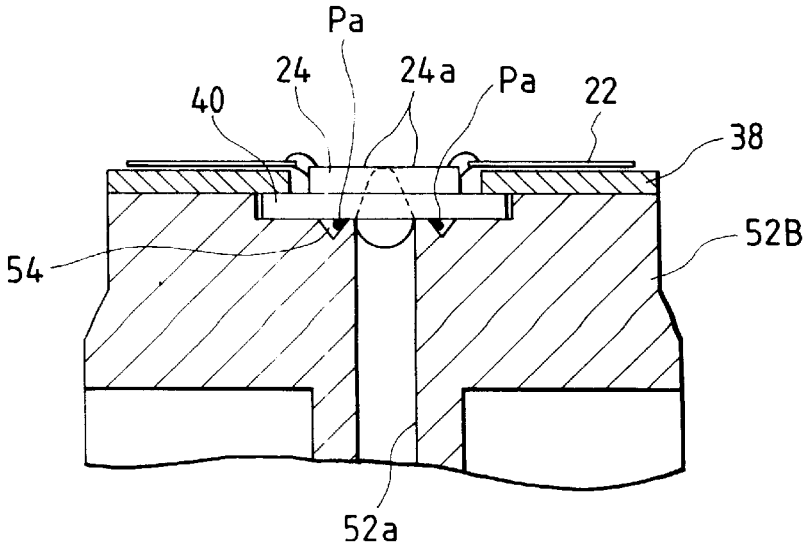

The main body section 52 is made in such a manner that the input terminal section 52A and ink supply section 52B are integrally molded, for example, of a resin. As shown in FIG. 11 and FIGS. 12A and 12B, the nearly rectangular recess 52BG is formed in the upper surface opposite to the portion to which the ink tank IT is mounted, in the ink supply section 52B of the main body section 52. The bottom of the recess 52BG serves as joined surface 52*b* to which the support member 40 as a first support member is bonded. A flat surface in the periphery around the recess 52BG serves as joined surface 52*c* to which the frame member 38 as a second support member is bonded.

An elongate opening end of the ink supply passage 52*a* for introducing the ink from the ink tank IT is open at the almost central portion of the joined surface 52*b*. In the peripheral region around the elongate opening end of the ink supply passage 52*a* in the joined surface 52*b*, the groove 54, the cross-sectional shape of which is, for example, a V-shape, is provided so as to surround the opening end. Without having to be limited to the V-shape, the cross-sectional shape of the groove 54 may be a U-shape or a cornered U-shape.

For placing the recording element board 24, to which the printed wiring board 22 is connected, in the ink supply section 52B in use of the frame member 38, as shown in FIG. 12A, the first joint surface 40*sb* of the support member 40 is first placed opposite to the joined surface 52*b* and thereafter is bonded to the predetermined position of the joined surface 52*b* with an adhesive applied. This adhesive is preferably, for example, one having high viscosity and having relatively low hardness after curing to show elasticity. On that occasion, the adhesive Pa applied is held in the groove 54, as shown in FIG. 12B. By this, the adhesive layer is obtained in a predetermined thickness according to the depth of the groove 54, so that undesired leakage of ink is avoided and so that the flatness of the support member 40 relative to the joined surface 52*b* is assured with accuracy.

Subsequently, as shown in FIG. 12B, the frame member 38 is positioned at the predetermined position on the joined surface 52*c* in the ink supply section 52B and on the second joint surface 40*sa* of the support member 40 and then is bonded in close fit thereto without clearance with an adhesive. This adhesive is preferably, for example, one having a relatively high thermal conductivity after cured.

Then, as shown in FIG. 12B, the second joint surface 40*sa* of the support member 40 is bonded to the surface provided with the ink supply opening portion 24*c* in the recording element board 24 with an adhesive. The adhesive is preferably, for example, one having low viscosity, forming a thin adhesive layer on the contact surface, and having relatively high hardness after curing. On that occasion, the clearance between the printed wiring board 22 and the recording element board 24 connected is preferably sealed with an adhesive having elasticity after curing.

By this, the recording element board 24 to which the printed wiring board 22 is connected is placed in the ink supply section 52B.

(Embodiment 6)

Figure 13:
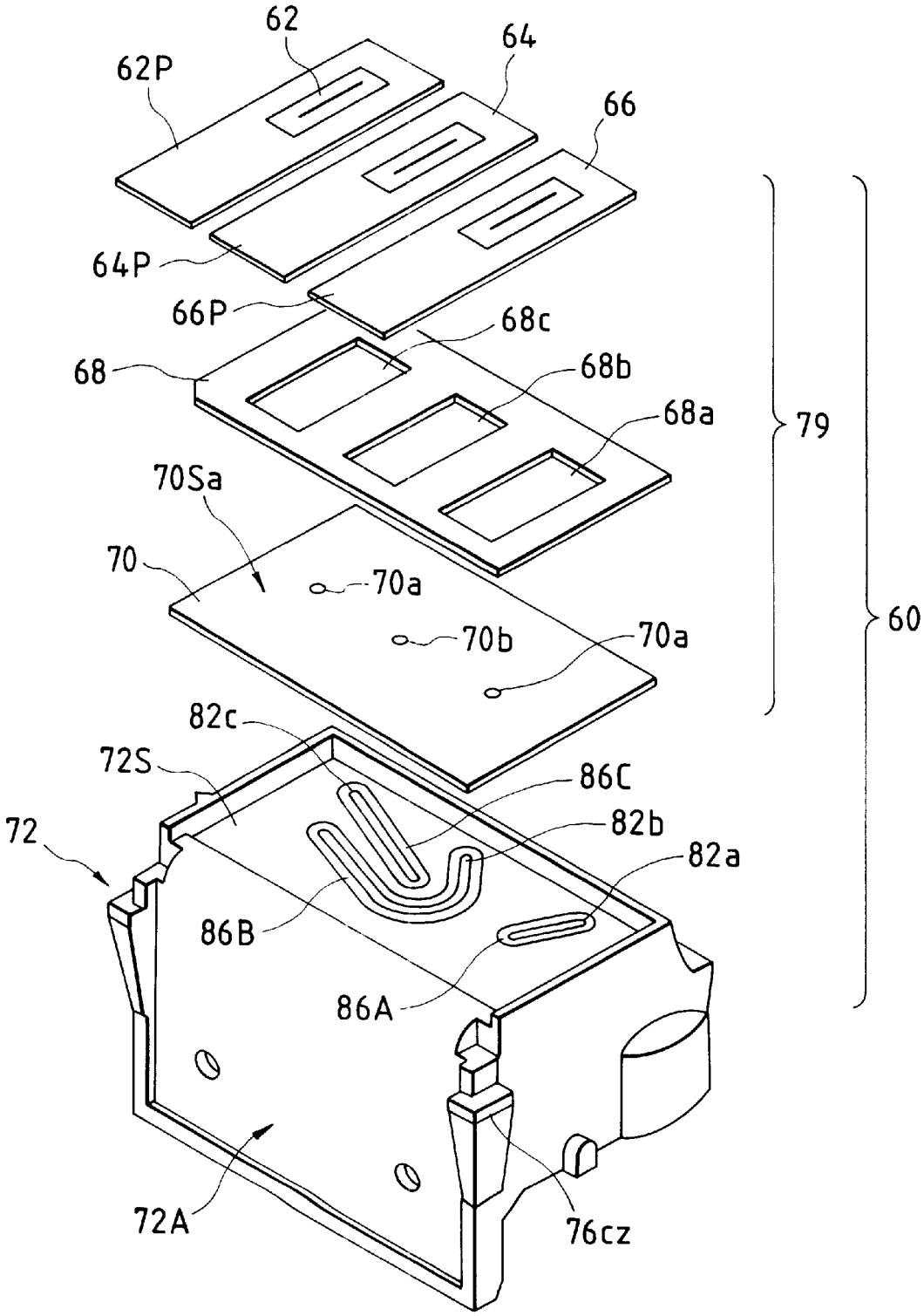
FIG. 13 is an exploded, perspective view to show the sixth embodiment of the ink jet recording head according to the present invention.
Figure 14:
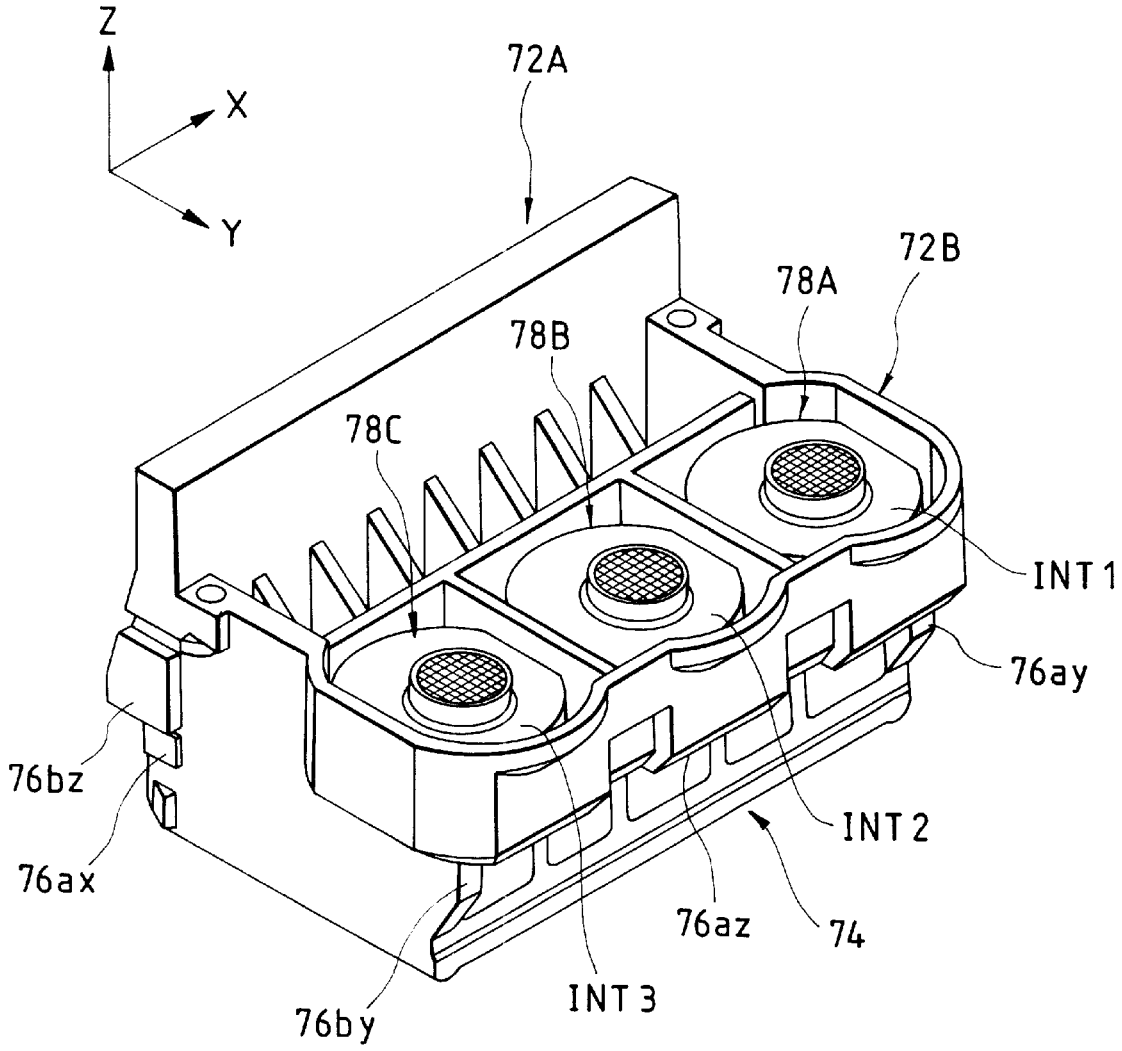
FIG. 14 is a perspective view to show the sixth embodiment of the ink jet recording head according to the present invention.

FIG. 13 and FIG. 14 schematically show the major part of the sixth embodiment of the ink jet recording head according to the present invention.

In FIG. 13 and FIG. 14, the ink jet recording head 60 of the side shooter type is comprised, for example, of the main body section 72 consisting of the ink supply section 72B, to which ink tanks INT1, INT2, and INT3 are mounted, and the input terminal section 72A electrically connected to the carriage portion not illustrated and receiving the drive control signal group from the carriage portion; and the ink ejection section 79 provided at the portion opposite to the ink supply section 72B in the main body section 72 and having ink ejection outlets for selectively ejecting the ink from the ink supply section 72B.

Figure 15:
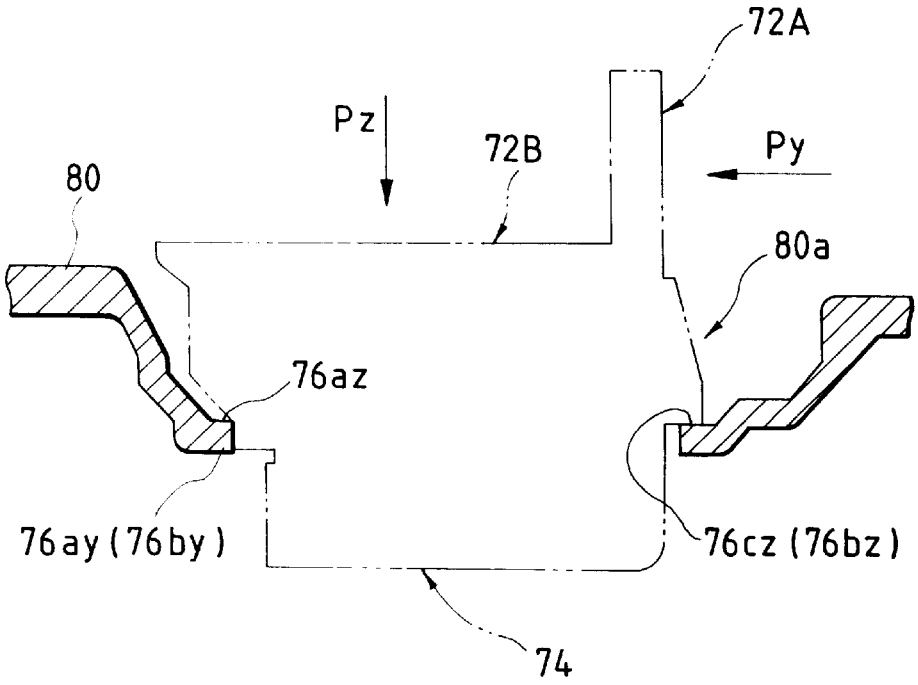
FIG. 15 is a drawing used for explanation of the operation in the example shown in FIG. 13.

In the ink supply section 72B, ink tank receiving sections 78A, 78B, and 78C in which the ink tanks INT1, INT2, and INT3 are mounted are arrayed along the scanning direction of the ink jet recording head 60 extending along the coordinate axis X shown in FIG. 14. A pair of contact portions 76*ay* and 76*by* for positioning relative to mount portion 80*a* of the carriage portion 80 on which the ink jet recording head 60 is mounted are provided at the edges in the direction of the coordinate axis Y shown in FIG. 14 in the outer shell forming the ink tank receiving sections 78A, 78B, and 78C. The contact portions 76*ay* and 76*by* are disposed opposite to and in parallel to each other and position the ink jet recording head 60 in the direction of the coordinate axis Y shown in FIG. 14 with respect to the mount portion 80*a* in the carriage portion 80, as shown in FIG. 15.

Another contact portion 76*az* is provided between the contact portion 76*ay* and the contact portion 76*by*. As shown in FIG. 15, the contact portion 76*az* positions the ink jet recording head 60 in the direction of the coordinate axis Z shown in FIG. 14 with respect to the mount portion 80*a* in the carriage portion 80.

In addition, contact portions 76*bz* and 76*cz* are disposed opposite to each other are provided on the both side wall portions in the direction along the coordinate axis X in the outer shell for forming the ink tank receiving sections 78A, 78B, and 78C, as shown in FIG. 13 and FIG. 14. The contact portions 76*bz* and 76*cz* position the ink jet recording head 60 in the direction of the coordinate axis Z shown in FIG. 14 with respect to the mount portion 80*a* in the carriage portion 80, as shown in FIG. 15.

Further, a contact portion 76*ax* is provided below the contact portion 76*bz* on the side wall portion where the contact portion 76*bz* is provided. The contact portion 76*ax* positions the ink jet recording head 60 in the direction of the coordinate axis X shown in FIG. 14 with respect to the mount portion 80*a* in the carriage portion 80, as shown in FIG. 16.

Figure 16:
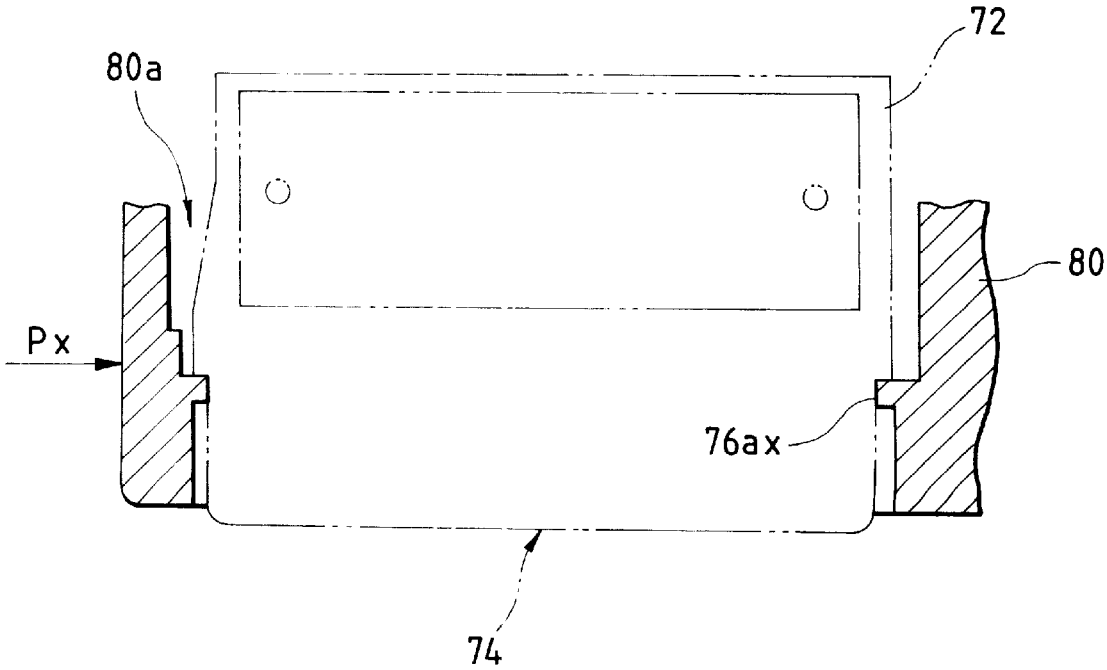
FIG. 16 is a drawing used for explanation of the operation in the example shown in FIG. 13.

By this, at the mount portion 80*a* in the carriage portion 80 the ink jet recording head 60 is positioned at one position in the direction of the coordinate axis X shown in FIG. 14, for example, by making urging force of a plate spring acting on the contact portion 76*ax* along the direction indicated by the arrow Px of FIG. 16. In addition, the ink jet recording head 60 is positioned at two positions in the direction of the coordinate axis Y shown in FIG. 14, for example, by making pressing force of contact pads (rubber pads) acting on the contact portions 76*ay* and 76*by* along the direction indicated by the arrow Py. Further, the ink jet recording head 60 is positioned at the three positions in the direction of the coordinate axis Z shown in FIG. 14, for example, by making urging force of a coil spring acting on the contact portions 76*az,* 76*bz,* and 76*cz* along the direction indicated by the arrow Pz.

Accordingly, the ink jet recording head 60 is properly positioned relative to the mount portion 80*a* in the carriage portion 80 automatically and securely when the ink jet recording head 60 is mounted on the mount portion 80*a*.

Figure 17:
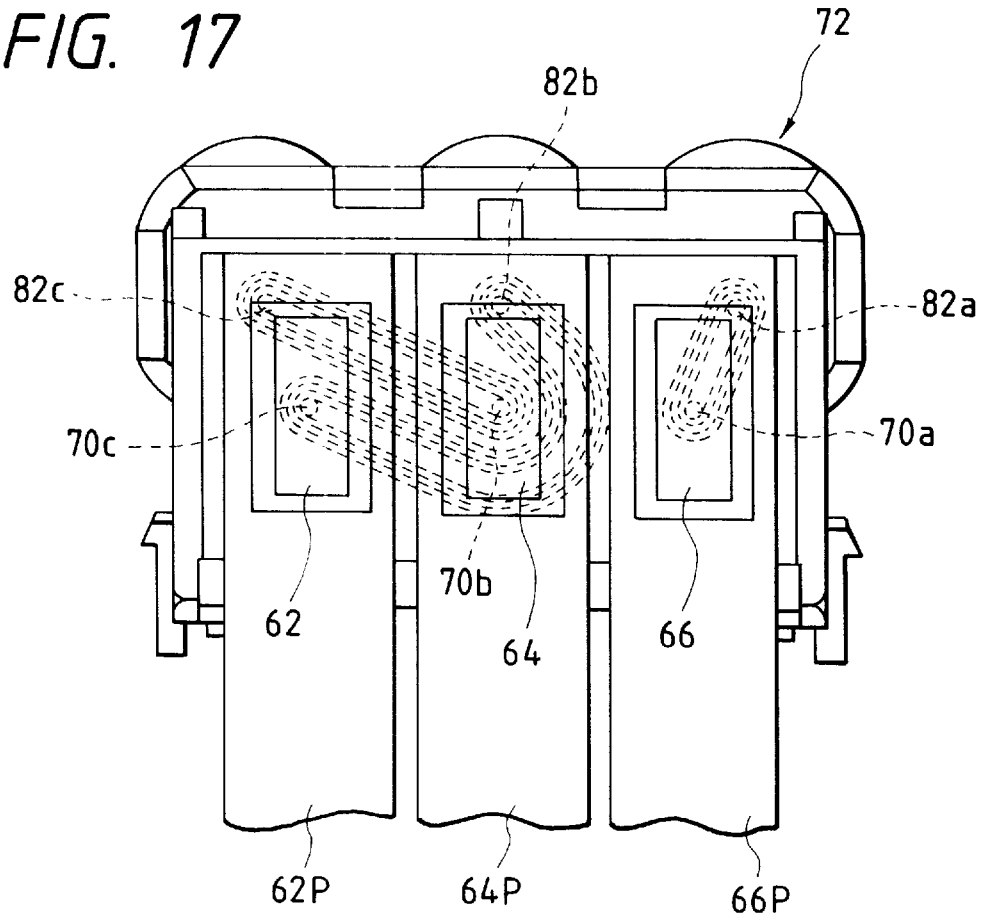
FIG. 17 is a plan view of the ink jet recording head in the example shown in FIG. 13.

The joined surface 72S is formed on the ink ejection section 79 side in the main body section 72, as shown in FIG. 13. As shown in FIG. 13 and FIG. 17, one opening ends 82*a,* 82*b,* and 82*c* of the ink supply passages 82A, 82B, 82C in communication with the ink tank receiving portions 78A, 78B, and 78C, respectively, are open in the joined surface 72S. The ink ejection section 79 is disposed on the joined surface 72S, as shown in FIG. 13.

The ink ejection section 79 is composed of support member 70 joined to the joined surface 72S, a plurality of recording element boards 62, 64, and 66 bonded to the upper surface as a second joint surface in the support member 70, printed wiring boards 62P, 64P, and 66P electrically connected to the recording element boards 62, 64, and 66, respectively, and supplying the drive control signal group from the input terminal section 72A thereto, and frame member 68 for positioning the printed wiring boards 62P, 64P, and 66P together with the plurality of recording element boards 62, 64, and 66, the frame member 86 being disposed on the upper surface of the support member 70.

Figure 19:
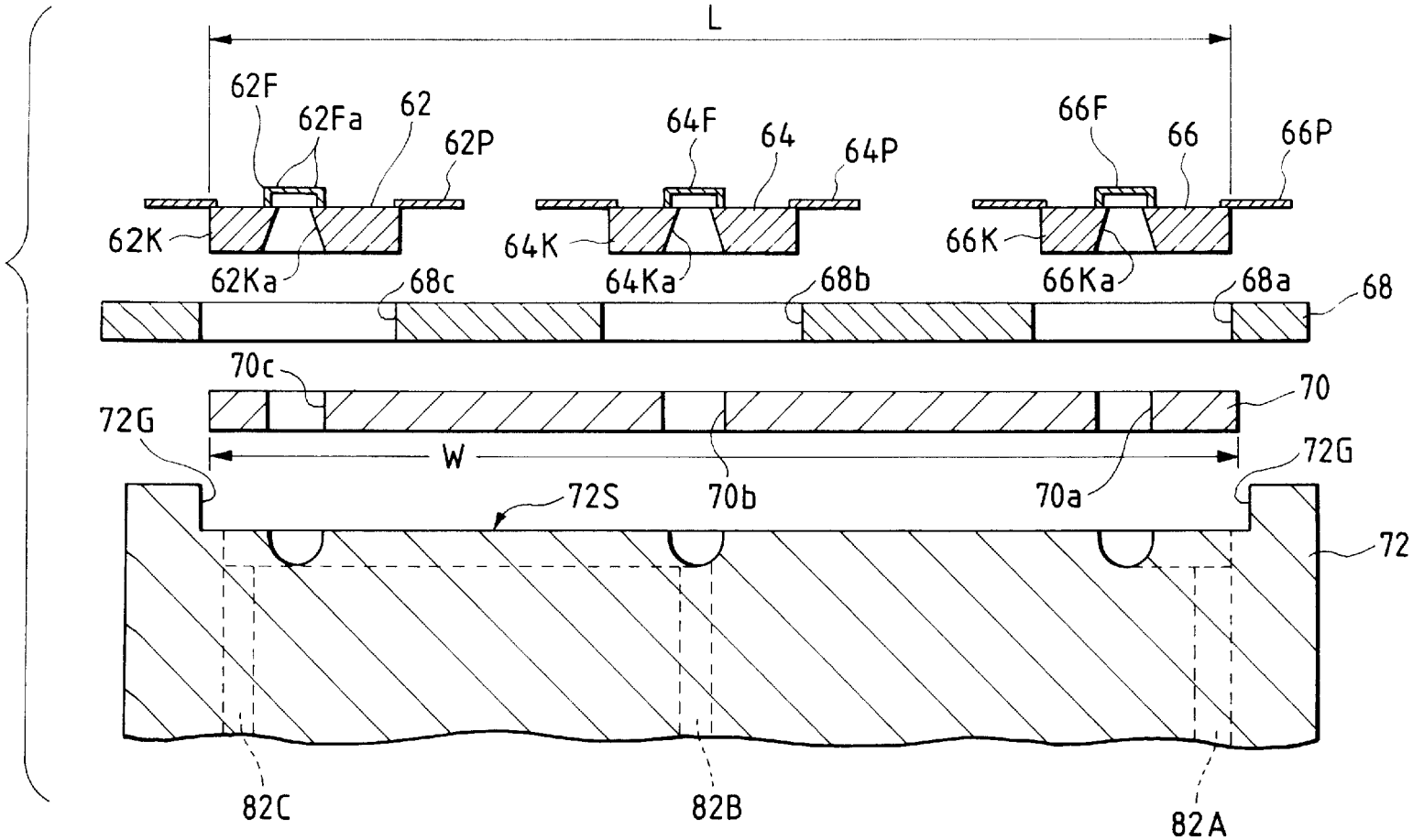
FIG. 19 is a cross-sectional view to show the major part in the example shown in FIG. 13.

The support member 70 as a first support member is formed in a rectangular plate shape in the thickness generally equal to that of the recording element boards 62 to 66. The width W of the support member 70 along the array direction of the recording element boards 62 to 66, described below, is set to be equal to or longer than the length L from one edge of the recording element board 62 to the other edge of the recording element board 66, as shown in FIG. 19. The support member 70 is made, for example, of silicon, which is the same material as the recording element boards 62 to 66. The material for the support member 70 is not limited to silicon, but the support member 70 may be made of any material having a coefficient of linear expansion equal to that of the material for the recording element boards 62 to 66 and having a thermal conductivity equal to or higher than that of the material for the recording element boards 62 to 66. The material for the support member 40 may be, for example, either one of alumina ($Al_2O_3$), aluminum nitride (AlN), silicon carbide (SiC), trisilicon tetranitride ($Si_3N_4$), molybdenum (Mo), and tungsten (W).

The support member 70 has through holes 70*a,* 70*b,* and 70*c* on a same straight line. The support member 70 has the first joint surface 70*sa* facing the frame member 68 and the second joint surface 70*sb* facing the joined surface 72S of the main body section 72. The second joint surface 70*sb* in the support member 70 is bonded to the joined surface 72S with an adhesive.

On that occasion, as shown in FIG. 13 and FIG. 17, the through hole 70*a* is in communication with the opening end 82*a* of the ink supply passage 82A through the ink flow path 86A provided in the joined surface 72S. The through hole 70*b* is in communication with the opening end 82*c* of the ink supply passage 82C through ink flow path 86C provided in the joined surface 72S. The through hole 70*c* is in communication with the opening end 82*b* of the ink supply passage 82B through ink flow path 86B provided with curvature on the ink flow passage 86A side in the joined surface 72S.

In this arrangement, the ink supplied through the ink supply passage 82C is supplied through the ink flow path 86C to the through hole 70*b* of the support member 70 and then is supplied to the recording element board 64. The ink supplied through the ink supply passage 82B is supplied through the ink flow path 86B to the through hole 70*c* of the support member 70 and then is supplied to the recording element board 62. Further, the ink supplied through the ink supply passage 82A is supplied through the ink flow path 86A to the through hole 70*a* of the support member 70 and then is supplied to the recording element board 66.

Figure 18:
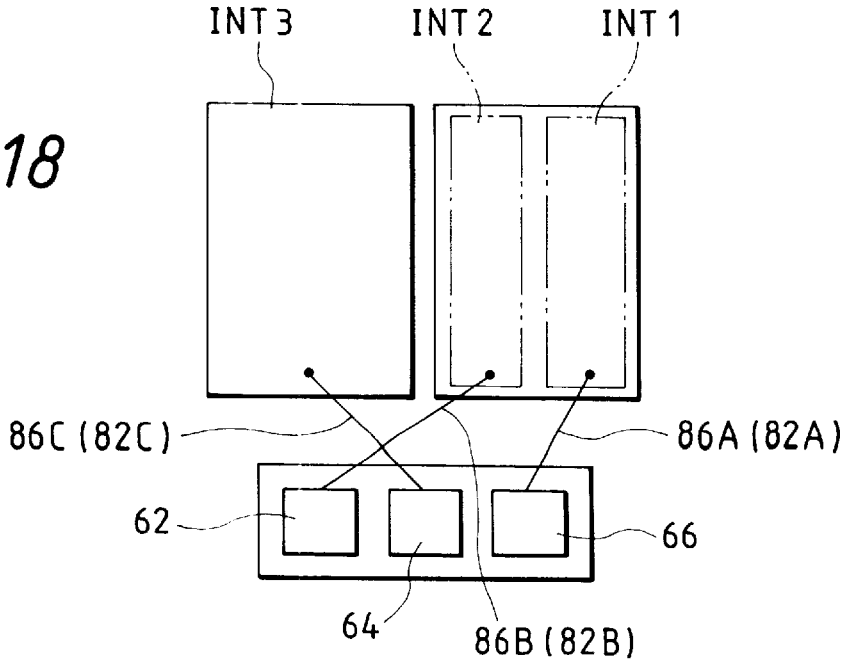
FIG. 18 is a drawing used for explanation of the operation in the example shown in FIG. 13.

Now, let us consider an example in which the recording element boards 62 and 66 are desired to eject ink of a same color and in which the recording element board 64 is desired to eject ink of a different ink color. As shown in FIG. 18, ink of an arbitrary color is reserved in the ink tank INT3 and ink of the same color is reserved in the ink tanks INT1 and INT2. When the respective ink liquids are supplied, the ink reserved in the ink tank INT3 is supplied through the through hole 70*b* of the support member 70 to the recording element board 64 and the ink liquids reserved in the ink tanks INT1 and INT2 are supplied to the recording element boards 62 and 66, respectively. Thus, this facilitates arrangement of the ink tanks INT1 and INT2. In the case wherein the ink tanks INT1 and INT2 are replaced by one ink tank, the ink can also be supplied to each of the recording element boards 62 and 66.

Since the recording element boards 62, 64, and 66 have the same structure, description is given as to only the recording element board 62.

The substrate 62*k* of the recording element board 62 is made of, for example, a silicon material of the thickness of 0.5 to 1.0 mm. Provided in the surface of the substrate 62*k*, which is bonded to the first joint surface 70*sa* of the support member 70 with an adhesive, is ink supply opening portion 62*ka* extending in the array direction of the ink ejection outlets 62F*a* opposite to the orifice plate 62F, as shown in FIG. 19. Further, heaters not illustrated are arranged at predetermined mutual intervals on either side of the ink supply opening portion 62*ka* in the orifice plate 62F. The ink supplied through the ink supply opening portion 62*ka* is guided through the flow paths formed in the orifice plate 62F to the associated heaters.

The printed wiring board 62P is electrically connected to each electrode of the substrate in the recording element board 62, as shown in FIG. 13 and FIG. 17. In bonding the printed wiring board 62P to the recording element board 62, they are connected to each other, for example, by the TAB (Tape Automated Bonding) method.

In the frame member 68 as a second support member, opening portions 68*a*, 68*b*, 68*c* for regulating the positions of the recording element boards 62, 64, 66 are provided in parallel and in correspondence to the recording element boards 62, 64, 66.

Figure 20:
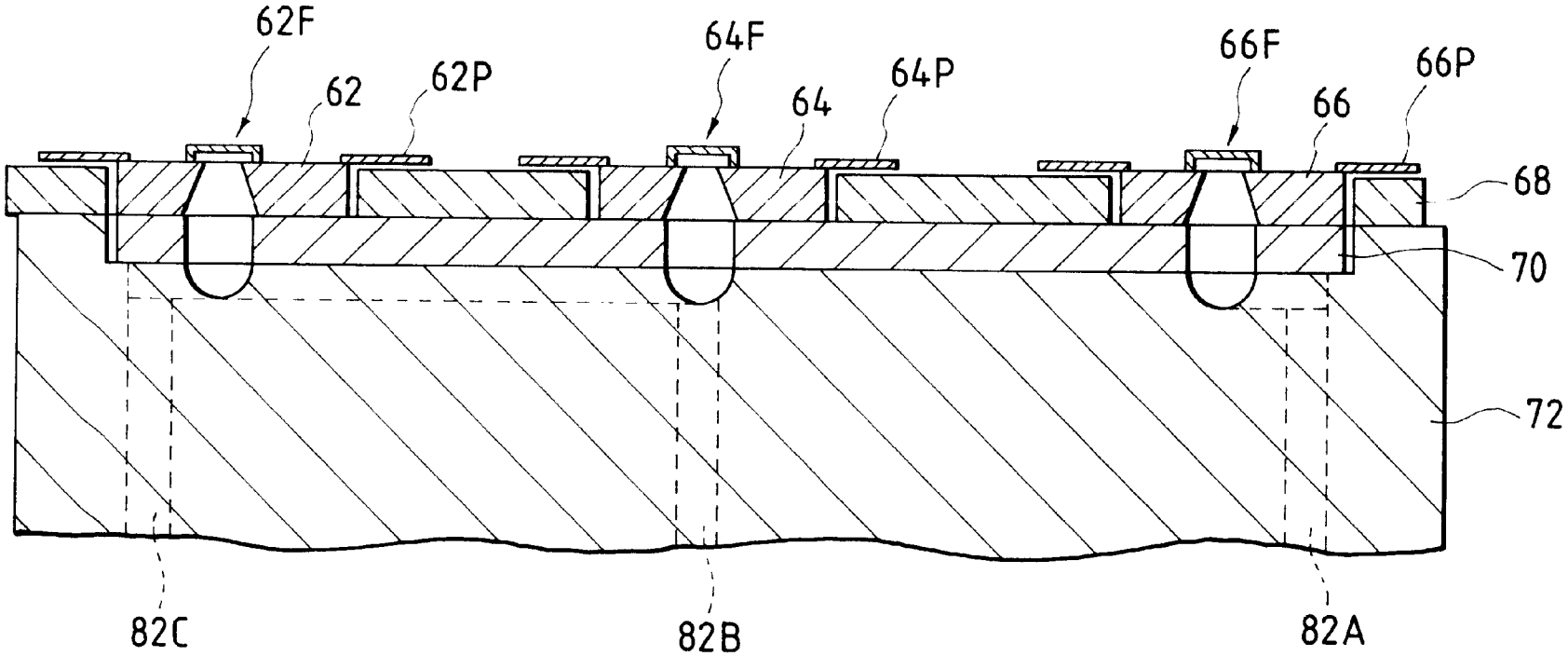
FIG. 20 is a cross-sectional view to show the major part in the example shown in FIG. 13.

For placing the recording element board 62 coupled with the printed wiring board 62P, the recording element board 64 coupled with the printed wiring board 64P, and the recording element board 66 coupled with the printed wiring board 66P on the joined surface 72S of the main body section 72 through the frame member 68 and support member 70, as shown in FIG. 19 and FIG. 20, the second joint surface 70*sb* of the support member 70 is first bonded to the joined surface 72S with an adhesive. Then the frame member 68 is bonded to the first joint surface 70*sa* of the support member 70 in correspondence to the through holes 70*a*, 70*b*, and 70*c*. Then the recording element board 62 coupled with the printed wiring board 62P, the recording element board 64 coupled with the printed wiring board 64P, and the recording element board 66 coupled with the printed wiring board 66P are inserted into the respective opening portions 68*a* to 68*c* to be bonded to the first joint surface 70*sa* of the support member 70 with an adhesive. On that occasion, the recording element boards are positioned, for example, by use of the picture recognition technology so that the ink ejection outlets of each orifice plate 62F ro 66F are directed in the same direction.

By this, the plural recording element boards 62, 64, and 66 are assembled as being bonded to one support member 70, which enhances the assembling accuracy and which in turn enhances the recording accuracy. Since the support member 70 is made of the material as described, thermal deformation of the recording element boards 62, 64, and 66 due to thermal expansion thereof is avoided.

Figure 21:
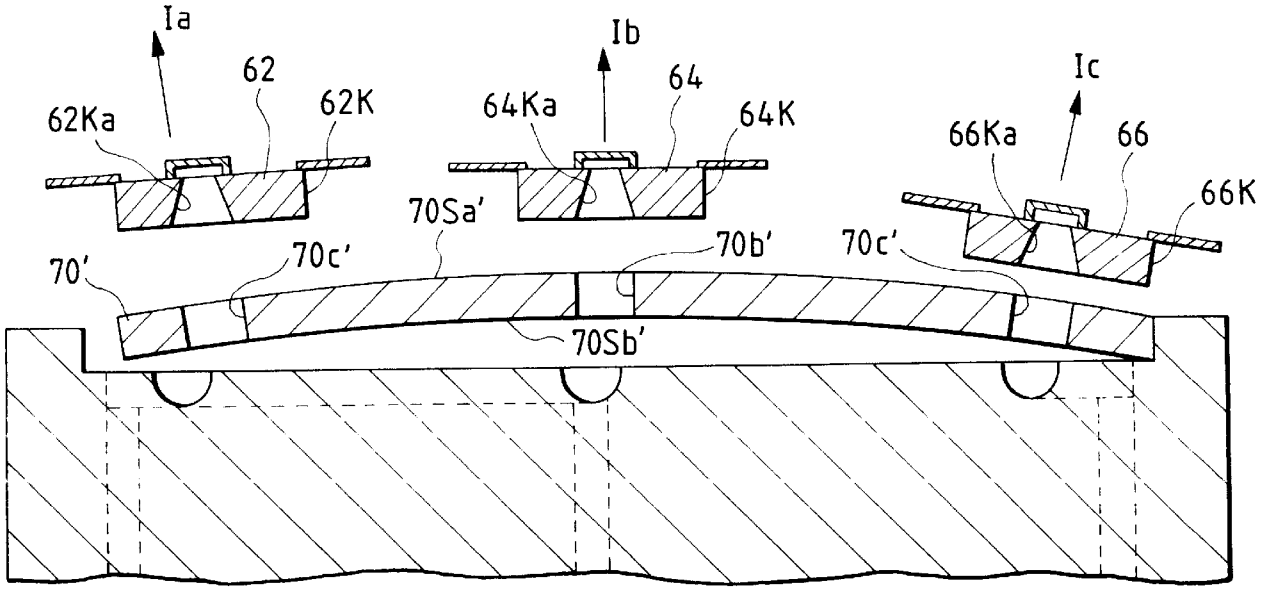
FIG. 21 is a partial cross-sectional view used for explanation of the operation in the example shown in FIG. 13.

FIG. 21 shows an example in which the flatness of the first joint surface 70*sa'* and the second joint surface 70*sb'* in the support member 70' with respect to the joined surface 72S is not good. In this case, when the recording element boards 62, 64, and 66 are bonded to the support member 70', the ink ejected from the recording element boards 62, 64, and 66 will be ejected in different ejection directions indicated by arrows Ia to Ic in FIG. 21.

Therefore, the flatness of the first joint surface in the support member 70 is maintained at high accuracy and the adhesive layer is made thin. Alternatively, the adhesive with relatively low viscosity is selected and predetermined pressure is applied to the adhesive, which can avoid the accident shown in FIG. 21.

Figure 22:
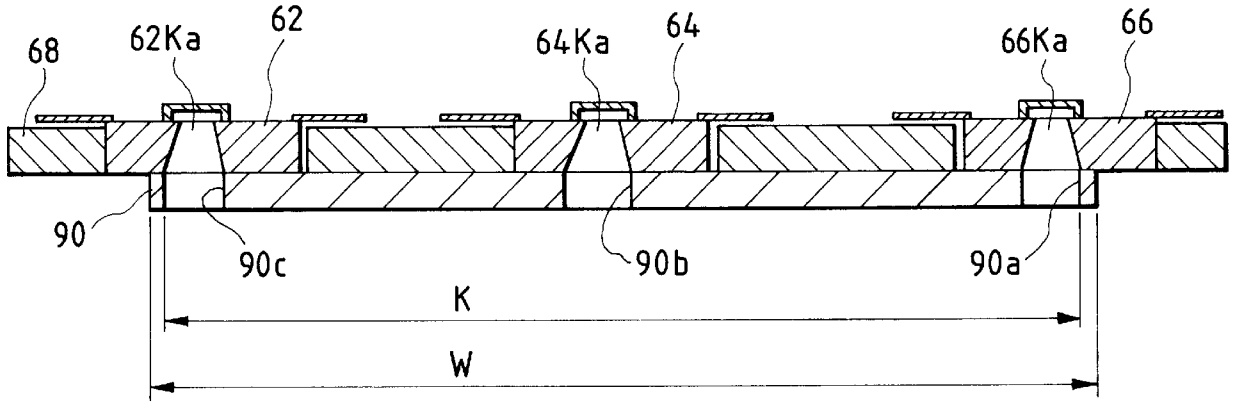
FIG. 22 is a partial cross-sectional view to show another example of the support member used in the example shown in FIG. 13.

In an example shown in FIG. 22, the width W of the support member 90 along the array direction of the recording element boards 62 to 66 is a little larger than length K between the through hole 90*a* and through hole 90*c*. The same reference symbols denote the same components as those in the example shown in FIG. 19, and redundant description thereof is omitted herein.

Figure 23:
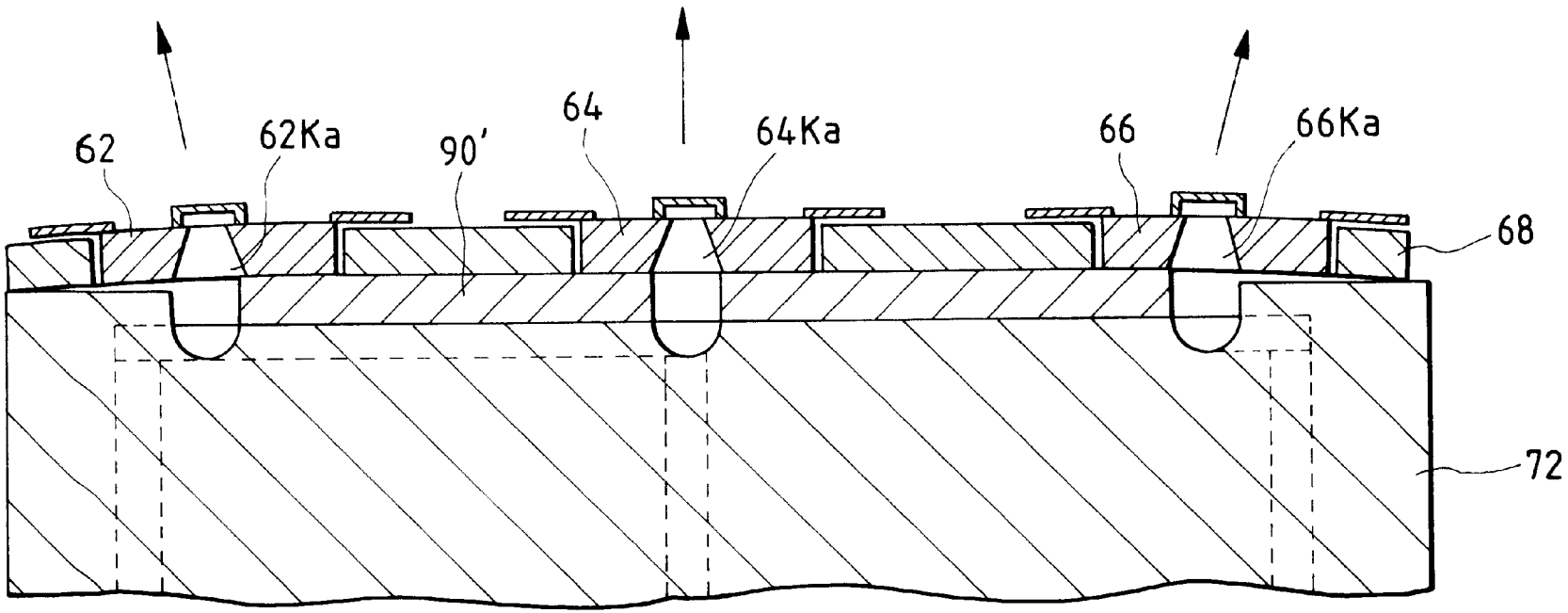
FIG. 23 is a partial cross-sectional view used for explanation of the operation in the example shown in FIG. 13.

By this arrangement, since the support member 90 is a member purposed mainly to assure the positioning accuracy of the plural recording element boards, a requirement is simply that at least one end of the support member 90 is defined in such a size as to contact an inner surface of peripheral wall 72G in the joined surface 72S. On the other hand, in an example wherein the both ends of the support member 90' do not contact the inner surface of the peripheral wall 72G in the joined surface 72S as shown in FIG. 23, the ink supply opening portions 62*ka* to 66*ka* of the respective recording element boards 62 to 66 could be deformed by the heat of heater.

Figure 24:
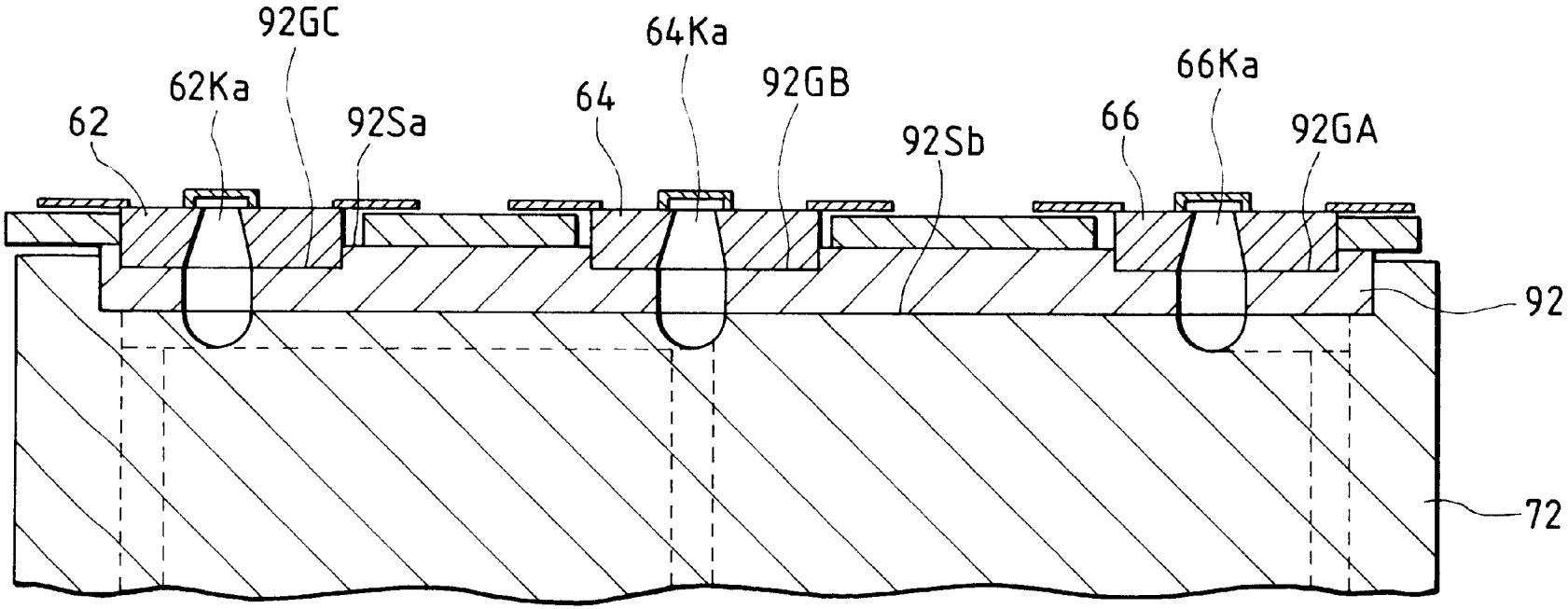
FIG. 24 is a partial cross-sectional view to show still another example of the support member used in the example shown in FIG. 13.
Figure 25:
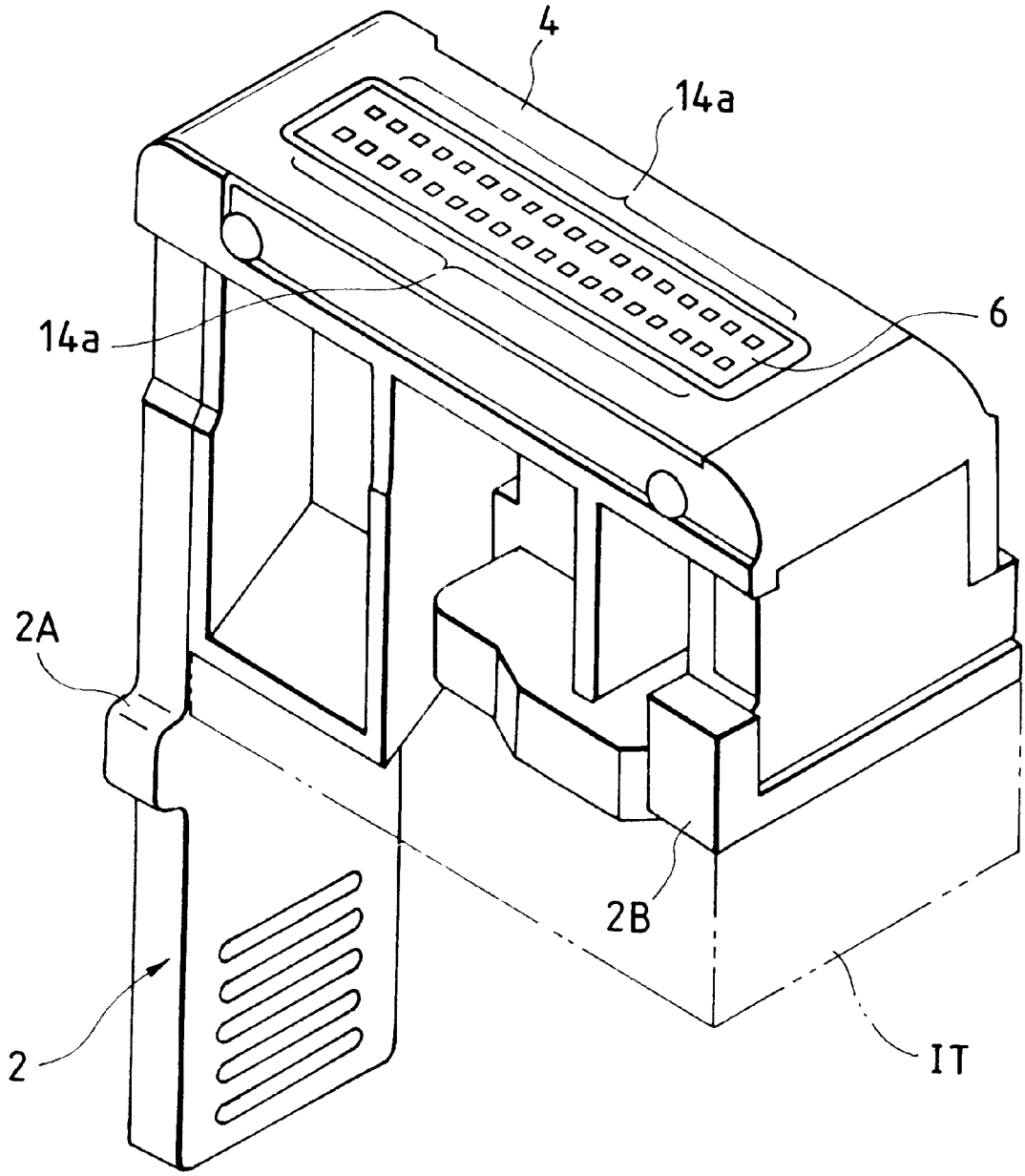
FIG. 25 is a perspective view to show the conventional apparatus.

FIG. 24 shows an example in which the first joint surface 92*sa* out of the first joint surface 92*sa* and the second joint surface 92*sb* in the support member 92 is provided with recesses 92GA, 92GB, and 92GC corresponding to the recording element boards 62 to 66.

In FIG. 24, the same reference symbols denote the same components as those in the example shown in FIG. 20, and redundant description thereof is omitted herein.

The recesses 92GA, 92GB, and 92GC are formed in a predetermined depth and at predetermined intervals. The recesses 92GA, 92GB, and 92GC are made by processing, for example, such as sand blasting or anisotropic etching.

By this arrangement, the outer periphery of the recording element boards 62 to 66 can be positioned with better accuracy to the inner periphery of the recesses 92GA, 92GB, and 92GC.

As described above, since the ink jet recording heads according to the above embodiments are arranged so that the recording element board(s) is placed on the joined surface in the main body section with intervention of the support member(s) and so that the thermal property in the material for the recording element board(s) and that of the material for the support member(s) are of the same quality, as the recording element board thermally expands, the support member also thermally expands together with the recording element board. This increases the rigidity of recording element board, prevents the recording element board from being broken by the change in the temperature of recording element board, and avoids the increase in the manufacturing cost of recording element board.

(Embodiment 7)

In the form of the ink jet recording head of Embodiment 6, there exists the clearance between the recording element boards and the wiring boards; if the recording liquid should stay in this clearance, the recording liquid could permeate the wiring board and the support member to reach the back of wiring board and to corrode the wiring. This recording liquid could also corrode the frame member. The present embodiment is achieved for solving such problem.

Figure 30:
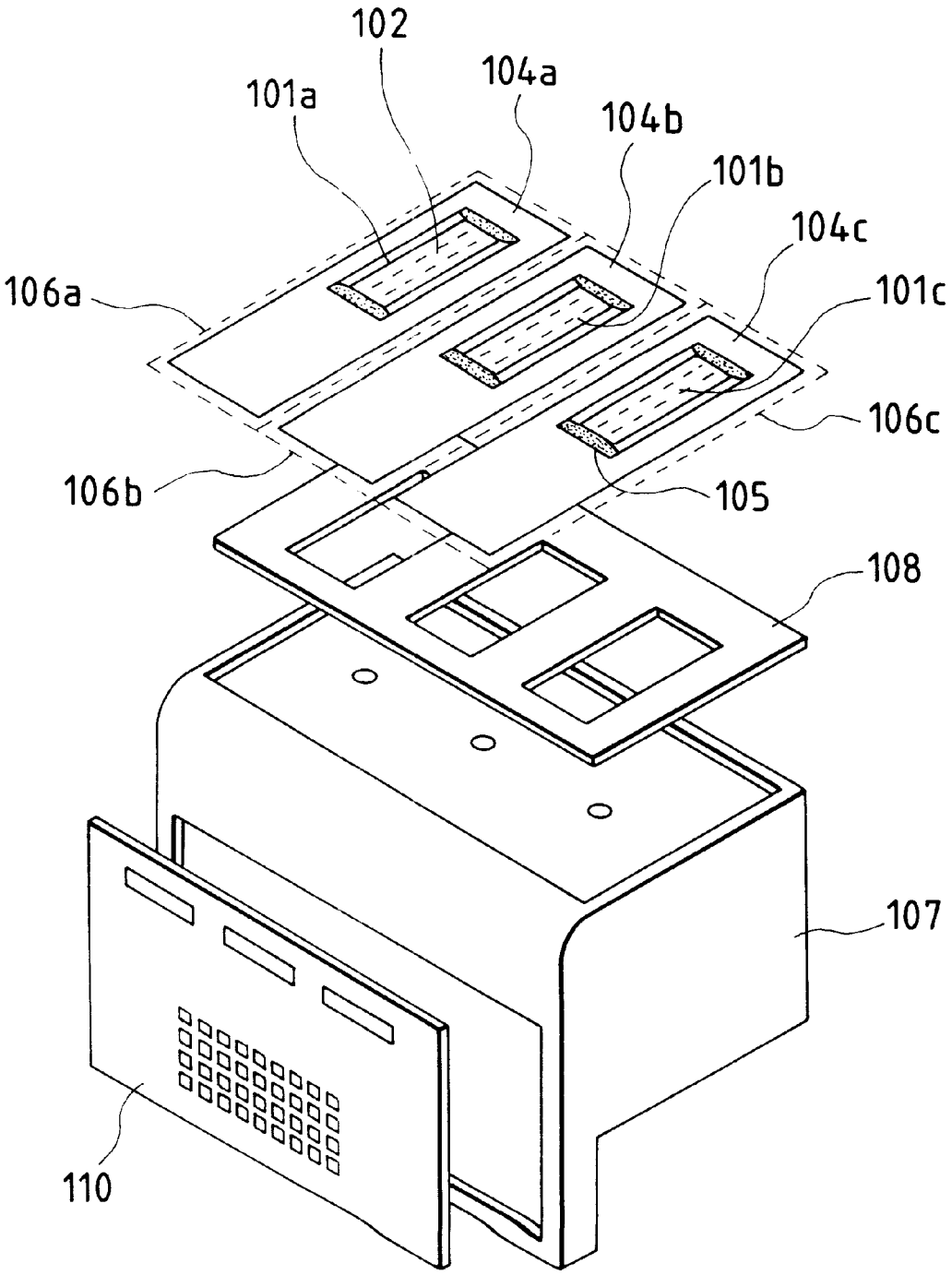
FIG. 30 is an exploded, perspective view to show the seventh embodiment of the ink jet recording head according to the present invention.
Figure 31A:
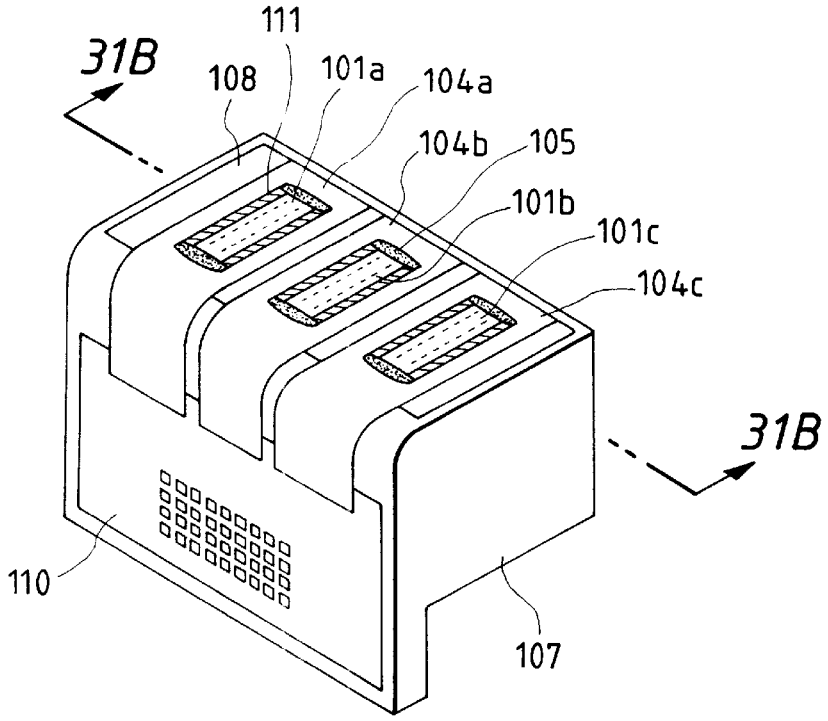
Figure 31B:
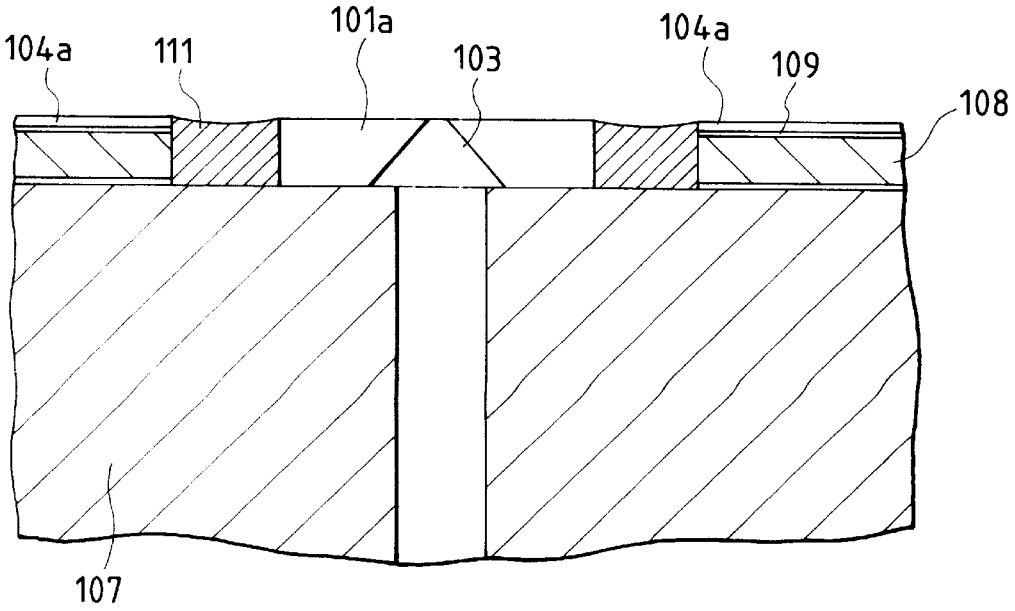

FIG. 30 is an exploded, perspective view to show the seventh embodiment of the ink jet recording head according to the present invention and FIGS. 31A and 31B are drawings to show the completely assembled state of the ink jet recording head shown in FIG. 30, wherein FIG. 31A is a perspective view of the appearance and FIG. 31B is a partially enlarged view of the cross section along 31B—31B shown in FIG. 31A.

As shown in FIG. 30 and FIGS. 31A and 31B, the present embodiment is composed of a plurality of recording element boards 101*a* to 101*c* in each of which a plurality of ejection outlets 102 with the recording elements for ejecting the recording liquid are arrayed; wiring boards 104*a* to 104*c*, each having an opening portion in which the recording element board 101*a* to 101*c* is mounted, being connected to the recording element board 101*a* to 101*c* mounted in the opening portion by the TAB mounting method, and sending an electric signal for ejecting the recording liquid to the recording element board 101*a* to 101*c*; sealing resin 105 for protecting lead wires for connection between the recording element board 101*a* to 101*c* and the wiring board 104*a* to 104*c* from corrosion by the recording liquid and from disconnection due to force acting from the outside; support member 107 for holding and securing the recording element boards 101*a* to 101*c*; support plate 108 having opening portions for permitting the recording element boards 101*a* to 101*c* to contact the support member 107, the support plate 108 holding and securing the wiring boards 104*a* to 104*c*; adhesive resin 109 for adhering the wiring boards 104*a* to 104*c* to the support plate 108; and wiring integration board 110 for integration of electric signals to the wiring boards 104*a* to 104*c*. The opening portions of the wiring boards 104*a* to 104*c* and the opening portions of the support plate 108 are so sized as to be nearly equal to each other and slightly larger than the recording element boards 101*a* to 101*c*. The sealing resin 111 fills the clearance formed between the recording element board 101*a* to 101*c* and the wiring board 104*a* to 104*c* or the support plate 108, i.e., portions in each opening portion of the support plate 108 where the recording element board 101*a* to 101*c* does not occupy.

The assembling method of the ink jet recording head of the arrangement as described above will be described.

First, a heating resistor layer and wires are patterned on a silicon wafer by the photolithography technology and then nozzle walls and ejection outlets 102 are made of a photosensitive resin. Next, recording liquid supply ports are formed by anisotropic etching, sand blasting, or the like, and thereafter the contour is made by cutting, thus forming the recording element board 101*a* to 101*c*.

Next, the recording element boards 101*a* to 101*c* are electrically connected with the respective wiring boards 104*a* to 104*c* for receiving the electric signals by the TAB mounting technology, and the sealing resin 105 is applied onto the electric signal input terminals on the recording element board 101*a* to 101*c* side, used for connection, and onto the lead wires on the wiring board 104*a* to 104*c* side.

Then the recording element boards 101*a* to 101*c* are bonded to the support member 107, and the wiring boards 104*a* to 104*c* are bonded to the support plate 108 with the adhesive resin 109, whereby the recording element units 106*a* to 106*c* each comprised of the recording element board 101*a* to 101*c* and the wiring board 104*a* to 104*c* are fixed to the structural body of the ink jet recording head comprised of the support member 107 and support plate 108.

Then the wiring boards 104*a* to 104*c* are electrically connected with the wiring integration board 110 and the wiring integration board 110 is held and secured on the support member 107.

After that, the sealing resin 111 is charged into the clearance between the recording element board 101*a* to 101*c* and the wiring board 104*a* to 104*c* or the support plate 108.

An aluminum material is usually used for the support plate 108 in terms of the cost, processability, thermal conduction property, and so on.

Normally, as described above, the recording element boards 101*a* to 101*c* and the wiring boards 104*a* to 104*c* are electrically connected by the lead wires by use of the TAB mounting technology, the lead wires are preliminarily protected by the sealing resin 105 in the form of the recording element units 106*a* to 106*c* for preventing corrosion by the recording liquid, disconnection by the force acting from the outside, and so on, and they are held and fixed on the support member 107 and the support plate 108.

Although there is another method for preventing remaining of the recording liquid by narrowing the gap to the wiring board 104*a* to 104*c* at the end face of the recording element board 101*a* to 101*c* on the side having no electric contact terminal with the wiring board 104*a* to 104*c*, the method for filling the clearance formed between the recording element board 101*a* to 101*c* and the support plate 108 with the sealing resin 111 can prevent the remaining of recording liquid more securely. In this case, the lower the viscosity of the sealing resin 111, the better the flow of the resin into fine portions, which makes the surface of sealing resin flatter. This is more advantageous for preventing the remaining of recording liquid. The sealing resin 111 may be a silicone resin or a urethane resin, and it is preferably a resin with repellency against the recording liquid.

In the present embodiment, as described above, the sealing resin 105, 111 fills the clearance formed between the recording element board 101*a* to 101*c* and the support plate 108 to eliminate the clearance between the recording element board 101*a* to 101*c* and the wiring board 104*a* to 104*c* and to prevent the recording liquid from remaining around the recording element boards 101*a* to 101*c*, thereby preventing corrosion of the wiring boards 104*a* to 104*c* and the support plate 108.

(Embodiment 8)

Figure 32:
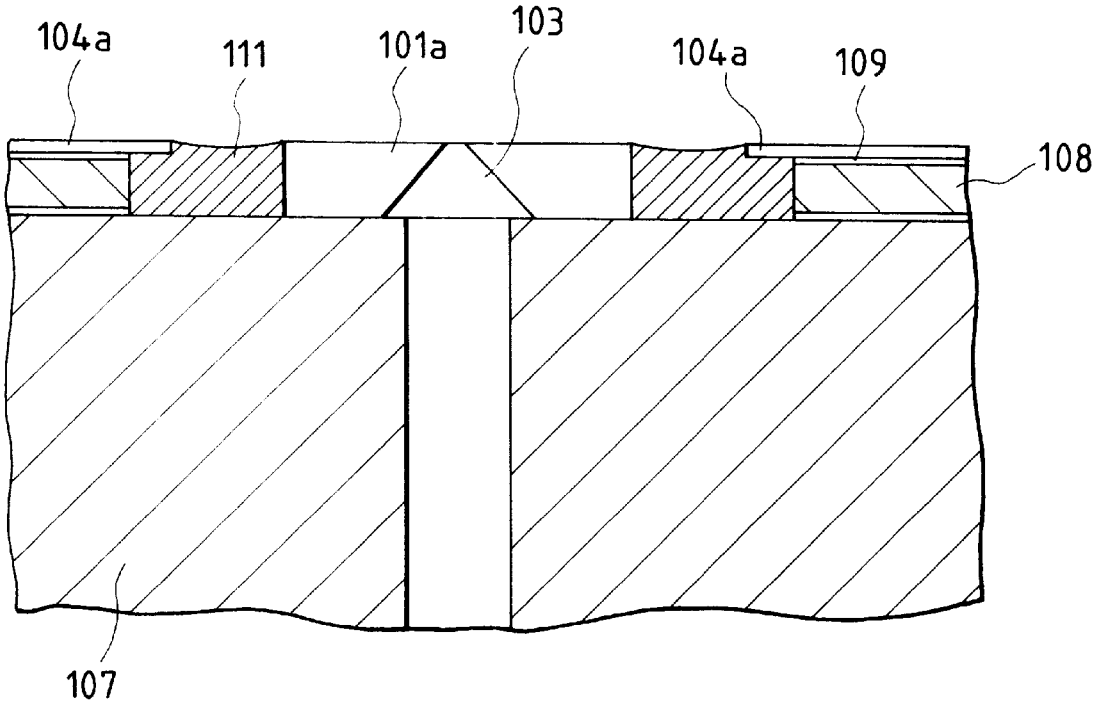
FIG. 32 is a drawing to show the eighth embodiment of the ink jet recording head according to the present invention.

FIG. 32 is a drawing to show the eighth embodiment of the ink jet recording head according to the present invention.

In comparison with the seventh embodiment, the present embodiment is arranged so that the opening portions of the support plate 108 are larger than the opening portions of the wiring boards 104*a* to 104*c* as shown in FIG. 32.

In the present embodiment constructed as described above, the portion around the opening portion can certainly contact the sealing resin 111 on the back surface of the wiring board 104*a* to 104*c*, whereby the recording liquid can be prevented more securely from flowing to the back surface of the wiring board 104*a* to 104*c*. In the support plate 108, the recording liquid is also prevented from flowing to the back side and from contacting it.

(Embodiment 9)

Figure 33A:
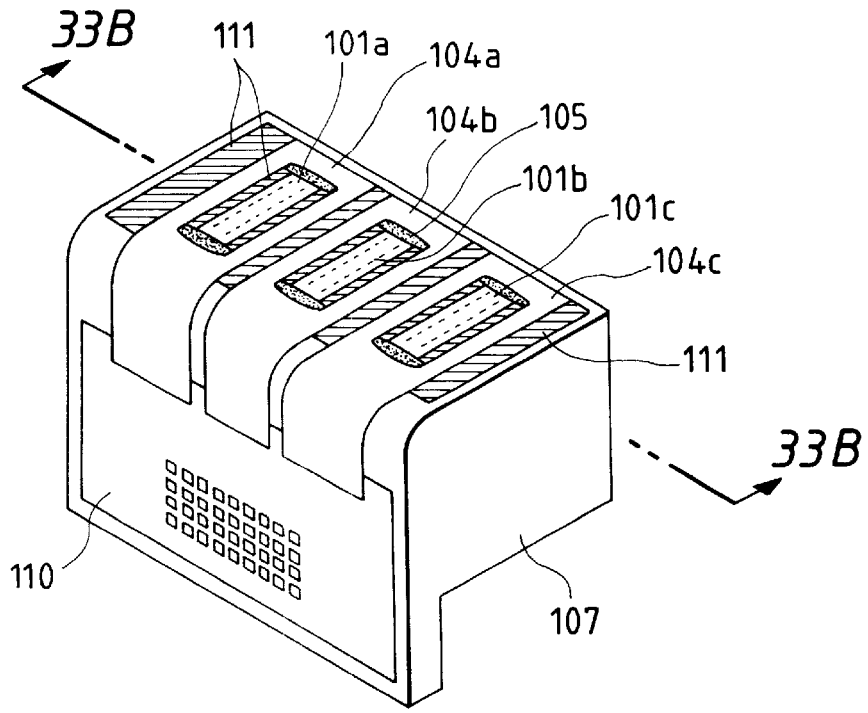
Figure 33B:
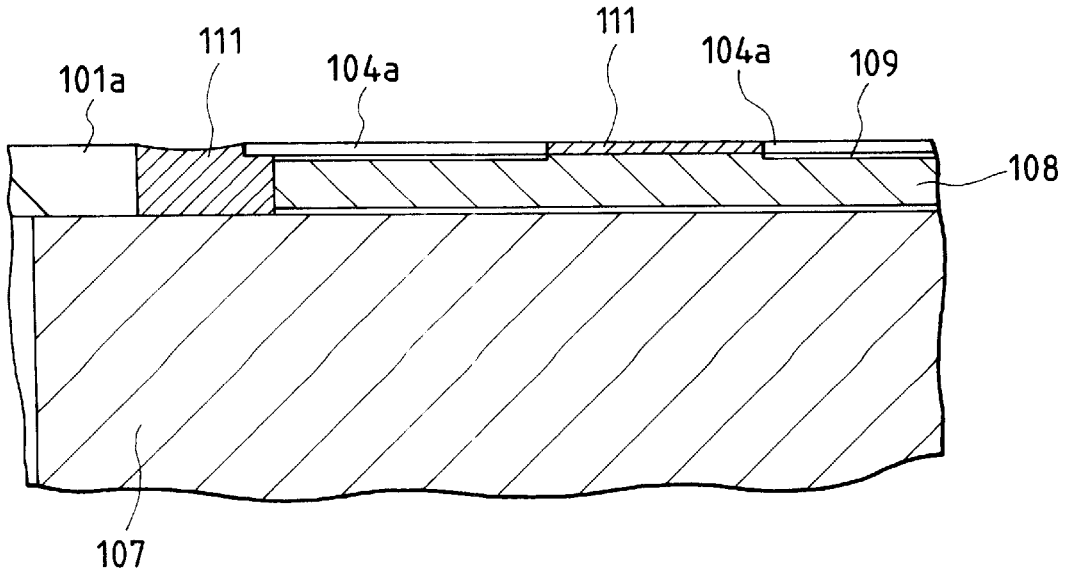

FIG. 33A and FIG. 33B are drawings to show the completely assembled state of the ninth embodiment of the ink jet recording head according to the present invention, wherein FIG. 33A is a perspective view of the appearance and FIG. 33B is a partially enlarged view of the cross section along 33B—33B shown in FIG. 33A.

As shown in FIGS. 33A and 33B, the present embodiment is achieved by modifying the arrangement of Embodiment 8 in such a manner that the sealing resin 111 is further provided on the surface of portions exposed to the outside without provision of recording element unit on the support plate 108.

Normally, on the support plate 108 there is a difference of height corresponding to the thicknesses of the wiring board 104*a* to 104*c* and the adhesive resin 109 between the surface of the wiring board 104*a* to 104*c* and the portions of the support plate 108 exposed to the outside, so that the portions of the support plate 108 exposed to the outside constitute grooves having the depth corresponding to that height. If the recording liquid should remain in such a groove, the recording liquid could flow to the back side of the wiring board 104*a* to 104*c* so as to corrode the wires or to corrode the surface of support plate 108, as described above in Embodiments 7 and 8.

By placing the sealing resin 111 on the support plate 108 exposed to the outside as in the present embodiment, the recording liquid is prevented from flowing to the back side of the wiring board 104*a* to 104*c* and thereby from corroding the wires and the surface of support plate 108.

A charge amount of the sealing resin 111 is determined desirably so as to be just enough to fill the level difference corresponding to the thicknesses of the wiring board 104*a* to 104*c* and the adhesive resin 109.

(Embodiment 10)

Figure 34:
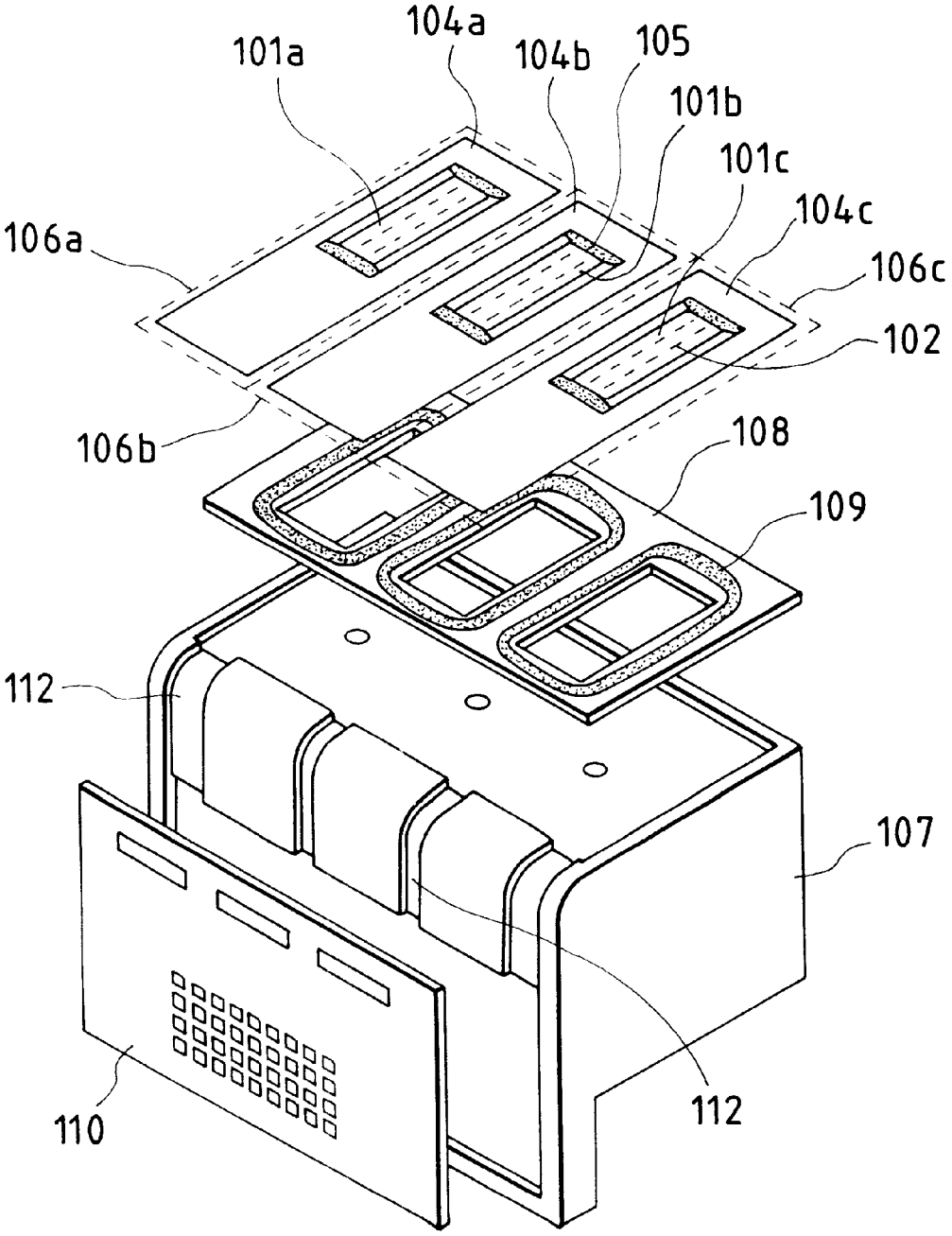
FIG. 34 is an exploded, perspective view to show the tenth embodiment of the ink jet recording head according to the present invention.
Figure 35A:
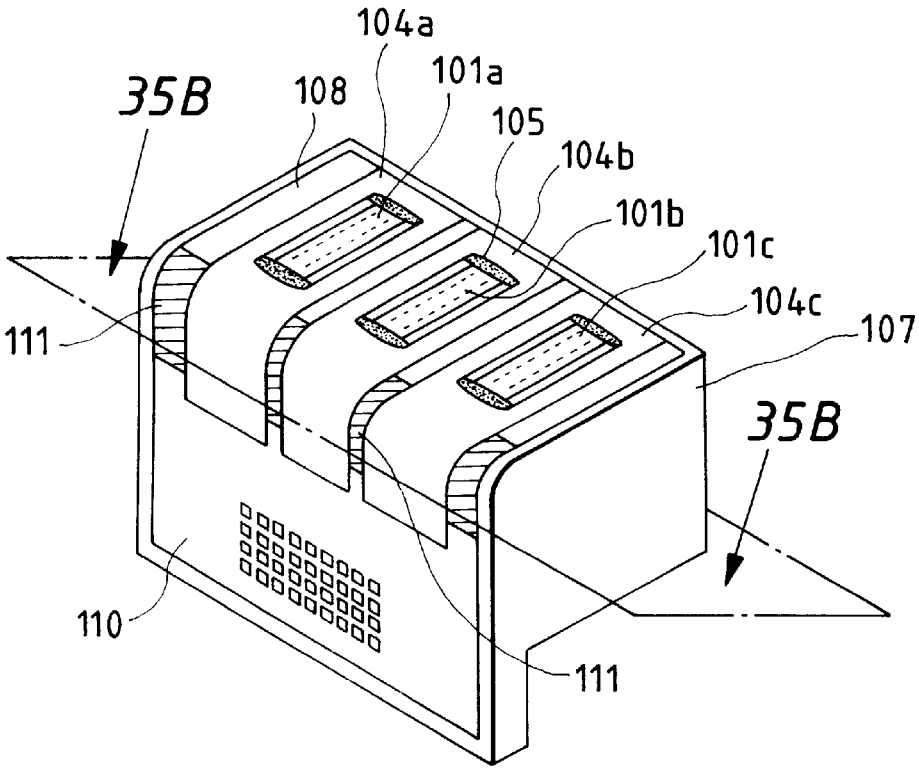
Figure 35B:
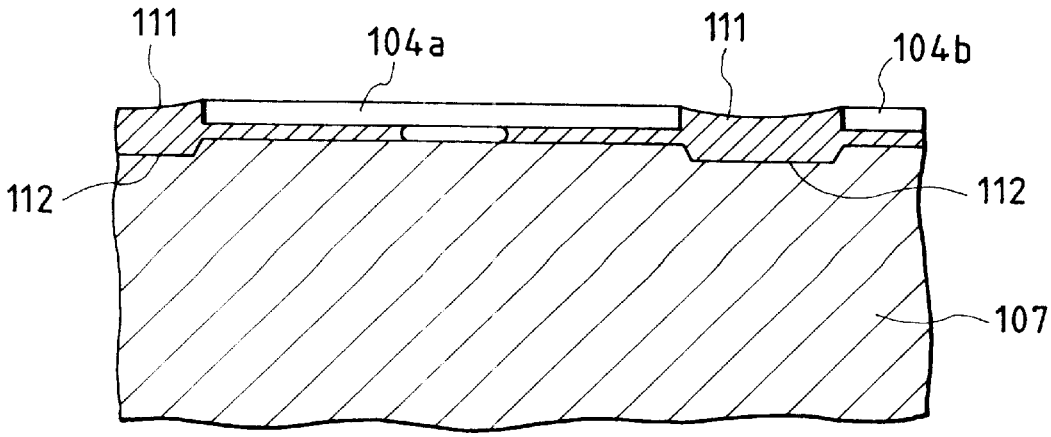

FIG. 34 is an exploded, perspective view to show the tenth embodiment of the ink jet recording head according to the present invention and FIGS. 35A and 35B are drawings to show the completely assembled state of the ink jet recording head shown in FIG. 34, wherein FIG. 35A is a perspective view of the appearance and FIG. 35B is a partially enlarged view of the cross section along 35B—35B shown in FIG. 35A.

As shown in FIG. 34 and FIGS. 35A and 35B, the present embodiment is composed of a plurality of recording element boards 101*a* to 101*c* in each of which a plurality of ejection outlets 102 with the recording elements for ejecting the recording liquid are arrayed; wiring boards 104*a* to 104*c* connected with the respective recording element boards 101*a* to 101*c* by the TAB mounting method and sending the electric signal for ejecting the recording liquid to each of the recording element boards 101*a* to 101*c;* sealing resin 105 for protecting the lead wires for connecting the recording element board 101*a* to 101*c* with the wiring board 104*a* to 104*c* from corrosion by the recording liquid and from disconnection due to the force acting from the outside; support member 107 for holding and securing the recording element boards 101*a* to 101*c;* support plate 108 for holding and securing the wiring boards 104*a* to 104*c;* adhesive resin 109 for adhering the wiring boards 104*a* to 104*c* to the support plate 108; and wiring integration board 110 for integration of electric signals to the wiring boards 104*a* to 104*c;* and grooves 112 are provided from the support plate 108 to the wiring integration board 110 on the both outer sides of a portion of the support member 107 corresponding to each bent portion of the wiring board 104*a* to 104*c*.

The assembling method of the ink jet recording head of the arrangement as described above will be described.

First, the heating resistor layer and wires are patterned on a silicon wafer by the photolithography technology and then the nozzle walls and ejection outlets 102 are made of a photosensitive resin. Next, the recording liquid supply ports are formed by anisotropic etching, sand blasting, or the like, and thereafter the contour is made by cutting, thus forming the recording element board 101*a* to 101*c*.

Next, the recording element boards 101*a* to 101*c* are electrically connected with the respective wiring boards 104*a* to 104*c* for receiving the electric signals by the TAB mounting technology, and the sealing resin 105 is applied onto the electric signal input terminals on the recording element board 101*a* to 101*c* side, used for connection, and onto the lead wires on the wiring board 104*a* to 104*c* side.

Then the recording element boards 101*a* to 101*c* are bonded to the support member 107, and the wiring boards 104*a* to 104*c* are bonded to the support plate 108 with the adhesive resin 109, whereby the recording element units 106*a* to 106*c* each comprised of the recording element board 101*a* to 101*c* and the wiring board 104*a* to 104*c* are fixed to the structural body of the ink jet recording head comprised of the support member 107 and support plate 108.

After that, the wiring boards 104*a* to 104*c* are electrically connected with the wiring integration board 110 and the wiring integration board 110 is held and secured on the support member 107.

An aluminum material is usually used for the support plate 108 in terms of the cost, processability, thermal conduction property, and so on.

As described above, the wiring boards 104*a* to 104*c* are arranged so that the bonded surface thereof to the support plate 108 is bonded to the support plate 108 by the adhesive resin 109 and the electric signal input terminal side thereof is electrically connected with the wiring integration board 110 and is fixed. Since the recording element boards 101*a* to 101*c* in the recording element units 106*a* to 106*c* and the wiring integration board 110 are bonded and fixed to the support member 107 with high position accuracy, it is very difficult to bond and fix the bent portions of the wiring boards 104*a* to 104*c* to the support member 107 by heat seal or the like. It is thus normal to seal the periphery of the wiring board 104*a* to 104*c* with the sealing resin 111 for the purpose of preventing the recording liquid from flowing to the back side of the wiring board 104*a* to 104*c* and for adhesion of the wiring board 104*a* to 104*c* to the support member 107. However, since the clearance is very narrow between the bent portion of wiring board 104*a* to 104*c* and the support member 107, the sealing resin 111 permeates into the clearance by capillarity and it is thus difficult to stabilize amounts of sealing resin 111 applied to the periphery of the wiring board 104*a* to 104*c*.

Therefore, the grooves 112 are formed from the support plate 108 to the wiring integration board 110 on the both outer sides of the portion of the support member 107 corresponding to each bent portion of the wiring board 104*a* to 104*c,* whereby a margin is given to the supply amount of sealing resin 111 so as to sufficiently compensate for permeation of the sealing resin 111 to the back side of wiring board 104*a* to 104*c*.

In an application wherein a plurality of wiring boards 104*a* to 104*c* are mounted in parallel on one ink jet recording head, a groove is shared between adjacent wiring boards, which requires only one supply of sealing resin 111 to enhance the production efficiency. In that case, the width of the groove needs to be enough to sufficiently seal the two wiring boards.

In the present embodiment, as described above, since the grooves 112 are formed in the region of from the support plate 108 to the wiring integration board 110 and on the both outer sides of the portion of the support member 107 corresponding to each bent portion of the wiring board 104*a* to 104*c,* the margin is given to the supply amount of sealing resin 111, which can prevent sealing failure.

(Embodiment 11)

Figure 36:
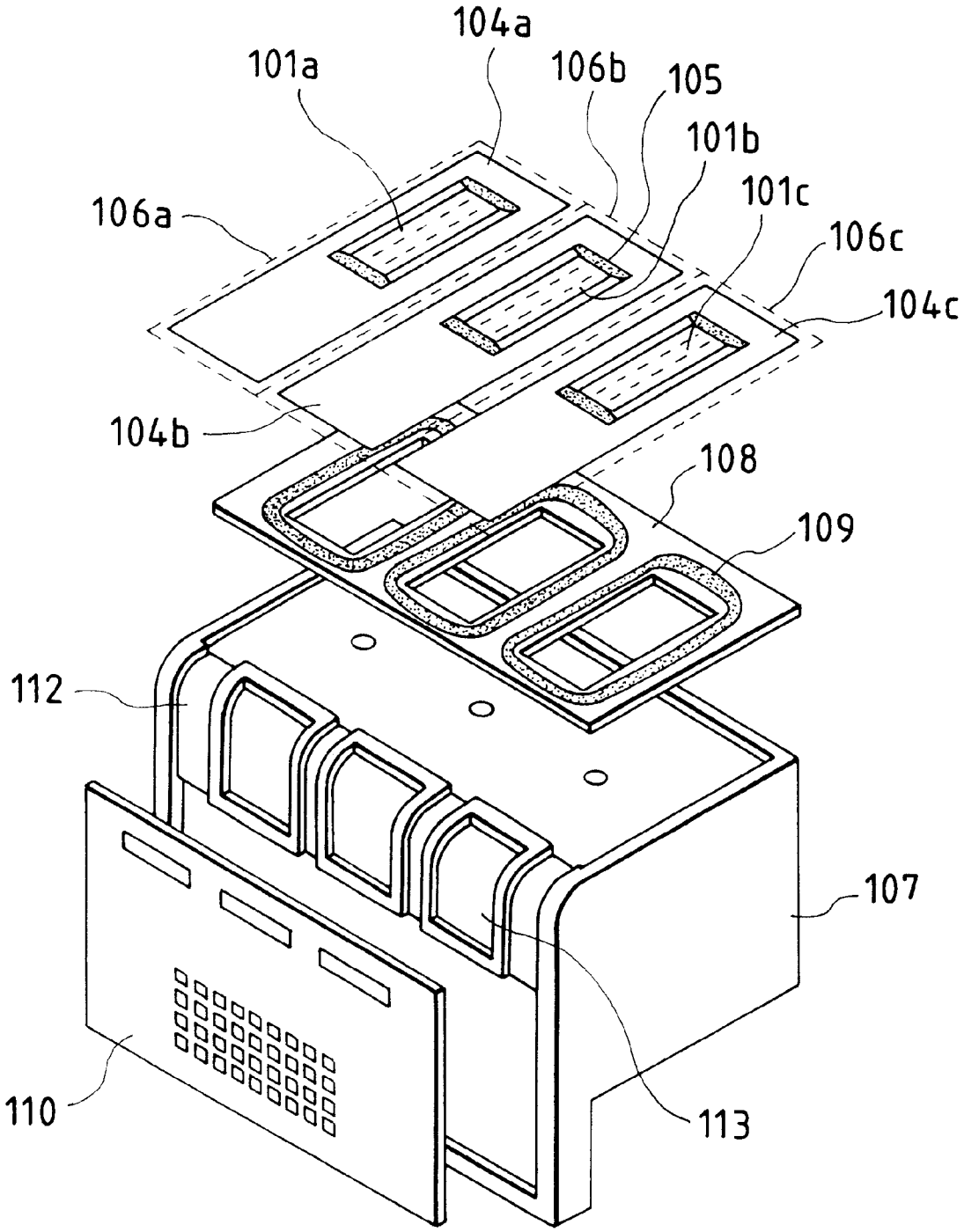
FIG. 36 is an exploded, perspective view to show the eleventh embodiment of the ink jet recording head according to the present invention.
Figure 37A:
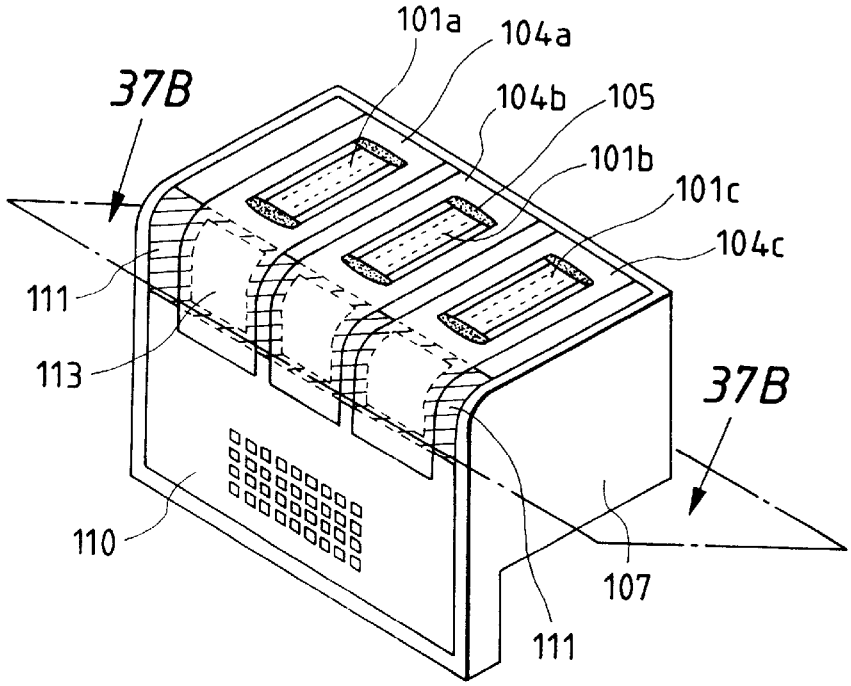
Figure 37B:
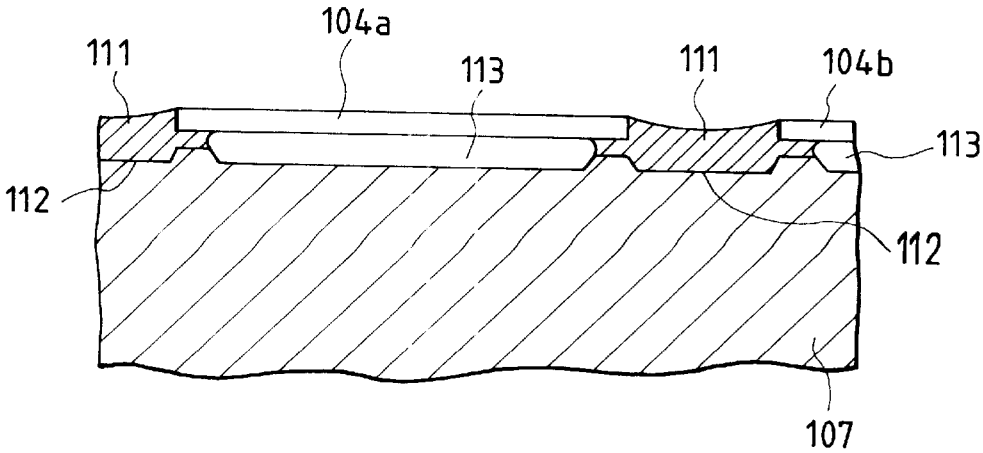

FIG. 36 is an exploded, perspective view to show the eleventh embodiment of the ink jet recording head according to the present invention and FIGS. 37A and 37B are drawings to show the completely assembled state of the ink jet recording head shown in FIG. 36, wherein FIG. 37A is a perspective view of the appearance and FIG. 37B is a partly enlarged view of the cross section along 37B—37B shown in FIG. 37A.

As shown in FIG. 36 and FIGS. 37A and 37B, the present embodiment is arranged by modifying the tenth embodiment in such a way that trenches 113 having the width narrower than the width of the wiring boards 104*a* to 104*c* are further provided in the portions of the support member 107 corresponding to the bent portions of the wiring boards 104*a* to 104*c*, for stabilizing the amount of the sealing resin 111 applied to the periphery of the wiring boards 104*a* to 104*c*.

In the present embodiment, the capillarity does not act in the portions where the trenches 113 are provided, so that permeation of the sealing resin 111 stops before the trenches 113. Therefore, the supply amount of sealing resin 111 can be adjusted depending upon the size of trench 113, whereby the supply amount of sealing resin 111 can be decreased to the irreducible minimum.

(Embodiment 12)

Figure 38A:
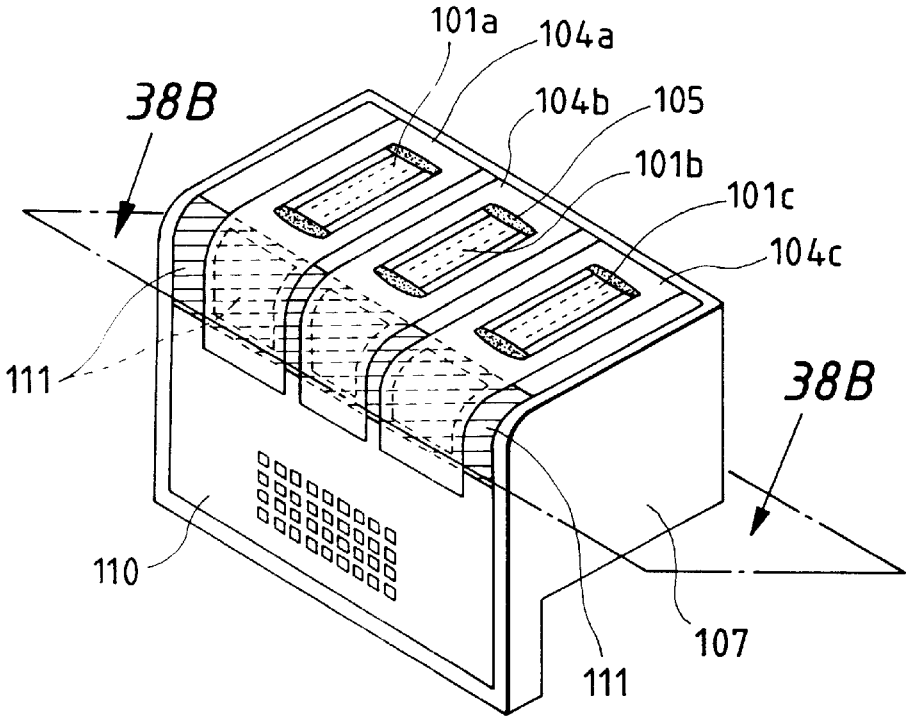
Figure 38B:
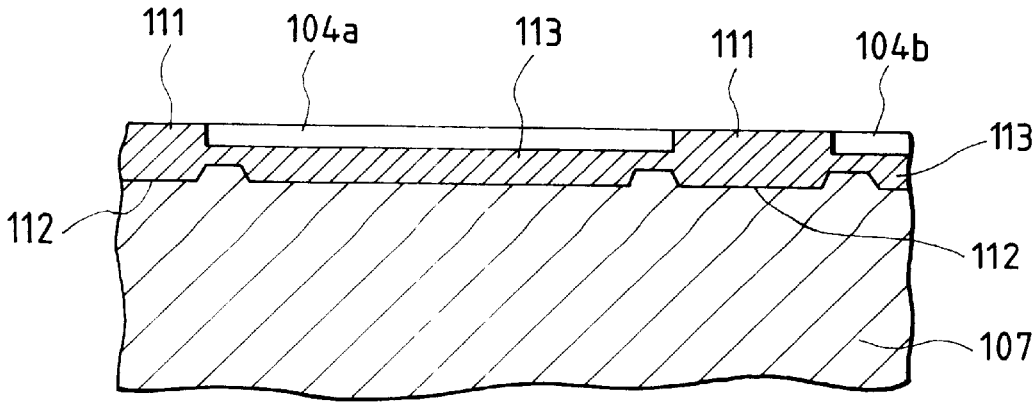

FIGS. 38A and 38B are drawings to show the completely assembled state of the twelfth embodiment of the ink jet recording head according to the present invention, wherein FIG. 38A is a perspective view of the appearance and FIG. 38B is a partially enlarged view of the cross section along 38B—38B shown in FIG. 38A.

As shown in FIGS. 38A and 38B, the present embodiment is arranged by modifying the eleventh embodiment in such a way that the sealing resin 111 is preliminarily charged into the trenches 113, the wiring boards 104*a* to 104*c* are bent thereafter, and then the periphery of the wiring board 104*a* to 104*c* is sealed.

Since there is the clearance between the bent portion of the wiring board 104*a* to 104*c* and the support member 107 and since the recording liquid remains there most, the periphery of wiring board 104*a* to 104*c* must be sealed for certain.

In the present embodiment, the recording element units are fixed to the support member 107 and to the support plate 108 and then the electric signal input terminal side of the wiring boards 104 to 104*c* is connected to the wiring integration board 110; thereafter, the sealing resin 111 is preliminarily charged into the trenches 113 provided at the positions of the support member 107 corresponding to the bent portions of the wiring boards 104*a* to 104*c* and then the wiring integration board 110 is held and fixed to the support member 107; thereafter, the periphery of the bent portion of the wiring board 104*a* to 104*c* is sealed in the same manner as in the eleventh embodiment, thereby preventing the permeation of sealing resin 111 due to the capillarity.

The amount of the sealing resin 111 preliminarily charged into the trench 113 is preferably approximately equal to the volume of the trench 113.

The present embodiment uses a slightly larger amount of the sealing resin 111 than the eleventh embodiment, but the present embodiment can seal the periphery of wiring board 104*a* to 104*c* securely.

(Embodiment 13)

Figure 39A:
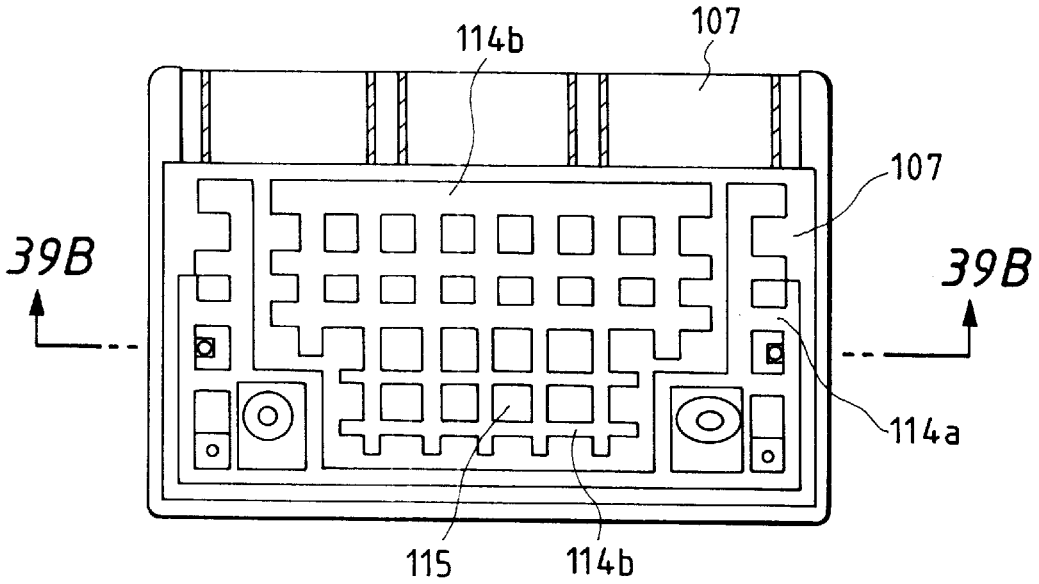
Figure 39B:
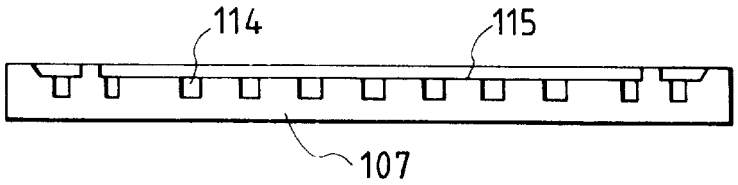
Figure 39C:
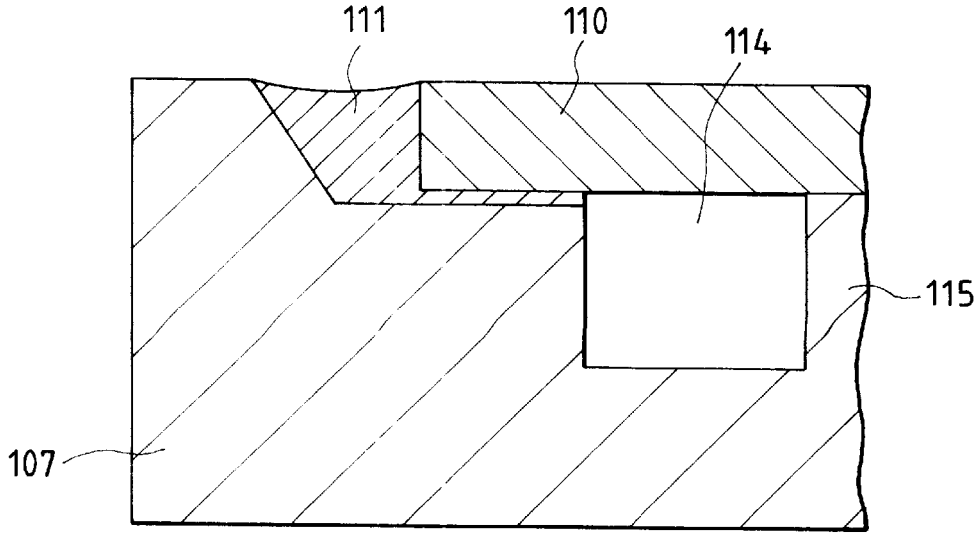

FIGS. 39A, 39B, and 39C are drawings to show the thirteenth embodiment of the ink jet recording head according to the present invention, wherein FIG. 39A is a front view of the support member, FIG. 39B is a cross-sectional view along 39B—39B shown in FIG. 39A, and FIG. 39C is an enlarged view of the cross section along 38B—38B after completion of assembly.

The present embodiment concerns sealing around the wiring integration board 110 of the ink jet recording head shown in the tenth embodiment and grid-patterned trench 114 is provided in the portion of the support member 107 to which the wiring integration board 110 is attached. The external shape of the trench 114 is smaller than that of the wiring integration board 110, so that the entire back surface of the wiring integration board 110 can contact the support member 107.

Normally, the entire periphery of the wiring integration board 110 is sealed by the sealing resin 111 without clearance in order to prevent permeation of the recording liquid to the back surface. When the trench 114 is provided inside the portion of the support member 107 in contact with the back surface of the wiring integration board 110, the sealing resin 111 supplied to the periphery of the wiring integration board 110 permeates by capillarity into only the portions where the wiring integration board 110 is in contact with the support member 107, and the permeation stops before the trench 114.

This can stabilize the amount of the sealing resin 111 applied to the periphery of the wiring integration board 110.

With the arrangement of the grid-patterned trench 114, even if there is a defect in the sealing of the periphery of the wiring integration board 110 and even if the recording liquid permeates to the back surface of the wiring integration board 110, the recording liquid will be apt to remain in the trench 114 and will thus be prevented from permeating to the back surface of the wiring board 104.

Further, if the trench 114 is divided into trench 114*a* adjacent to the periphery of the support member 107 and trench 114*b* located inside and if they are isolated from each other as shown in FIGS. 39A to 39C, the permeation of recording liquid can be prevented more reliably.

Islands 115 formed in the grid-patterned trench 114 are effective in eliminating flexure of the wiring integration board 110 against the external force such as contact pressure of the output terminal for supplying the electric signal to the wiring integration board 110, thus improving electric connection.

In the present embodiment as described above, the grid-patterned trench 114 is provided in the portion of the support member 107 to which the wiring integration board 110 is attached and the entire periphery of the wiring integration board 110 is sealed by the sealing resin 111, whereby the recording liquid can be prevented from permeating to the back surface of the wiring integration board 110 and wiring board 104.

(Embodiment 14)

Figure 50:
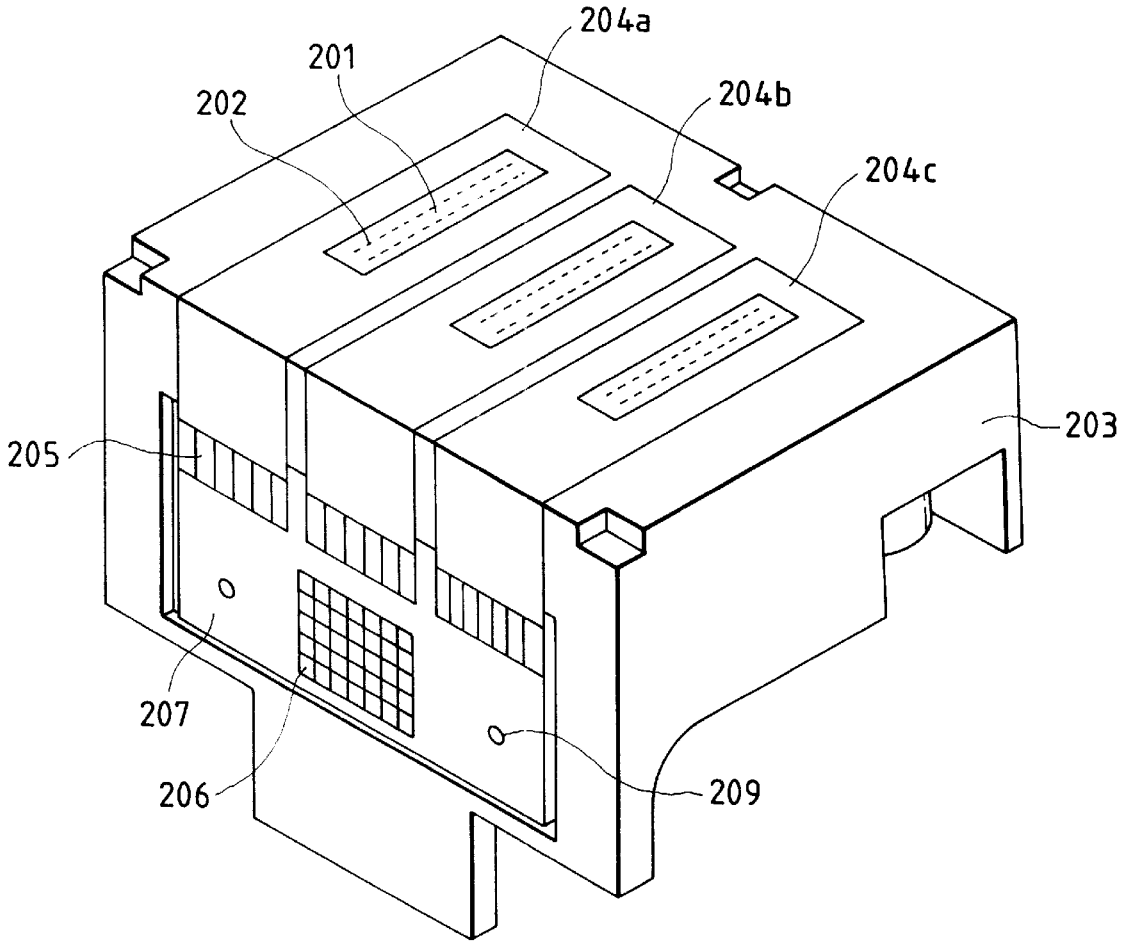
FIG. 50 is a schematic, perspective view of the ink jet recording head according to the conventional technology.

The wiring integration board 207 in Embodiments 9 to 13 described above is often fixed to the support member 203 by the method of adhesive, double coated tape, thermal welding, or the like, but high position accuracy is required for the electric signal input terminal 206 of the wiring integration board 207 for contact with the external output terminal (not illustrated). Therefore, as shown in FIG. 50, it is normal to fix the wiring integration board 207 to the support member 203 by positioning the wiring integration board 207 by pins 209 and thereafter fusing the pins 209 by heat, which is advantageous in aspects of the cost and manufacturing tactics.

Figure 51:
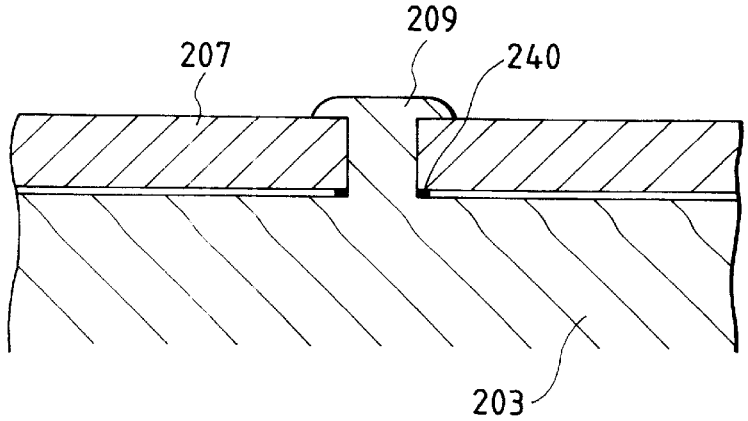
FIG. 51 is a cross-sectional view of pin and insertion hole after completion of assembly thereof according to the conventional technology.

In the above-stated method for securing the wiring integration board to the support member by the pins, however, the diameter of each pin is set to be close to the diameter of an insertion hole in the wiring integration board corresponding to the pin, for assuring the position accuracy of wiring integration board. When the wiring integration board is coupled with the pin, they touch each other to make burr 240 and the burr 240 is deposited on the back surface of the wiring integration board 207 as shown in FIG. 51, which weakens adhesion between the wiring integration board 207 and the support member 203. When the wiring integration board is fixed in such an unstable state in this way, electrical conduction becomes unstable at the contact between the electric signal input terminal on the wiring integration board and the external output terminal, which poses a problem of contact failure.

In view of the problem in the conventional technology as described above, the present embodiment provides a highly reliable ink jet recording head for positioning and securing the wiring integration board to the support member, which is free of the trouble due to production of burr during assembly, in which the wiring integration board is adhered and fixed to the support member for certain, and which is free of the electrical contact failure at the contact between the input terminal of wiring integration board and the external output terminal.

Figure 40:
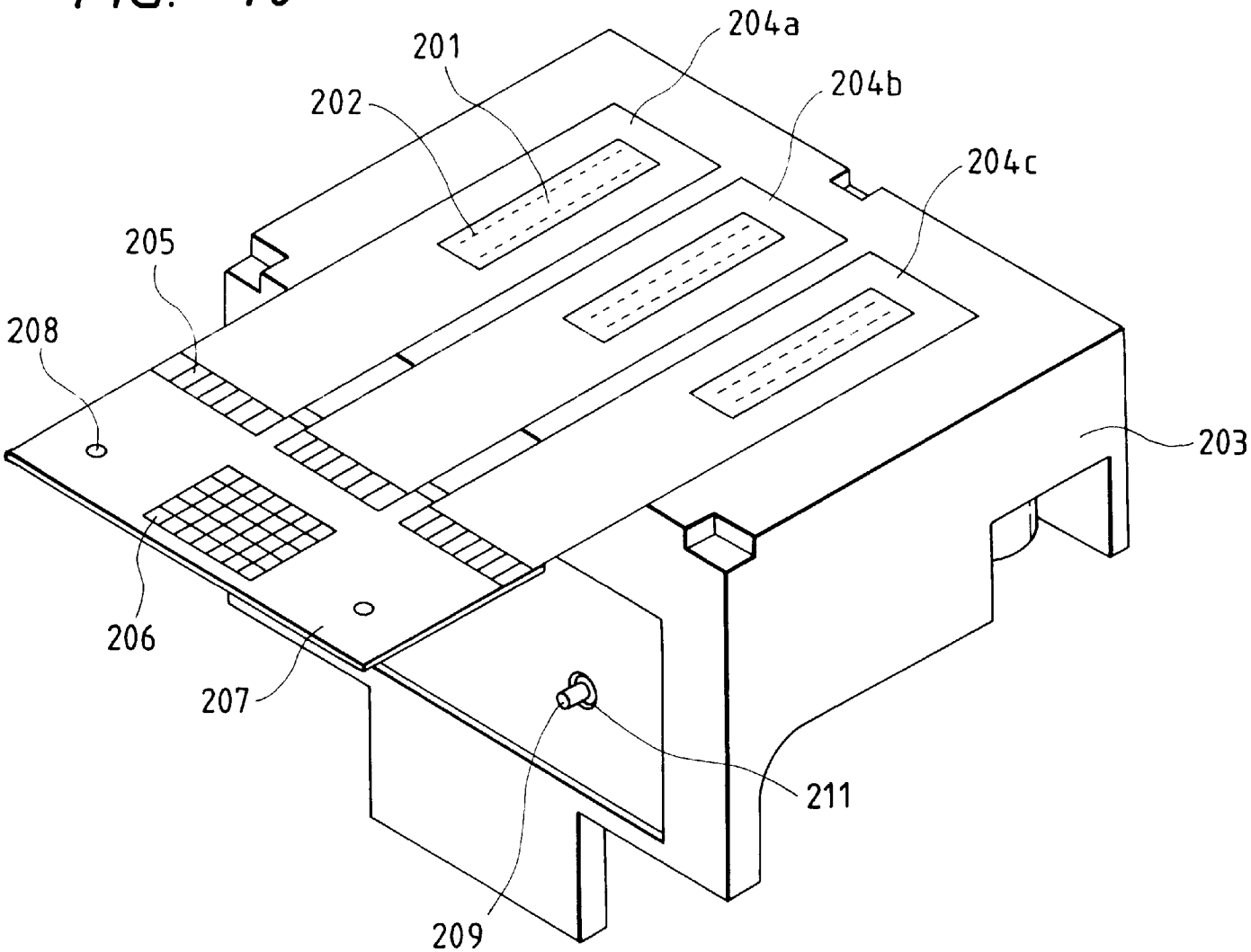
FIG. 40 is an exploded, perspective view of the ink jet recording head according to the fourteenth embodiment of the present invention.

FIG. 40 is an exploded, perspective view of the fourteenth embodiment of the ink jet recording head according to the present invention. The ink jet recording head of the present embodiment has three recording element boards 201 in each of which a plurality of recording elements for supplying the energy for ejecting the ink are arrayed; wiring boards 204*a,* 204*b,* 204*c,* connected to the respective recording element boards 201, for supplying the electric signal for ejecting the ink; electric signal input terminals 205 for capturing the electric signal into the respective wiring boards 204*a,* 204*b,* 204*c;* wiring integration board 207 for integration of common input terminals in the plural wiring boards 204*a,* 204*b,* 204*c;* electric signal input terminal 206, provided in the wiring integration board 207, for input of electric signal from the external output terminal (not illustrated); support member 203 for securing the recording element boards 201, the wiring boards 204*a,* 204*b,* 204*c,* and the wiring integration board 207, in which ink flow paths from the ink tanks (not illustrated) are formed; insertion holes 208 and pins 209 for securing the wiring integration board 207 to the support member 203; and grooves 211 for catch of burr 210 described below with the drawing.

The recording element boards 201 are normally fabricated in such a way that the heating resistor layer, wirings, etc. are patterned on a silicon wafer by the photolithography technology, nozzles as flow paths and ejection outlets (orifices) are made of a photosensitive resin, and the silicon wafer is cut. Then the recording element boards 201 are connected to the respective wiring boards 204*a,* 204*b,* 204*c* for receiving the electric signal by the TAB mounting technology. Normally, one wiring board is provided with approximately thirty electric signal input terminals 205 for input of electric signal from the outside to the recording element board 201, but, in order to decrease the number of electric contacts with the outside, the all electric signal input terminals 205 of the wiring boards 204*a,* 204*b,* 204*c* are electrically connected and fixed to the wiring integration board 207 and common electric signal input terminals out of the plural wiring boards 204*a,* 204*b,* 204*c* are integrated at the electric signal input terminal 206 on the wiring integration board 207. The wiring integration board 207 is fixed to the support member 203 by thermal welding described below.

Figure 41:
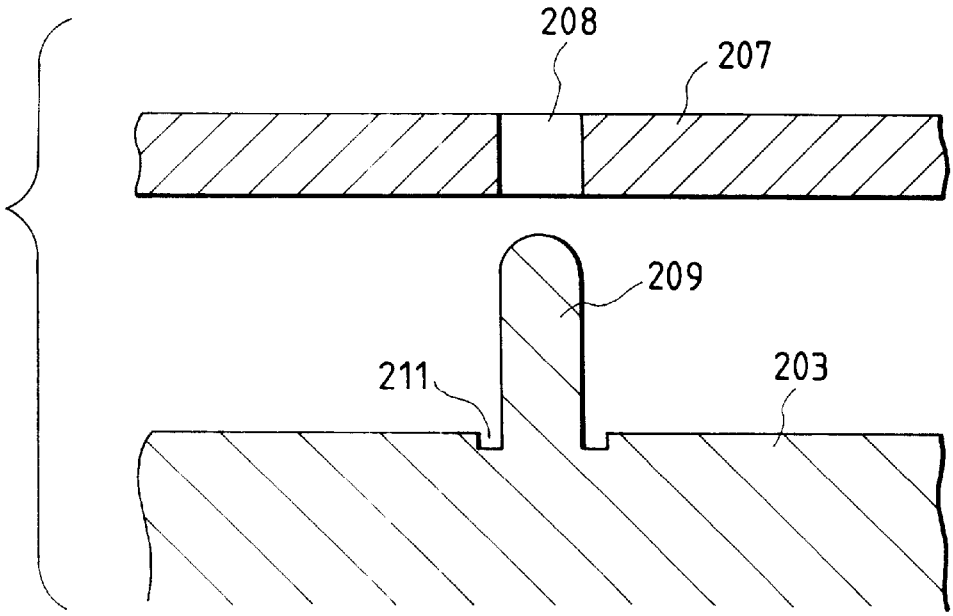
FIG. 41 is a cross-sectional view before assembly of pin and insertion hole according to the fourteenth embodiment of the present invention.
Figure 42:
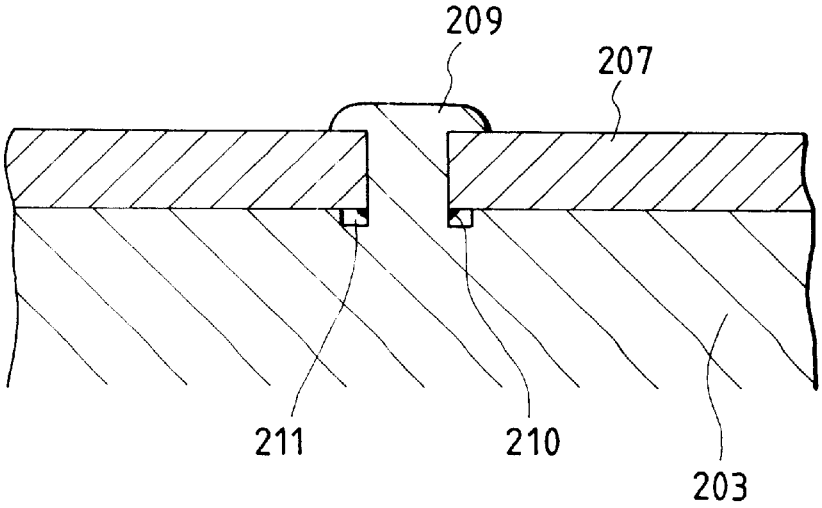
FIG. 42 is a cross-sectional view of the pin and insertion hole after completion of assembly thereof according to the fourteenth embodiment of the present invention.

FIG. 41 is a cross-sectional view before assembly of the pin 209 provided in the support member 203 and the insertion hole 208 of the wiring integration board 207 to be associated with the pin 209. In FIG. 41, the groove 211 for catching the burr produced upon assembly, described hereinafter with FIG. 42, is provided around the root of pin 209. The position accuracy of the wiring integration board 207 relative to the support member 203 needs to be in the range of approximately 0.1 mm from the positional relation between the electric signal input terminal 206 of wiring integration board 207 and the external output terminal side connected thereto, which is determined by the insertion hole 208 (of the diameter 1.3 mm) and the pin 209 (of the diameter 1.2 mm).

FIG. 42 is a cross-sectional view after completion of assembly of the insertion hole 208 and pin 209 shown in FIG. 41. As shown in FIG. 42, the wiring integration board 207 is fixed to the support member 203 by inserting the pin 209 into the insertion hole 208 and fusing the head of pin 209 by heat to crush it (thermal welding). While the pin 209 is inserted into the insertion hole 208, the pin 209 molded of a molding material is shaved to produce the fine burr 210 and the burr adheres to around the insertion hole 208 on the back surface side of the wiring integration board 207. Since the groove 211 is provided around the root of pin 209, the burr 210 drops into the groove 211 as shown in FIG. 42, whereby the wiring integration board 207 comes to contact the support member 203 perfectly. The groove 211 can be made readily by forming a projection in the mold for injection molding of the support member 203 of the molding material. By securing the support member 203 in close contact to the wiring integration board 207 in this way, no electric contact failure occurs at the contact between the electric signal input terminal 206 of the wiring integration board 207 and the external output terminal.

(Embodiment 15)

Figure 43:
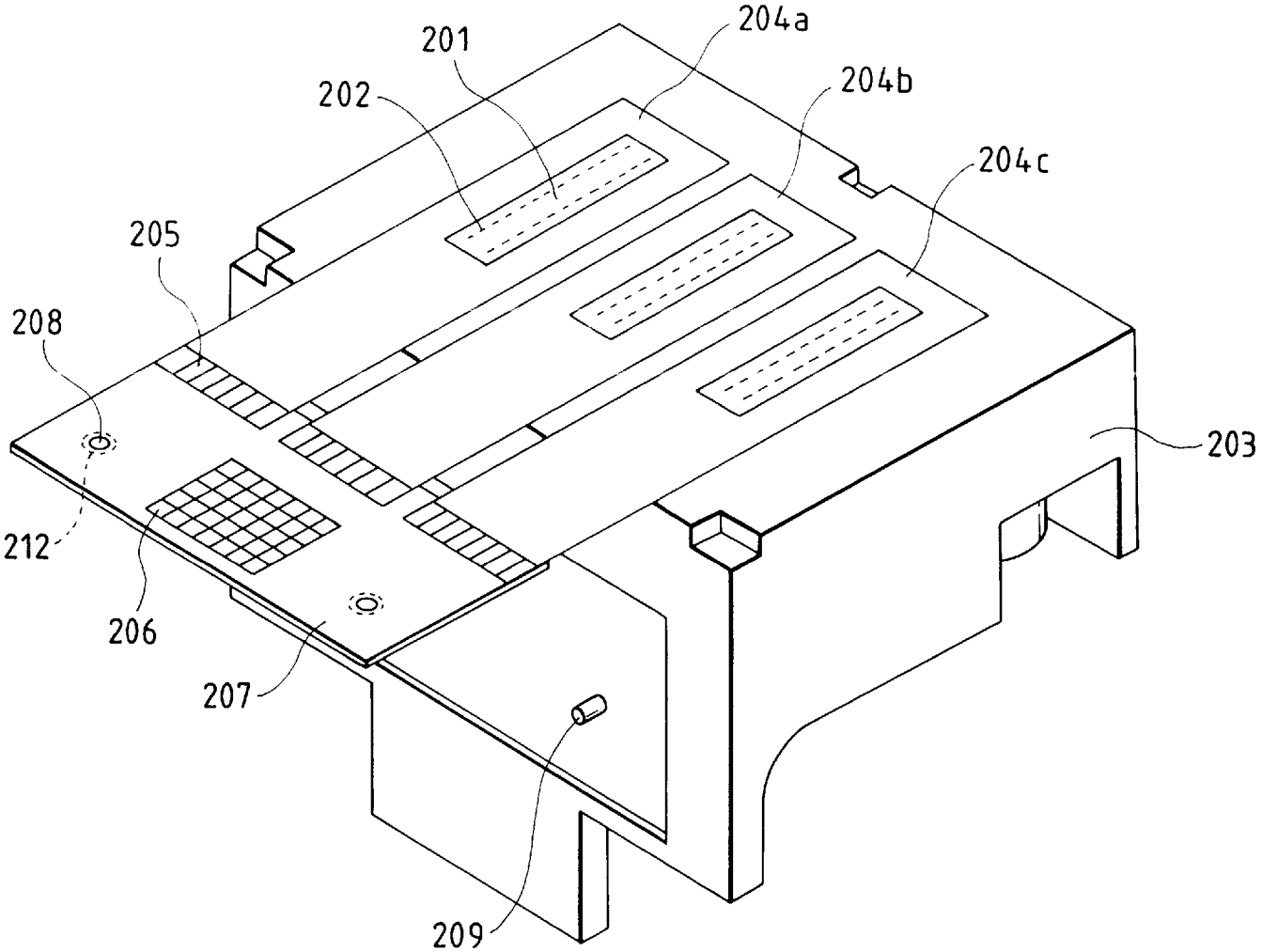
FIG. 43 is an exploded, perspective view of the ink jet recording head according to the fifteenth embodiment of the present invention.
Figure 44:
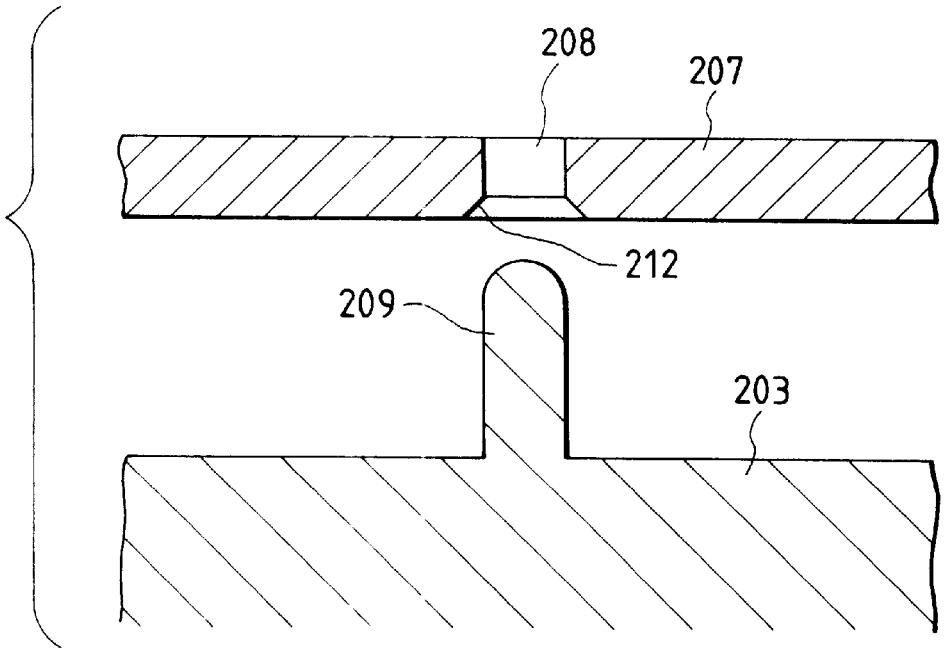
FIG. 44 is a cross-sectional view before assembly of pin and insertion hole according to the fifteenth embodiment of the present invention.
Figure 45:
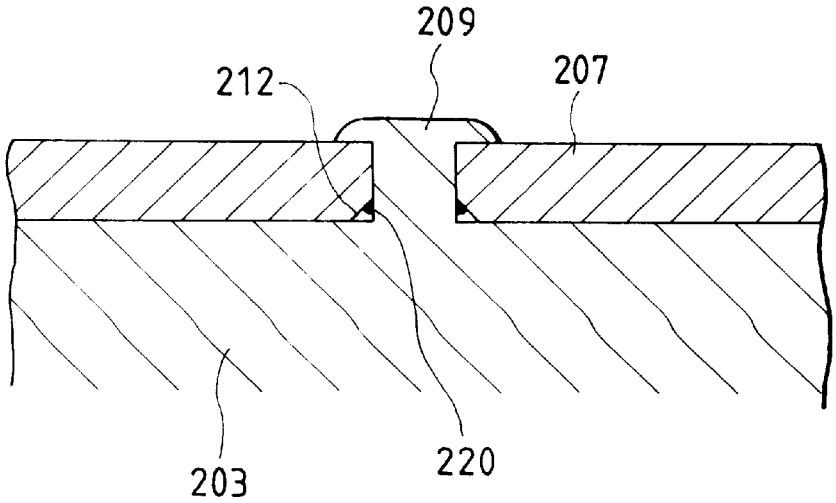
FIG. 45 is a cross-sectional view of the pin and insertion hole after completion of assembly thereof according to the fifteenth embodiment of the present invention.

FIG. 43 is an exploded, perspective view of the fifteenth embodiment of the ink jet recording head according to the present invention. FIG. 44 is a cross-sectional view before assembly of a pin of the support member in FIG. 43 and an insertion hole of the wiring integration board associated therewith, and FIG. 45 is a cross-sectional view after completion of assembly of the pin and insertion hole shown in FIG. 44. In these figures, the same reference symbols denote the same components as those in Embodiment 14, and only different components from Embodiment 14 will be described.

The present embodiment is constructed in such structure that chamfer 212 is provided on the back surface side (the surface side in contact with the support member 203) of the insertion hole 208 in the wiring integration board 207 as shown in FIG. 43 and FIG. 44, and there is no specific groove around the root of pin 209, different from Embodiment 14.

In this arrangement, as shown in FIG. 45, the wiring integration board 207 is fixed to the support member 203 by inserting the pin 209 into the insertion hole 208 and fusing the head of pin 209 by heat to crush it in the same manner as in Embodiment 14. With provision of the chamfer 212, the pin 209 molded of the molding material is shaved during insertion of the pin 209 into the insertion hole 208 to produce the fine burr 220 and the burr 220 adheres to around the chamfer 212 on the back surface side of the wiring integration board 207. Accordingly, the burr 220 is collected into the chamfer 212 as shown in FIG. 45, whereby the wiring integration board 207 comes to closely contact the support member 203 perfectly. The chamfer 212 can be formed readily by performing an additional work upon router working of the contour of the wiring integration board 207. By securing the wiring integration board 207 in close contact to the support member 203 in this way, it becomes possible to eliminate the electrical contact failure at the contact between the electric signal input terminal 206 of the wiring integration board 207 and the external output terminal.

(Embodiment 16)

Figure 46:
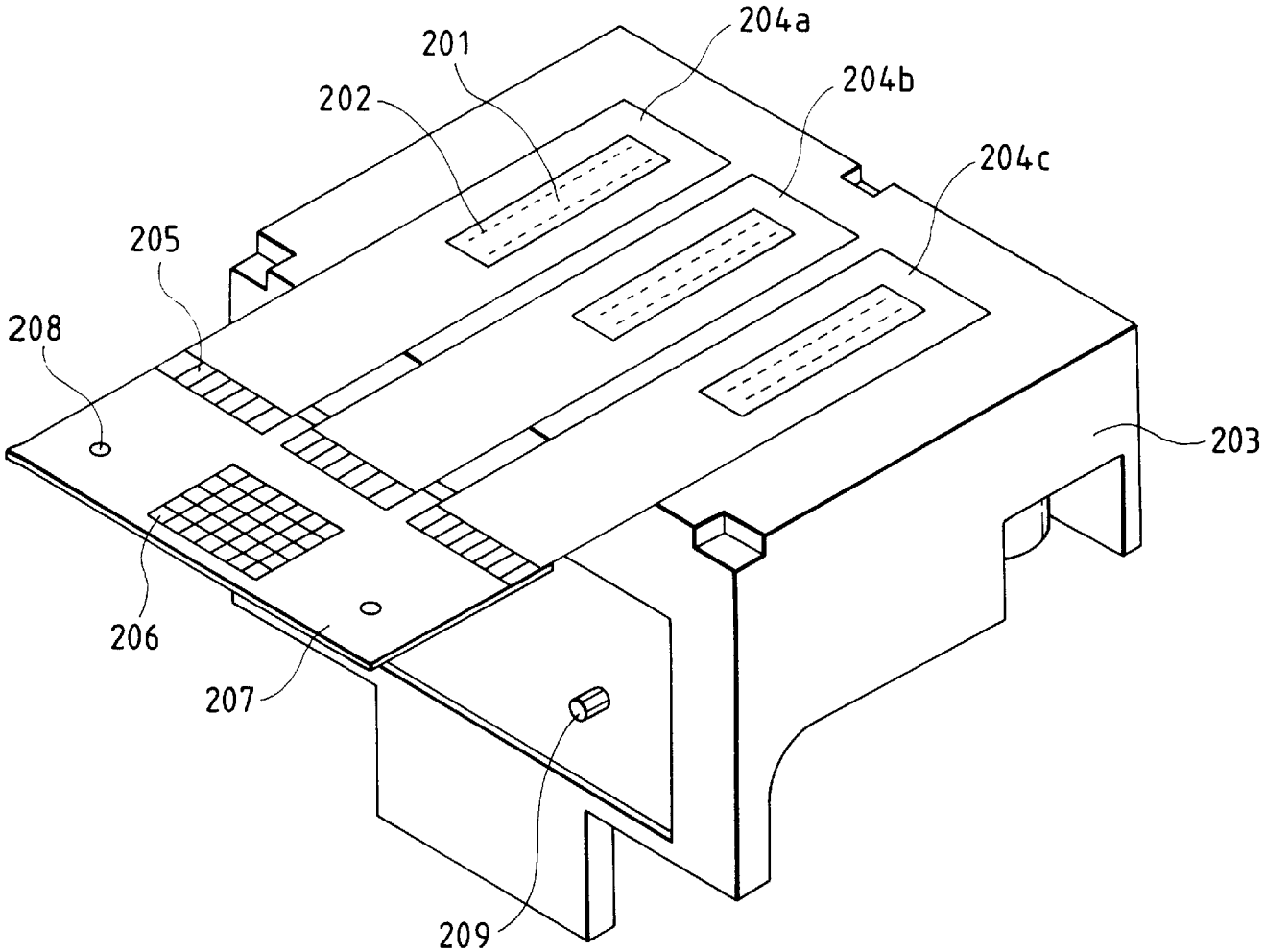
FIG. 46 is an exploded, perspective view of the ink jet recording head according to the sixteenth embodiment of the present invention.
Figure 47:
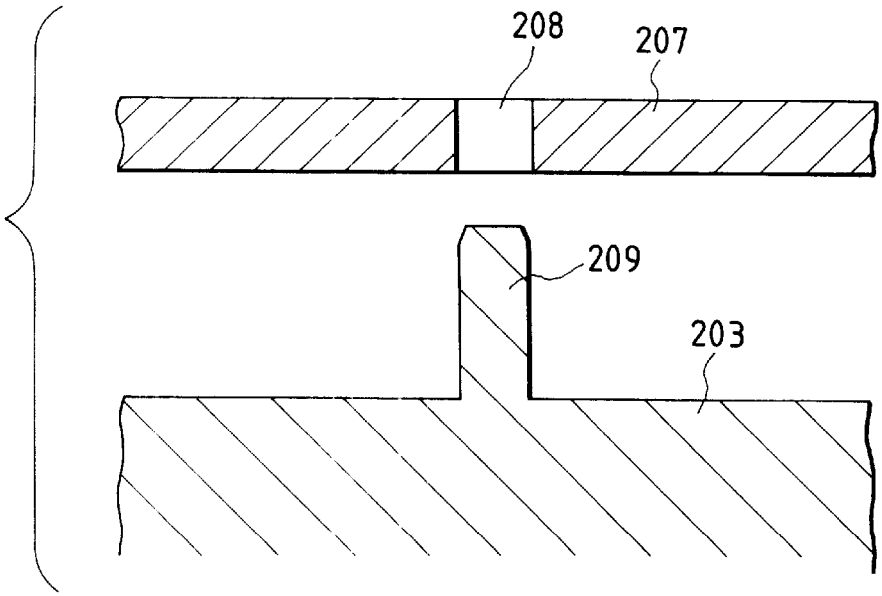
FIG. 47 is a cross-sectional view before assembly of pin and insertion hole according to the sixteenth embodiment of the present invention.
Figure 48:
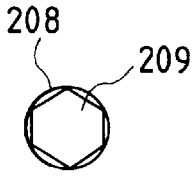
FIG. 48 is a top plan view of the pin and insertion hole shown in FIG. 47, observed from the top of the insertion hole.
Figure 49:
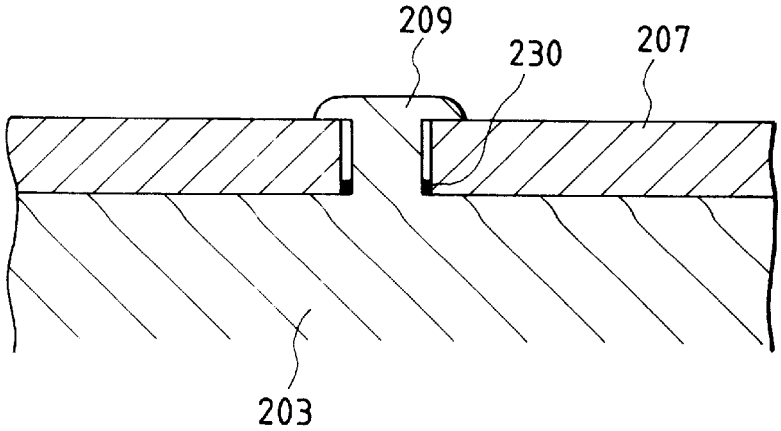
FIG. 49 is a cross-sectional view of the pin and insertion hole after completion of assembly thereof according to the sixteenth embodiment of the present invention.

FIG. 46 is an exploded, perspective view of the sixteenth embodiment of the ink jet recording head according to the present invention. FIG. 47 is a cross-sectional view before assembly of a pin of the support member and an insertion hole of the wiring integration board associated therewith, shown in FIG. 46, and FIG. 48 is a top plan view of FIG. 47 to show the shape of the pin and the positional relation between the insertion hole and the pin. FIG. 49 is a cross-sectional view after completion of assembly of the pin and insertion hole shown in FIG. 47. In these figures, the same reference symbols also denote the same components as those in Embodiment 14, and only different components from Embodiment 14 will be described.

In the present embodiment the pin 209 is of a polygonal prism shape and the present embodiment shows an example of a hexagonal prism, as shown in FIG. 46, FIG. 47, and FIG. 48. There is no special groove provided around the root of pin 209, different from Embodiment 14.

In this arrangement, as shown in FIG. 49, the wiring integration board 207 is fixed to the support member 203 by inserting the pin 209 into the insertion hole 208 and fusing the head of pin 209 by heat to crush it in the same manner as in Embodiment 14. The pin 209 molded of the molding material is shaved during insertion of the pin 209 into the insertion hole 208 to produce fine burr 230. However, the pin 208 is formed in the polygonal prism shape whereby the insertion hole 208 contacts only the corners of the pin 209, so that an amount of burr 230 produced is decreased and so that the burr 230 is collected in the clearance between the insertion hole 208 and the pin 209 as shown in FIG. 49. Accordingly, the wiring integration board 207 can be perfectly in close fit with the support member 203. By securing the wiring integration board 207 in close contact to the support member 203 in this way, it becomes possible to eliminate the electrical contact failure at the contact between the electric signal input terminal 206 of the wiring integration board 207 and the external output terminal.

The above embodiments were described with the examples of the side shooter type, but without having to be limited to this type, the present invention may also be applied to heads of the edge shooter type.

What is claimed is:

1. An ink jet recording head comprising:

a recording element substrate having a heat generating element for generating thermal energy to discharge a recording liquid, a first supply port provided on a surface opposed to a surface on which said heat generating element is provided to supply the recording liquid to a region where said heat generating element is located and an electrically connected terminal provided on said surface on which said heat generating element is provided;

a print wiring substrate connected to said electrically connected terminal of said recording element substrate to apply an electrical pulse for discharging the recording liquid to said heat generating element;

a support member having a second supply port for supplying the recording liquid to said recording element substrate and supporting said recording element substrate so that said first supply port corresponds to said second supply port; and a frame member having an opening larger than said recording element substrate and smaller than said supporting member and joined to said supporting member so that said recording element substrate is located in said opening to hold said print wiring substrate, wherein heat generated by driving said heat generating element is dissipated by said supporting member and said frame member.

2. An ink jet recording head according to claim 1, wherein said recording element board and said support member each comprise a material selected from the group consisting of silicon, alumina, aluminum nitride, silicon carbide, molybdenum, and tungsten.

3. An ink jet recording head as in claim 1, further comprising:

a resin filling a region in the opening portion of said support members where said recording element boards are not placed.

4. An ink jet recording head according to claim 3, wherein said resin has water repellency.

5. An ink jet recording head according to claim 1, further comprising:

a resin filling a surface of a region of said support member where said recording element units are not placed.

6. An ink jet recording head according to claim 5, wherein said resin has water repellency.

7. An ink jet recording head comprising:

a plurality of recording element substrates, each said recording element substrate having a heat generating element for generating thermal energy to discharge a recording liquid, a first supply port provided on a surface opposed to a surface on which said heat generating element is provided to supply the recording liquid to a region where said heat generating element is located and an electrically connected terminal provided on said surface on which said heat generating element is provided;

a plurality of print wiring substrates respectively connected to said electrically connected terminals of said recording element substrates to apply thereto electrical pulses for discharging the recording liquid to said heat generating elements;

a support member having a second supply port for supplying the recording liquid to an associated said recording element substrate and supporting said associated recording element substrate so that said first supply port corresponds to said second supply port; and a frame member having a plurality of openings corresponding to and each larger than said recording element substrates and smaller than said supporting member and joined to said supporting member so that said recording element substrates are located in said openings to hold said print wiring substrates, wherein heat generated by driving said recording elements is dissipated by said support member and said frame member.

8. An ink jet recording head as in claim 7, further comprising:

a wiring integration board for electrically connecting said plurality of wiring substrates with each other; and a wiring support member for holding and securing said plurality of wiring substrates in a partly bent state and for holding and securing said wiring integration board at a predetermined angle relative to said recording element substrates;

wherein areas around bent portions of said wiring substrates are sealed by a resin, and wherein said support member has grooves of a predetermined length on both outer sides of portions thereof corresponding to the bent portions of said wiring substrates.

9. An ink jet recording head as in claim 7, further comprising:

a wiring integration board for electrically connecting said recording element substrates with each other, said wiring integration board having an input terminal for input of an electric signal; and a pin for positioning and securing said input terminal of the wiring integration board and an external output terminal, said pin having a root, said wiring integration board being positioned and secured to at least one said support member by said pin;

wherein a groove is formed around the root of said pin.

10. An ink jet recording head comprising:

a recording element substrate having a plurality of heat generating elements for generating thermal energy to discharge a recording liquid, a first supply port provided on a surface opposed to a surface on which said heat generating elements are provided to supply the recording liquid to a region where said heat generating elements are located and a plurality of electrically connected terminals provided on said surface on which said heat generating elements are provided;

a print wiring substrate connected to said electrically connected terminals of said recording element substrate to apply an electrical pulse for discharging the recording liquid to said heat generating elements;

a support member having a plurality of second supply ports for supplying the recording liquid to said recording element substrate and supporting said recording element substrate so that said first supply port is in fluid communication with at least one of said second supply ports, the recording elements being arranged in a plurality of groups corresponding to said second supply ports; and a frame member having an opening larger than said recording element substrate and smaller than said supporting member and joined to said supporting member so that said recording element substrate is located in said opening to hold said print wiring substrate, wherein heat generated by driving said recording elements is dissipated by said supporting member and said frame member.

11. An ink jet recording head comprising:

a plurality of recording element substrates, each said recording element substrate having a plurality of heat generating elements for generating thermal energy to discharge a recording liquid, a first supply port provided on a surface opposed to a surface on which said heat generating elements are provided to supply the recording liquid to a region where said heat generating elements are located and a plurality of electrically connected terminals provided on said surface on which said heat generating elements are provided;

a plurality of print wiring substrates respectively connected to said electrically connected terminals of said recording element substrates to apply thereto electrical pulses for discharging the recording liquid to said heat generating elements;

a support member having a plurality of second supply ports for supplying the recording liquid to said recording element substrates and supporting said recording element substrates so that said first supply ports are in fluid communication with said second supply ports, the recording elements being arranged in a plurality of groups corresponding to said second supply ports; and a frame member having a plurality of openings corresponding to and each larger than said recording element substrates and smaller than said supporting member and joined to said supporting member so that said recording element substrates are located in said openings to hold said print wiring substrates, wherein heat generated by driving said recording elements is dissipated by said support member and said frame member.

* * * * *

UNITED STATES PATENT AND TRADEMARK OFFICE

CERTIFICATE OF CORRECTION

PATENT NO. : 6,257,703 B1 
DATED : July 10, 2001
INVENTOR(S) : Toshiaki Hirosawa et al.

It is certified that error appears in the above-identified patent and that said Letters Patent is hereby corrected as shown below:

Column 1,
Line 58, “ends” should read -- end --.

Column 11,
Line 46, “cured” should read -- being cured --; and
Lines 54 and 61, “cured.” should read -- being cured. --.

Column 12,
Line 20, “cured,” should read -- being cured, --; and
Lines 25 and 61, “cured” should read -- being cured --.

Column 13,
Line 10, “cured.” should read -- being cured. --.

Column 14,
Line 32, “cured.” should read -- being cured. --.

Column 15,
Line 53, “one” should be deleted.

Column 19,
Line 9, “board 101*a* to 101*c* is” should read -- board 101*a* to 101*c* are --;
Lines 10, 13, 30, 42 and 63, “board 101*a*” should read -- boards 101*a* --;
Line 15, “board to 101*c*” should read -- boards 101*a* to 101*c* and the wiring boards --; and
Lines 31, 55 and 64, “board 104*a*” should read -- boards 104*a* --.
Line 33, “board 101*a* to 101*c* does” should read -- board 101*a* to 101*c* do --;

Column 20,
Lines 12, 13, 14, 16, 27, 63 and 65, “board” should read -- boards --;
Line 29, “board” (both occurrences) should read -- boards --; and
Lines 44 and 46, “board 104*a*” should read -- boards 104*a* --.

Column 21,
Lines 3, 10, 14, 47 and 56, “board” should read -- boards --; and
Line 35, “board” (both occurrences) should read -- boards --.

UNITED STATES PATENT AND TRADEMARK OFFICE

CERTIFICATE OF CORRECTION

PATENT NO. : 6,257,703 B1 
DATED : July 10, 2001
INVENTOR(S) : Toshiaki Hirosawa et al.

It is certified that error appears in the above-identified patent and that said Letters Patent is hereby corrected as shown below:

Column 22,
Lines 1 and 2, "board" should read -- boards --;
Line 13, "to the support" should be deleted.;
Line 14, "plate 108" (first occurrence) should be deleted.; and
Lines 24, 26, 27, 29, 33, 37 and 41, "board 104*a*" should read -- boards 104*a* --;

Column 23,
Lines 29 and 41, "board 104*a*" should read -- boards 104*a* --; and
Line 49, "board" should read -- boards --.

Column 25,
Line 45, "the all" should read -- all --.

Column 26,
Line 54, "an" should be deleted.

Column 28,
Line 7, "members" should read -- member --; and
Line 55, "substrates;" should read -- substrates, --.

Column 29,
Line 5, "pin;" should read -- pin, --.

Signed and Sealed this

Sixteenth Day of July, 2002

*Attest:*

*Attesting Officer*

JAMES E. ROGAN
*Director of the United States Patent and Trademark Office*